US011993932B2

(12) United States Patent
Van Ee

(10) Patent No.: US 11,993,932 B2
(45) Date of Patent: May 28, 2024

(54) GIGACUBES COASTERS AND LIDS

(71) Applicant: Jonathan Hendrik Van Ee, Dublin, CA (US)

(72) Inventor: Jonathan Hendrik Van Ee, Dublin, CA (US)

( * ) Notice: Subject to any disclaimer, the term of this patent is extended or adjusted under 35 U.S.C. 154(b) by 0 days.

(21) Appl. No.: 17/305,446

(22) Filed: Jul. 7, 2021

(65) Prior Publication Data

US 2022/0042307 A1 Feb. 10, 2022

Related U.S. Application Data

(60) Provisional application No. 62/706,234, filed on Aug. 6, 2020.

(51) Int. Cl.
*E04B 1/343* (2006.01)
*E04B 2/00* (2006.01)

(52) U.S. Cl.
CPC ..... *E04C 2/44* (2013.01)

(58) Field of Classification Search
CPC . E04B 1/34315; E04B 1/34331; A63H 66/04; A63H 33/10; A63H 33/101; A63H 33/107; A63H 33/06; A63H 33/062; A63H 33/065; A63H 33/08; A63H 33/088
See application file for complete search history.

(56) References Cited

U.S. PATENT DOCUMENTS 1,779,826 A * 10/1930 Potter ..... A63H 33/06 446/116
3,442,044 A * 5/1969 Quercetti ..... A63F 9/12 446/124
3,611,609 A * 10/1971 Reijnhard ..... A63H 33/101 446/128
3,747,261 A * 7/1973 Salem ..... B23Q 1/545 446/124
4,792,319 A * 12/1988 Svagerko ..... A63H 33/08 446/104
6,050,873 A * 4/2000 Reisman ..... A63H 33/062 446/128
9,517,423 B1 * 12/2016 Kanbar ..... A63H 33/084
2005/0075035 A1 * 4/2005 Hatting ..... A63H 33/101 446/85
2006/0048475 A1 * 3/2006 Lin ..... A63H 33/088 52/589.1
2007/0173095 A1 * 7/2007 Bin-Nun ..... A63H 33/108 439/219
2008/0160875 A1 * 7/2008 Leicht ..... A63F 9/12 446/124
2012/0032393 A1 * 2/2012 Leicht ..... A63H 33/107 273/156

(Continued)

*Primary Examiner* — William V Gilbert

(57) ABSTRACT

The Invention is primarily a series of panels that are coasters, or cubes that can be assembled into coasters, that can also be assembled into a really wide range of useful objects like homes, tables, walls, boxes and much more. The panels have smooth surfaces, surfaces with a series of interfaces, and the edges of the panels have interfaces that snap, hook, hold together magnetically, screw and assemble with these interfaces and combinations of these interfaces. The panels, and blocks and other constructions built with the pieces, are locked when spheres are inserted into them and they are locked and reinforced when poles are inserted into them.

1 Claim, 75 Drawing Sheets

(56) References Cited

U.S. PATENT DOCUMENTS

| | | | | |
|---|---|---|---|---|
| 2013/0165012 | A1* | 6/2013 | Klauber | A63H 33/04<br>446/102 |
| 2017/0173487 | A1* | 6/2017 | Woolston | A63H 33/086 |
| 2018/0339237 | A1* | 11/2018 | Lim | A63H 33/106 |
| 2020/0238190 | A1* | 7/2020 | Tusacciu | A63H 33/08 |
| 2021/0282373 | A1* | 9/2021 | Boileau | A63H 33/062 |

* cited by examiner

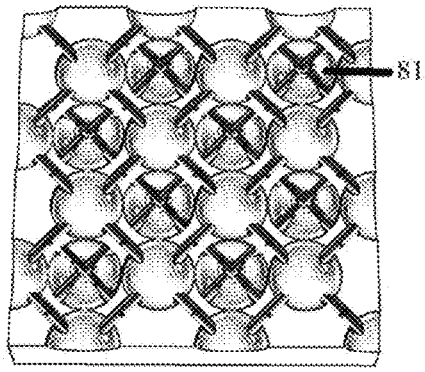
Fig. 24A
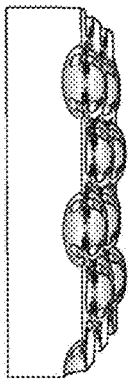
Fig. 25C
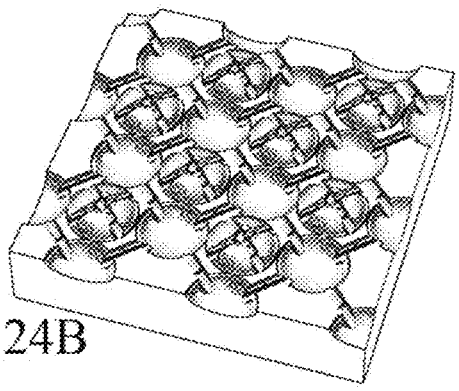
Fig. 24B
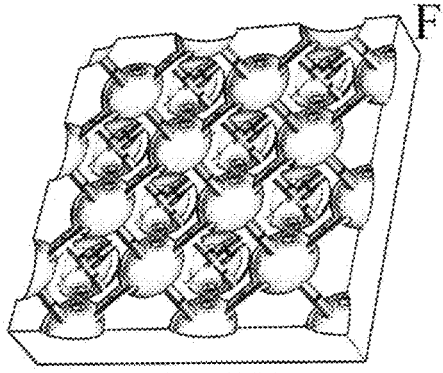
Fig. 25D
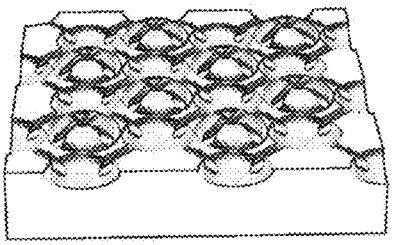
Fig. 24C
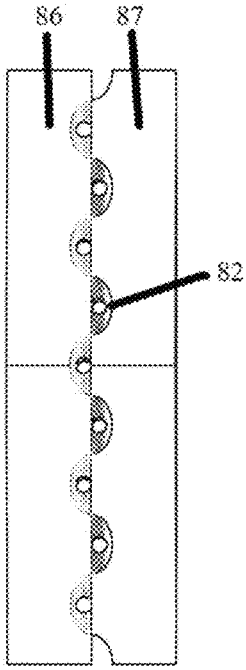
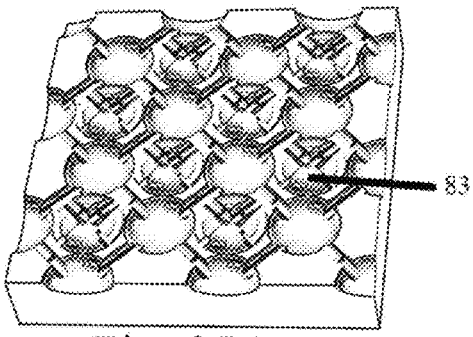
Fig. 25A
Fig. 26A
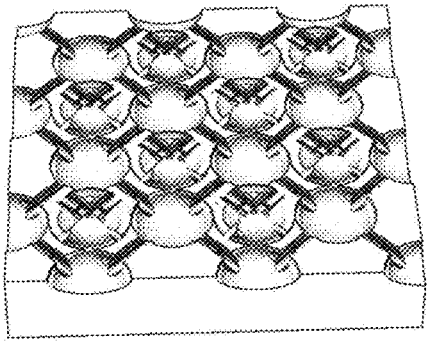
Fig. 25B
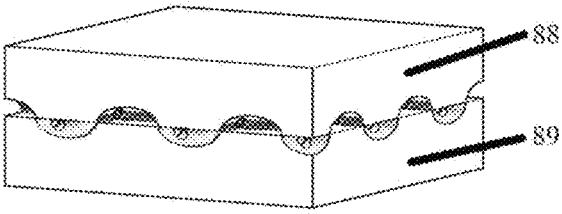
Fig. 26B
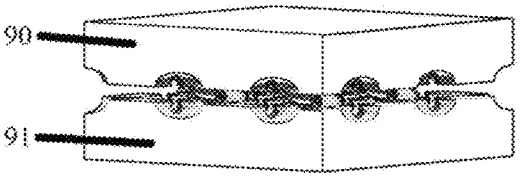
Fig. 26C

GIGACUBES COASTERS AND LIDS

BACKGROUND OF THE INVENTION

Field of the Invention

Gigacubes Coasters & Lids (the "Invention") uses a wide range of versatile interfaces like hooks, knobs screws, magnets and more to be (and to form) coasters and modular building blocks with which homes, tables, food containers and a wide range of additional things can be assembled.

Description of Related Art

Coasters that snugly stack for compact storage.
Containers with lids.
Boxes with lids that fit snugly onto the box.

BRIEF SUMMARY OF THE INVENTION

The Invention is beautiful, simple and versatile coaster pieces that are also conversation pieces because they also are puzzles, toys and building blocks.

The Invention allows a wide array of useful objects that, in addition to being (or forming) coasters, are also square bowls and building blocks that can be stacked to store well, build things and be tangible three-dimensional art.

The Invention uses a wide range of modular, interchangeable and powerful interfaces to achieve its purposes through knobs, hooks, magnets, screws hinges, and additional interfaces and combinations of those interfaces.

The Invention's coasters build blocks, boxes, shelves, walls, roofs and perform the role of panels and barriers.

BRIEF DESCRIPTION OF THE SEVERAL VIEWS OF THE DRAWINGS

FIG. 198 is a profile view of the side of FIG. 19A.

FIG. 20B is a view of the assembled pieces shown in FIG. 20A when one of the FIG. 19A pieces that make up FIG. 20A are viewed head-on.

FIG. 20A is resting on a flat surface.

FIG. 24A is a panel with compressed spheres that fit together in the manner shown in FIGS. 26A and 26B. Once together, they can be locked in place with poles or spheres inserted into the holes that appear in FIG. 26A.

FIG. 24B is a top corner view of FIG. 24A.

FIG. 24C is atop side view of FIG. 25A.

FIG. 25A is similar to FIG. 24A except the compressed spheres have less sphere quadrants. As a result, they can be assembled not just in the manner shown in FIGS. 26A and 268 but they can also be assembled in the manner shown in FIG. 26C and FIG. 26D, which can also be locked with poles.

FIG. 258 is atop side view of FIG. 25A,

FIG. 25C is a side view of FIG. 24A,

FIG. 25D is a top side view of FIG. 24A

FIG. 26A is a profile view of shapes in the form of FIG. 25A and FIG. 24A pressed together.

FIG. 26B is a top corner view of the assembled pieces in FIG. 26A.

FIG. 26C is a demonstration of how two pieces that are in the shape of FIG. 25A can assemble to allow more space than the manner of assembling them shown in FIG. 26B.

FIG. 29A is a knob panel whose knobs can fit into themselves.

FIG. 29B is a top side view of FIG. 29A.

FIG. 29C is a vertical example of FIG. 29A.

FIG. 29D is a top view of FIG. 29A.

FIG. 29E is another top side view of FIG. 29A.

FIG. 30A is a knob panel that fits into itself and that has longer knobs for greater stability and temperature insulation when used as a coaster.

FIG. 30B is a top corner view of FIG. 30A.

FIG. 30C is a vertical example of FIG. 30A.

FIG. 30D is a view from a top side of FIG. 30A.

FIG. 30E is a view from further up on a top side of FIG. 30A.

FIG. 31A is a panel of compact male knobs that builds larger panels with FIG. 27A.

FIG. 31B is a top side view of FIG. 31A.

Figure 31A:
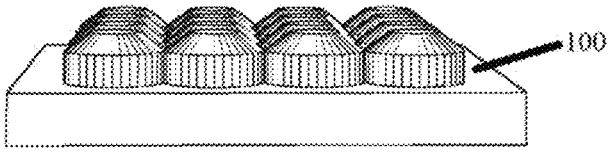
Figure 31B:
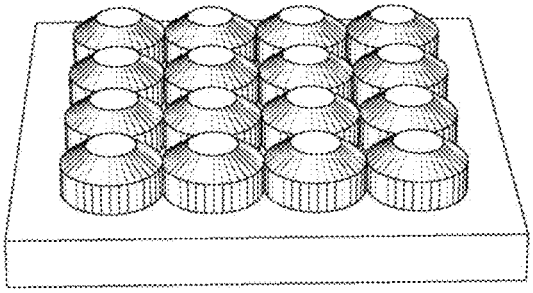
Figure 31C:
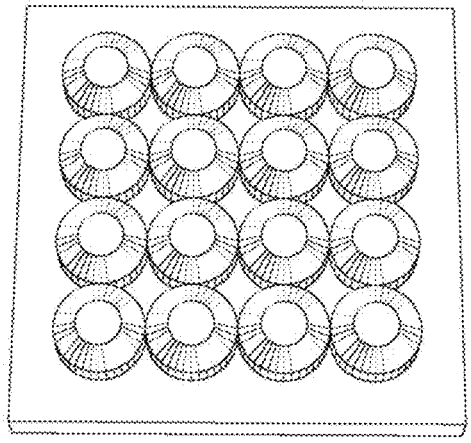

FIG. 31C is a top view of FIG. 31A.

Figure 31D:
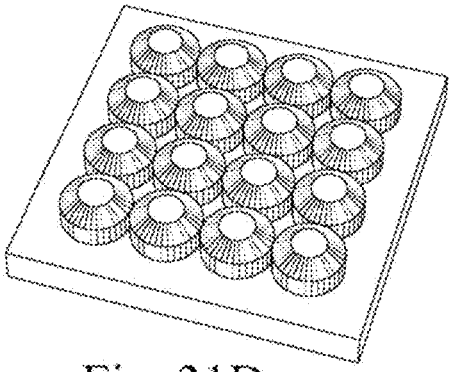

FIG. 31D is a top corner view of FIG. 31A.

Figure 32A:
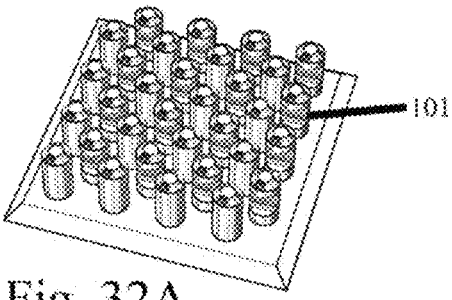
Figure 32B:
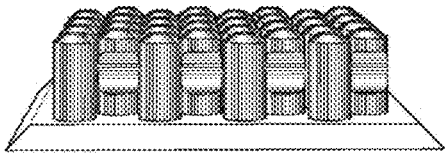
Figure 32C:
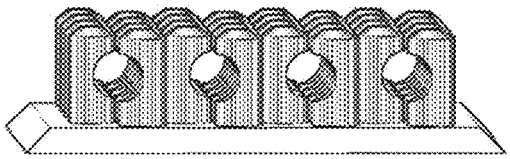
Figure 32D:
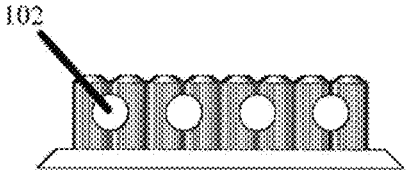

FIG. 32A is a reversible panel that locks when poles and spheres are inserted into the holes seen in FIG. 32D when it is inserted into itself.

FIG. 32B is a top side view of FIG. 32A.

FIG. 32C is a top side view of FIG. 32A from another angle.

FIG. 32D is a profile view from the side of FIG. 32A.

Figure 33A:
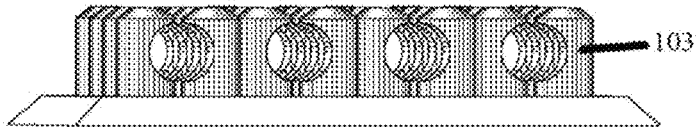

FIG. 33A is similar to FIG. 32A except its knobs are shorter.

Figure 33B:
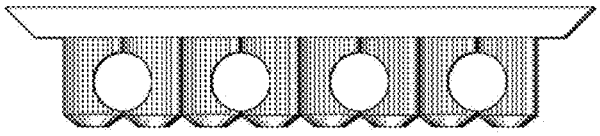

FIG. 33B is a profile view from the side of an upside-down FIG. 33A.

Figure 33C:
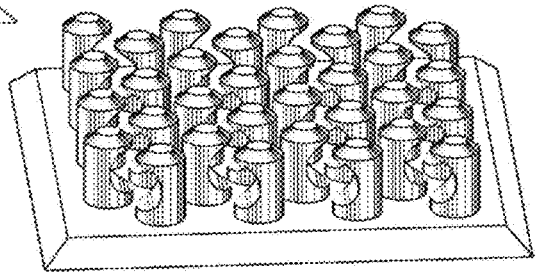

FIG. 33C is a top side view of FIG. 33A.

Figure 34A:
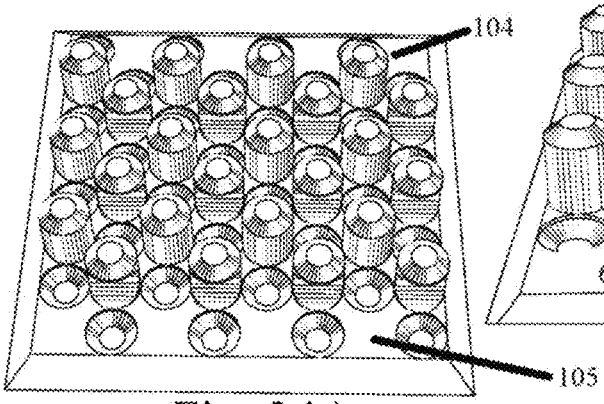
Figure 35A:
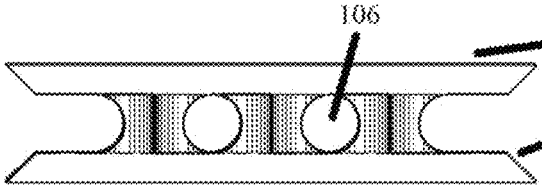
Figure 35B:
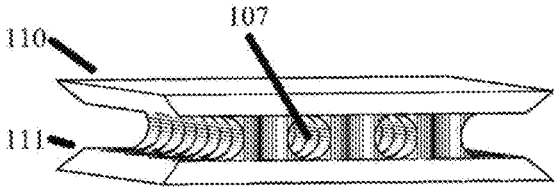

FIG. 34A is similar to FIG. 33A except its knobs are shorter and it has empty rows of male knobs on the ends to give it more versatility when affixed next to other panels that have protruding pieces. It can be locked with poles and spheres when assembled as shown in FIGS. 35A and 35B.

Figure 34B:
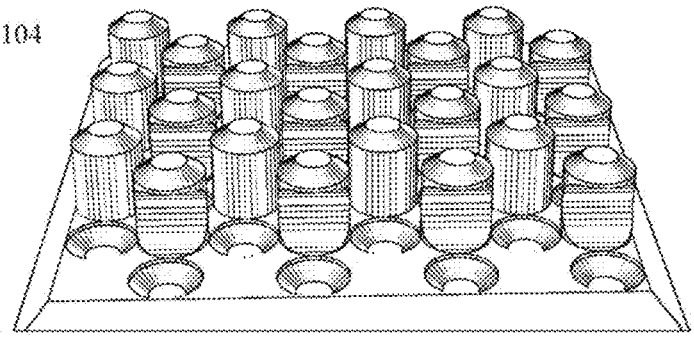

FIG. 34B is a top side view of FIG. 34A.

Figure 34C:
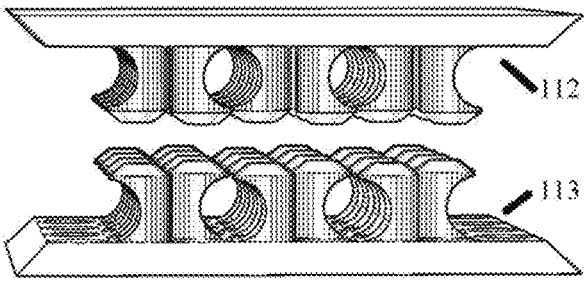

FIG. 34C is an example of how two pieces in the shape of FIG. 34A can fit together when pushed into each other.

Figure 34D:
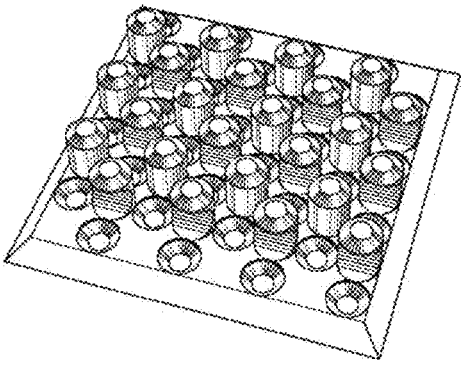

FIG. 34D is a top corner view of FIG. 34A.

FIG. 35A is a profile view of the pieces in FIG. 34C after they have been pushed together.

FIG. 35B is a side view at an angle of FIG. 35A.

Figure 36A:
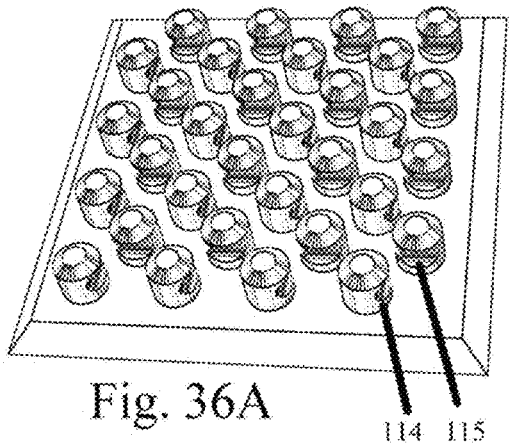

FIG. 36A is similar to the preceding panels except the locking shafts into which poles lock the pieces when they are affixed to themselves run in two directions and at 90 degrees to each other, making it a more versatile building piece that can be locked in more than one direction.

Figure 36C:
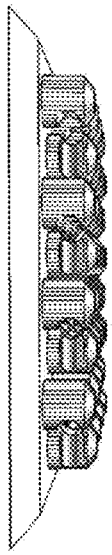
Figure 36B:
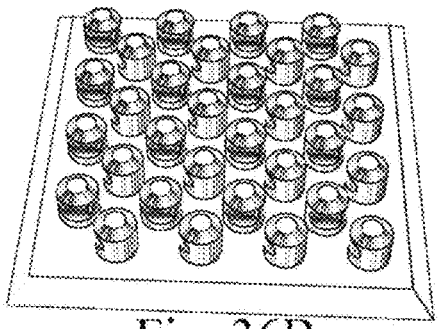

FIG. 36B is a top side view of FIG. 36A from a different angle.

FIG. 36C is a vertical view of FIG. 36A.

Figure 37A:
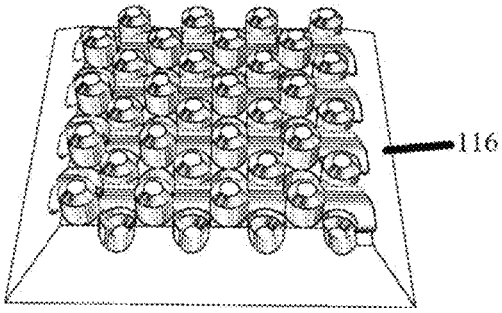
Figure 37C:
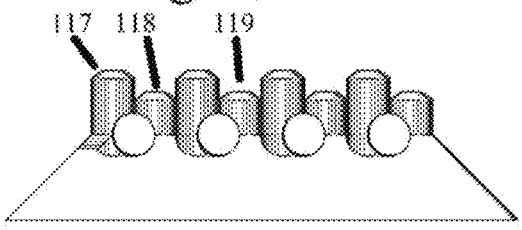
Figure 38:
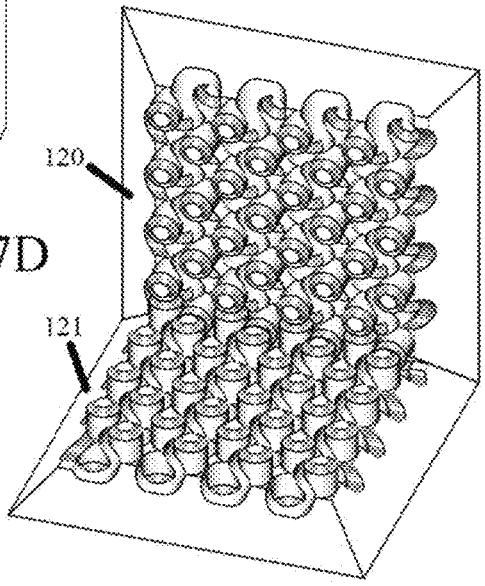

FIG. 37A is similar to the prior FIGs. except it has large sloping sides that can be magnetized to help it make cubes in the manner shown in FIG. 38. The alternating "higher and lower" heights of its male knobs seen in FIG. 37C also allows the gaps between those higher male knobs to operate as receding places (or female interfaces) for male knobs to be inserted.

Figure 37B:
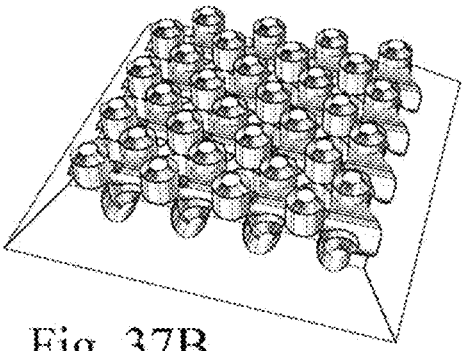

FIG. 37B is a top corner view of FIG. 37A.

FIG. 37C is a side profile view of FIG. 37A.

Figure 37D:
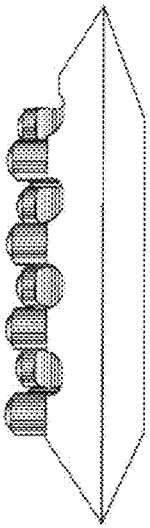

FIG. 37D is a vertical view of FIG. 37A.

Figure 37E:
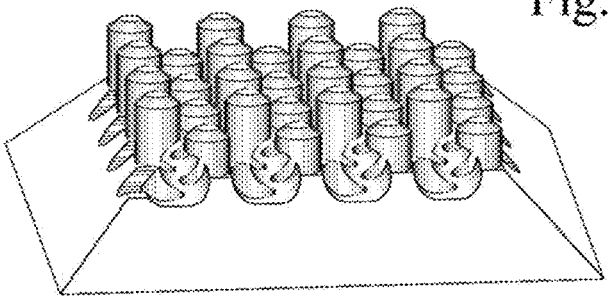

FIG. 37E is a side view of FIG. 37A.

Figure 37F:
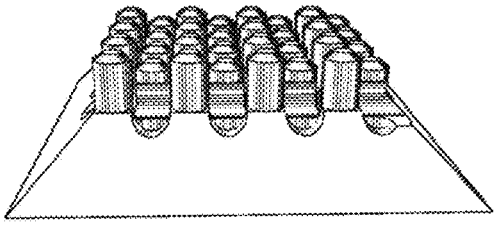

FIG. 37F is a side view of FIG. 37A from a different angle.

Figure 37G:
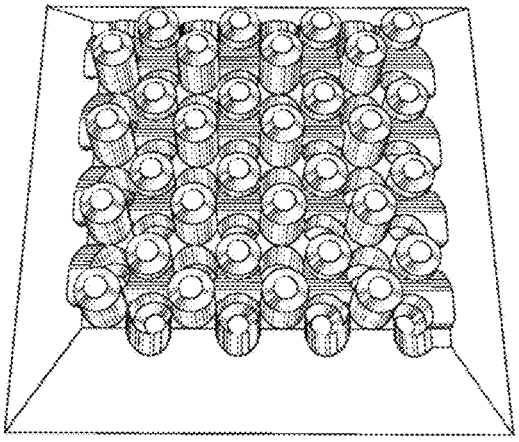

FIG. 37G is a top view of FIG. 37A.

Figure 37H:
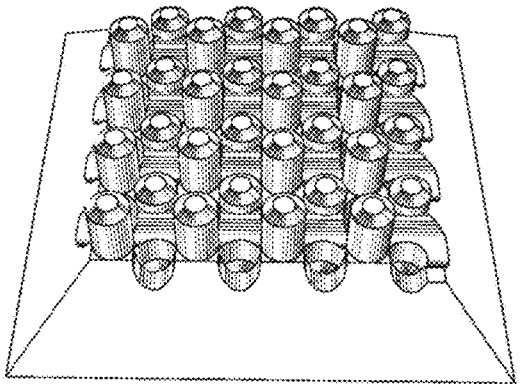

FIG. 37H is a top side view of FIG. 37A from a slightly different angle.

FIG. 38 is a demonstration of how FIG. 37A with magnetized sides make a cube.

Figure 39A:
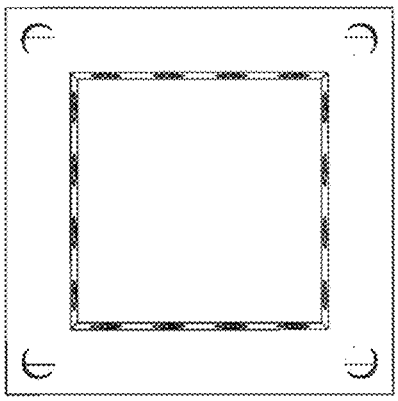

FIG. 39A is a profile view from the bottom of FIG. 39A.

Figure 39B:
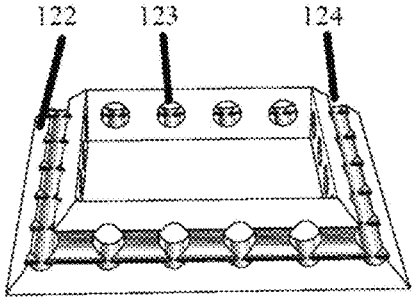

FIG. 39B is a basic panel outline whose slanted sides can be magnetized to allow it to form panels and cubes. Magnetized poles can then be inserted to join panels or to reinforce them.

Figure 39C:
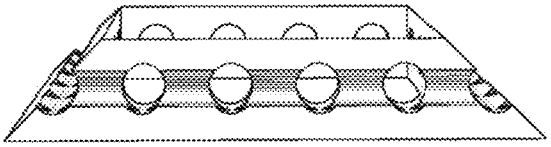

FIG. 39C is a view from a side of FIG. 39B.

Figure 39D:
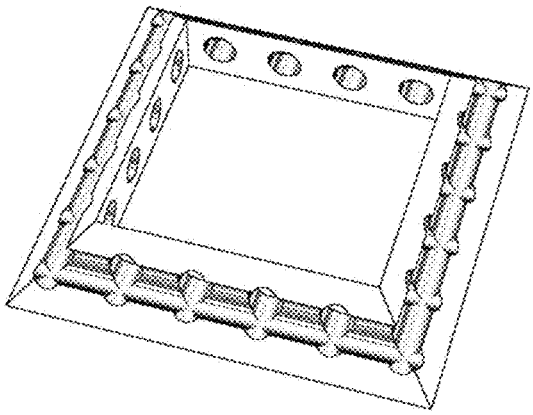

FIG. 39D is a top corner view of FIG. 39B.

Figure 39E:
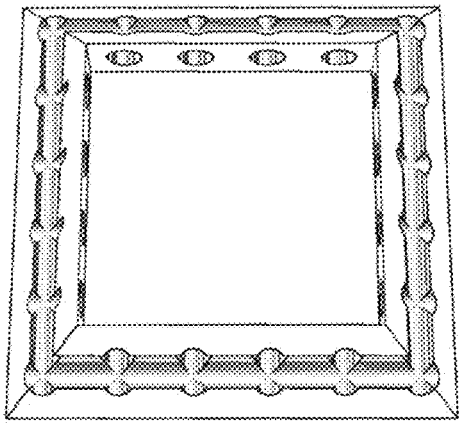

FIG. 39E is a top view of FIG. 398.

Figure 40A:
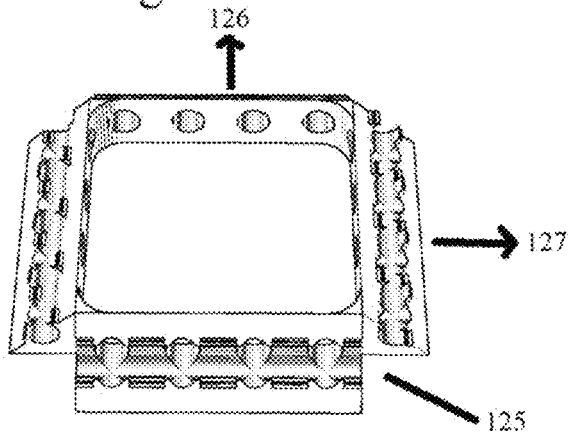

FIG. 40A is similar to FIG. 39B except it has empty corners that allow it to form panels in two directions (not just in one direction) and it has reversible snaps (shown close-up in FIGS. 40C and 40D) with which it can hold itself together. Those snaps are locked when poles or spheres are inserted into the open cylindrical space that exists on the sides of the pieces when they are assembled.

Figure 40B:
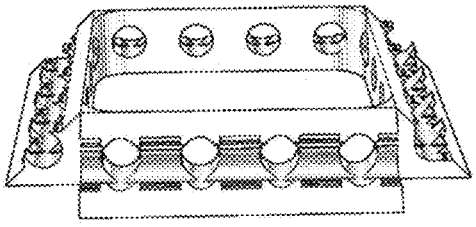

FIG. 40B is a side view of FIG. 40A.

Figure 40C:
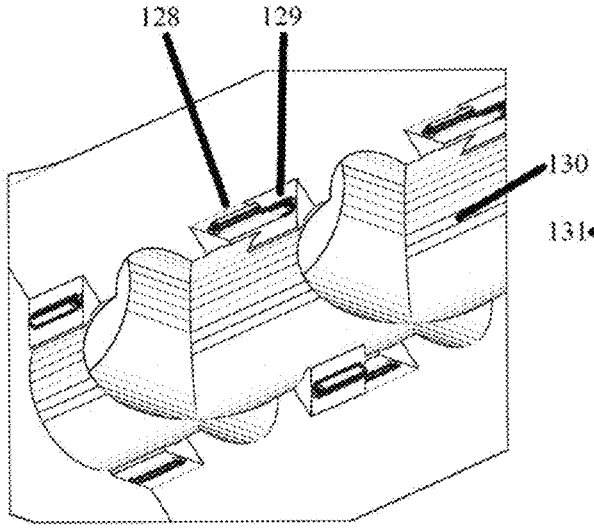

FIG. 40C is a close-up view at an angle of the snaps on FIG. 40A.

Figure 40D:
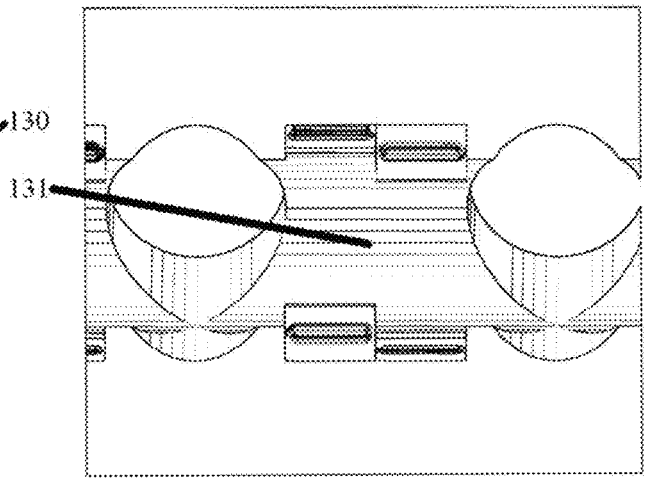

FIG. 40D is a head-on close-up view of the snaps on FIG. 40A.

Figure 40E:
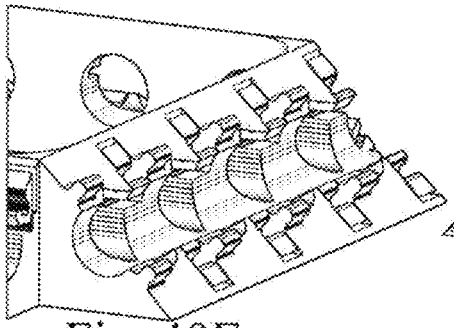

FIG. 40E is a close-up view at an angle of a side of FIG. 40A.

Figure 40F:
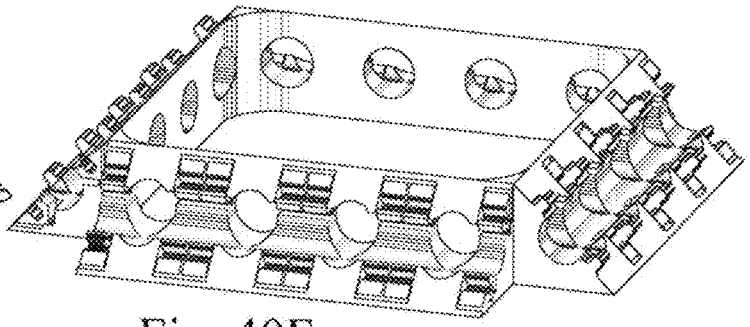

FIG. 40F is a view from a top side corner of FIG. 40A.

Figure 41A:
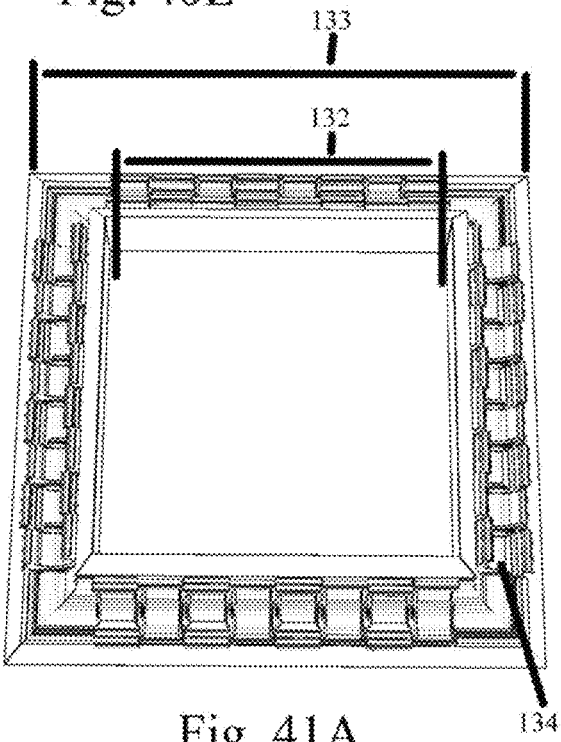

FIG. 41A is a panel similar to the prior panels in that the ratios of the empty center space to the total size of the piece are the same. Also, the circular recess on the sides of the piece are the same dimensions as those of the prior pieces. That circular space is one half the size of the border area.

Figure 41B:
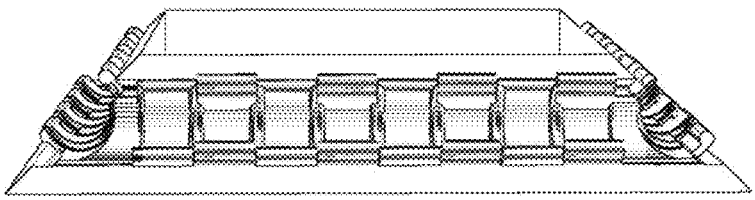
Figure 41C:
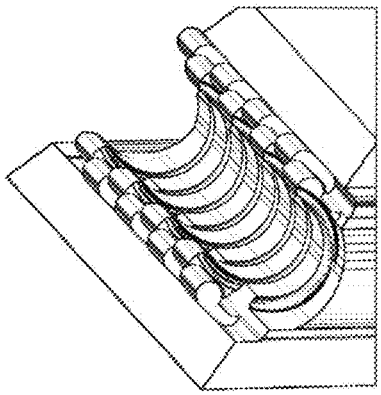

FIG. 41B is a side view of FIG. 41A,

FIG. 41C is a close-up view of aside of FIG. 41A.

Figure 42:
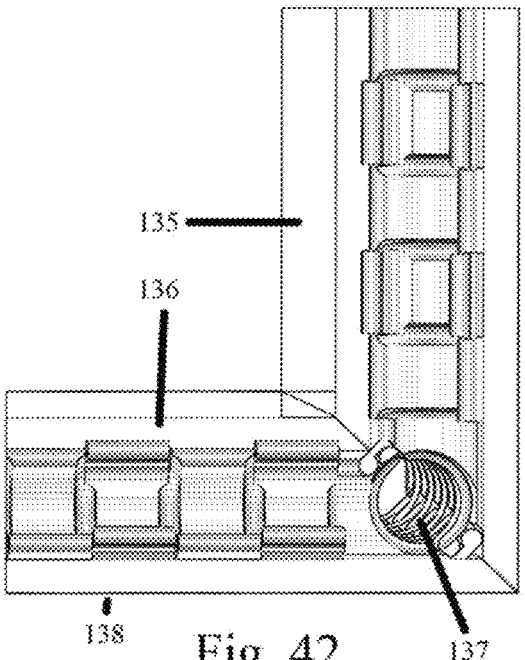

FIG. 42 shows how FIG. 41A fits into itself to form a 90-degree joint. With additional panels an entire cube can be assembled. With reversible magnetic patterns on the flat side of the piece, the assembled cubes can in turn be assembled into walls that that have a lattice or scaffolding appearance. The hole in the bottom right of FIG. 42 shows how the pieces snap together on their own and how, once snapped together, they can be locked with spheres inserted into that open area. Also, they can be locked and reinforced with poles inserted into that opening area.

Figure 43A:
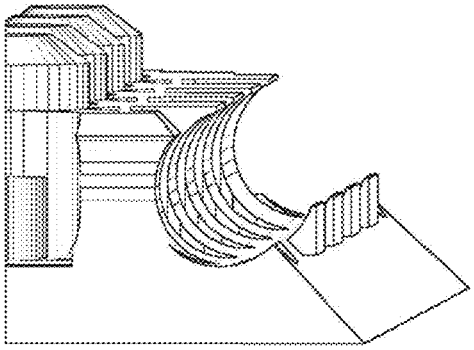
Figure 43B:
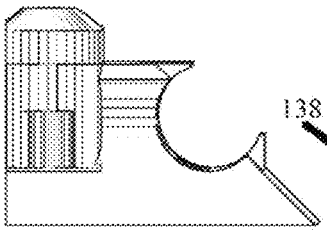
Figure 43C:
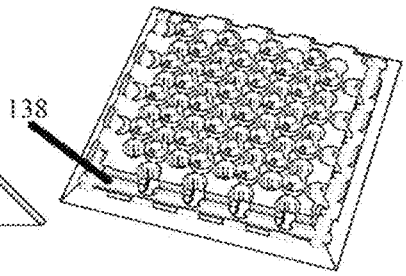

FIG. 43A is a close-up view of a side of the panel that is FIG. 43C.

FIG. 43B is a profile view of the side of the panel shown in FIG. 43C.

Figure 43D:
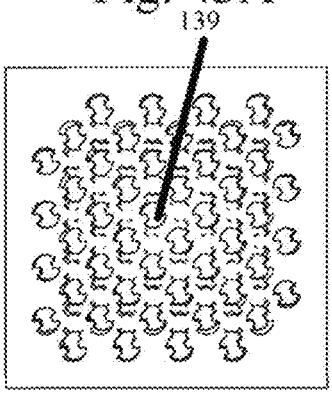
Figure 43E:
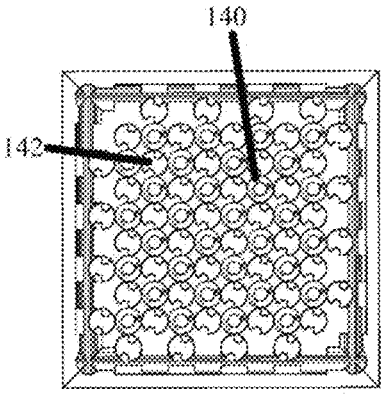
Figure 48A:
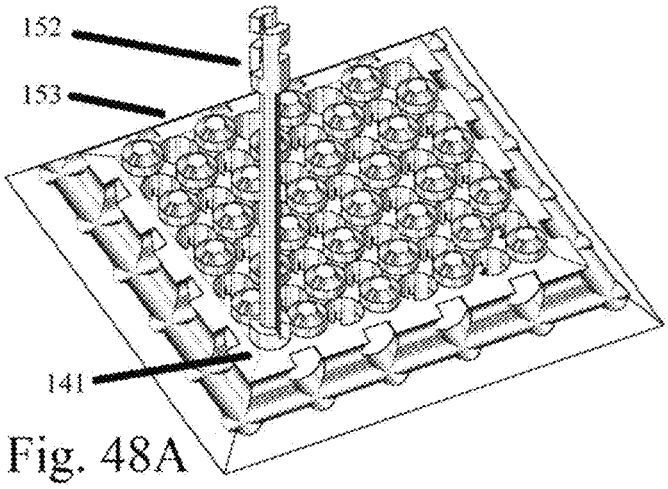

FIG. 43C is a panel that is similar to the prior panels except that its reversible edges are secured in place with the insertion of poles or spheres. The edges can also be magnetized in a reversible manner that allows it to be assembled with more stability and strength. The center pan of FIG. 43A has an artistic pattern of holes that allow light through as is seen in FIGS. 43D and 43E. Those holes also can secure pieces together with knobs that have the shape of those holes as is shown in FIG. 48A. In addition, the panels can be secured together with poles that have hooks that grab onto the point that protrudes into the hole when the poles are inserted into that hole and rotated to hook in place. That pole is FIG. 48B.

FIG. 43D is a profile view from the bottom of FIG. 43C.

FIG. 43E is a profile view from the top of FIG. 43C.

Figure 44A:
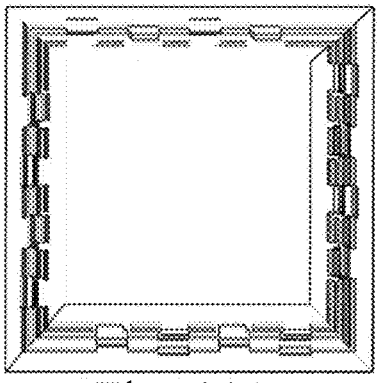

FIG. 44A is a panel that follows the same basic logic as the prior panels except that the hole on the side is much smaller and is also a snapping mechanism. As with the standard operating abilities of these panels, this panel can be assembled at 90-degree and 180-degree angles to form larger panels or to form cubes. Once snapped in place, this FIG. 44A can be locked with a pole or with spheres that are much smaller in sin relative to the total size of the panel. The ratios of sizes of features in these panels, like the small hole in this piece, are all of a standard nature in that they are either one half the size of the height of the piece, one fourth, one eighth the size, etc. This facilitates scaling and adjusting the features to make them compatible with all other pieces.

Figure 44B:
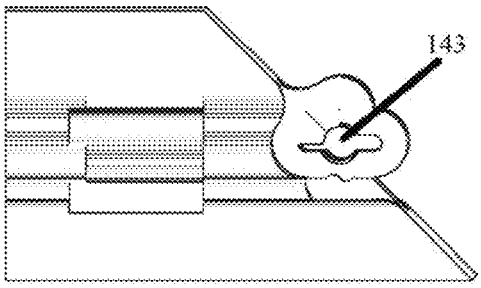

FIG. 44B is a profile close-up view of a side of FIG. 44A.

Figure 44C:
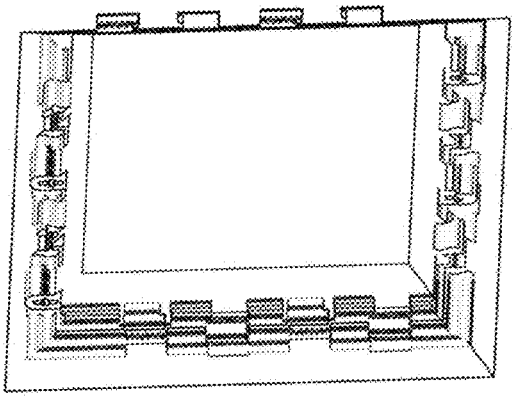

FIG. 44C is a view from a top side of FIG. 44A.

Figure 44D:
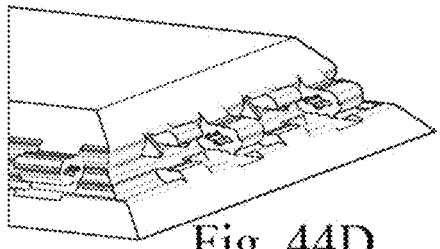

FIG. 44D is a view from an angle of one of the sides of FIG. 44A.

Figure 45A:
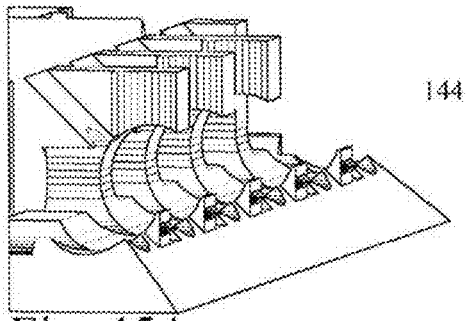
Figure 45B:
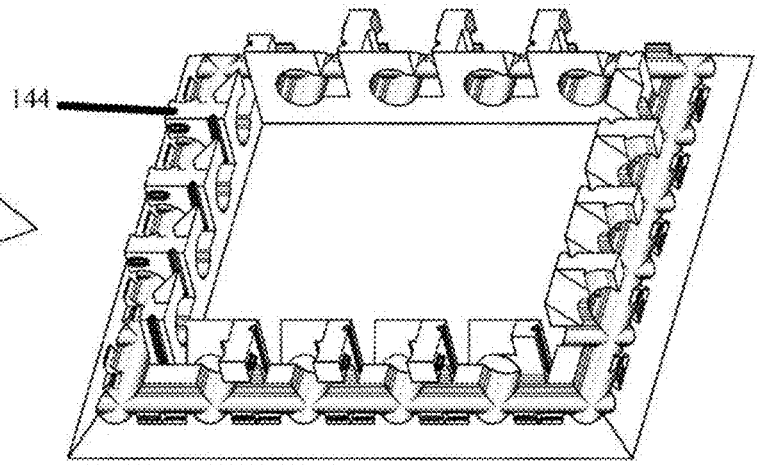

FIG. 45A is a close-up view of a side of FIG. 45B.

Figure 46:
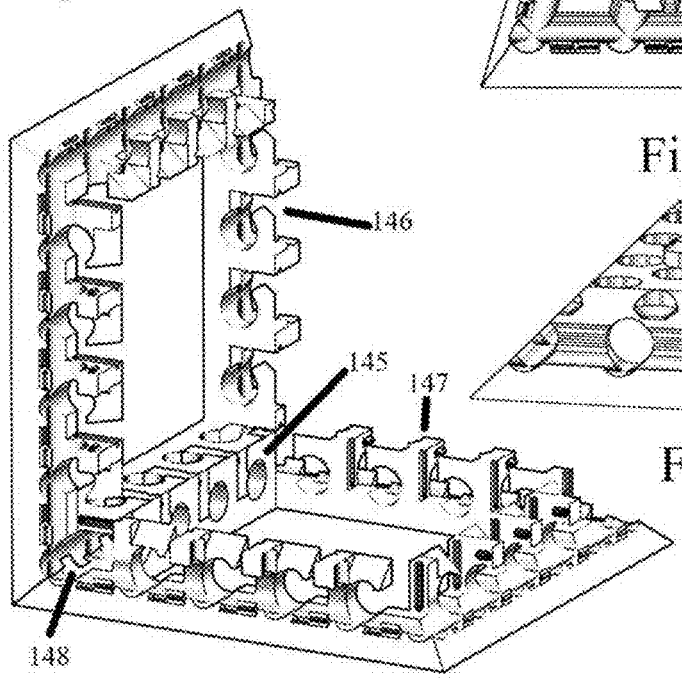

FIG. 45B is a panel that also uses its sides to be large hooks that fit into themselves when the panels are assembled in the manner shown in FIG. 46. Those hooks can be locked with poles and spheres. This panel can also assemble at 180-degree angles.

Figure 45C:
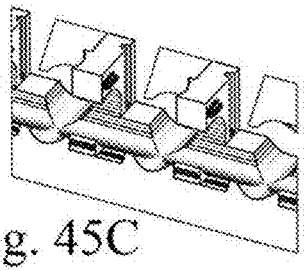

FIG. 45C is a close-up view of the side of FIG. 45B.

FIG. 46 shows how the FIG. 45B panels assemble.

Figure 47A:
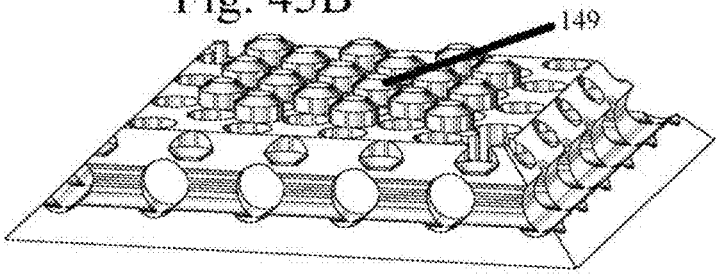

FIG. 47A is a panel following the logic of the prior panels and it can affix itself together with a reversible knob panel in the middle as can be seen in FIG. 47A. FIG. 47C shows the hole pattern that also exists in the middle of the piece through which poles can hook to affix this panel to itself with a pole that has hooks on the end in the manner shown in FIG. 48A. The pole is FIG. 48B and a closeup view of the hook interface at the end of that pole is FIG. 48C.

Figure 47B:
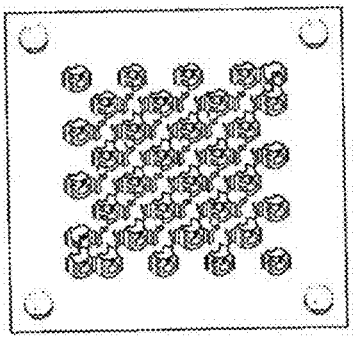
Figure 47C:
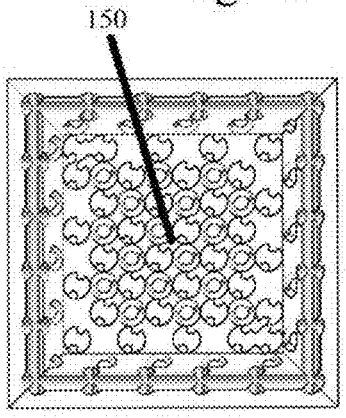

FIG. 47B is a view from the bottom of FIG. 47A.

FIG. 47C is a profile view from the top of FIG. 47A.

Figure 47D:
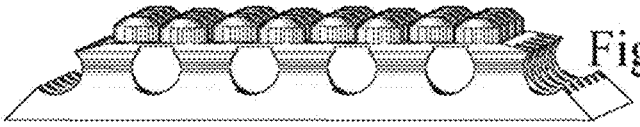

FIG. 47D is a side view of FIG. 47A.

Figure 48B:
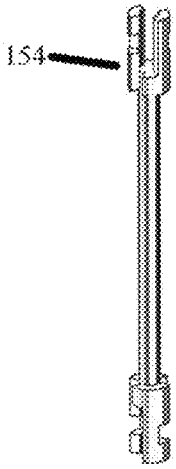

FIG. 48A is a demonstration of how the pole that is FIG. 48B fits into the panel that is FIG. 47A.

FIG. 48B is a pole that is into the hole in FIG. 43A.

Figure 48C:
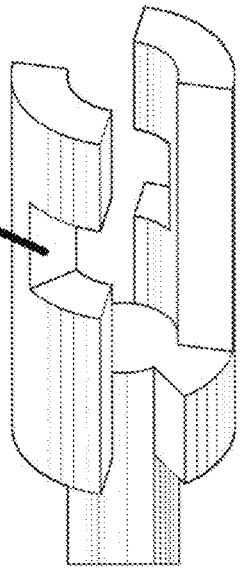

FIG. 48C is a closeup view of the hook interface at the end of FIG. 48B.

Figure 49A:
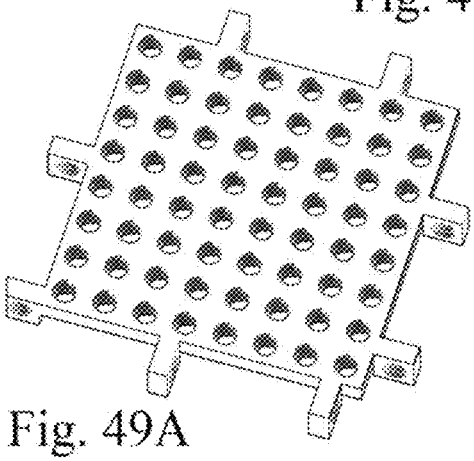
Figure 49B:
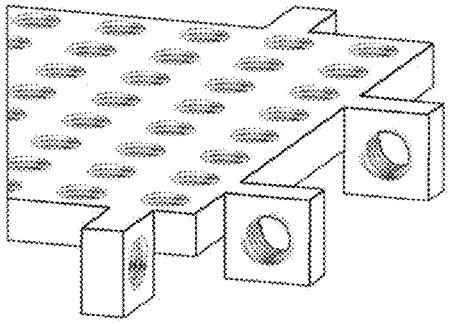
Figure 49C:
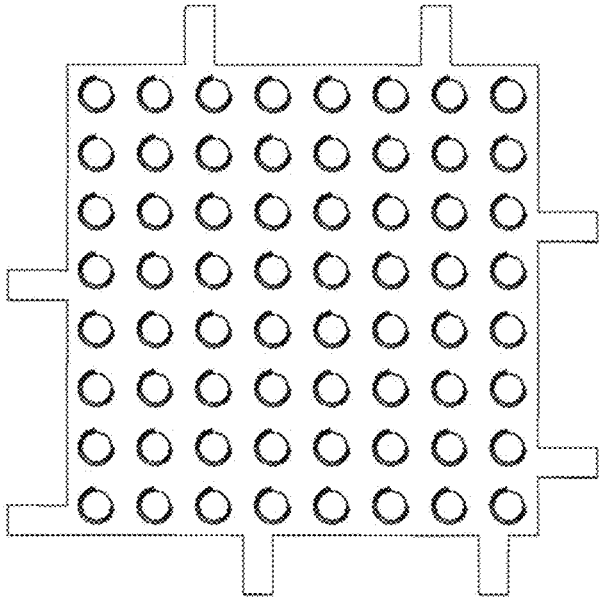
Figure 49D:
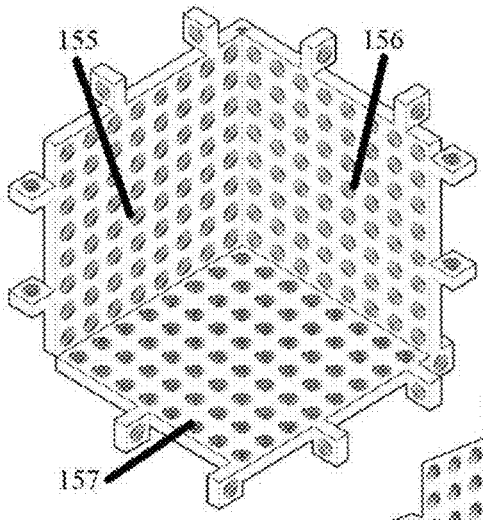
Figure 49E:
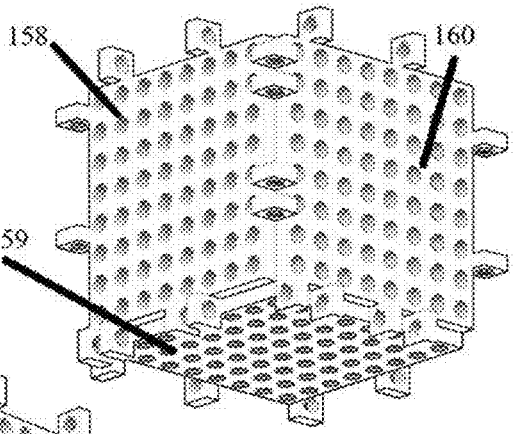
Figure 49F:
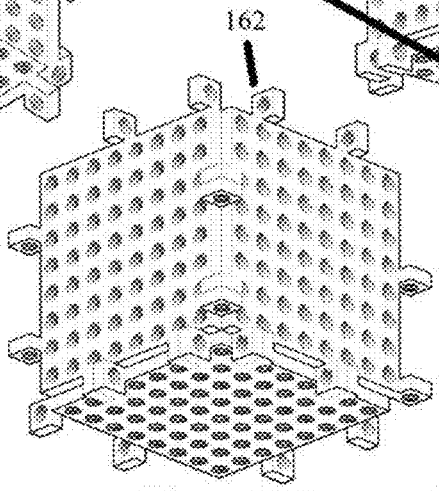
Figure 49G:
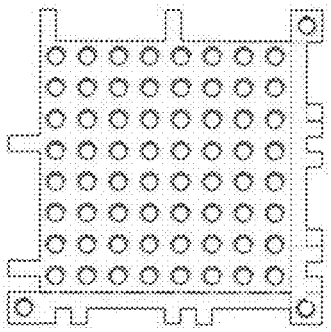
Figure 49H:
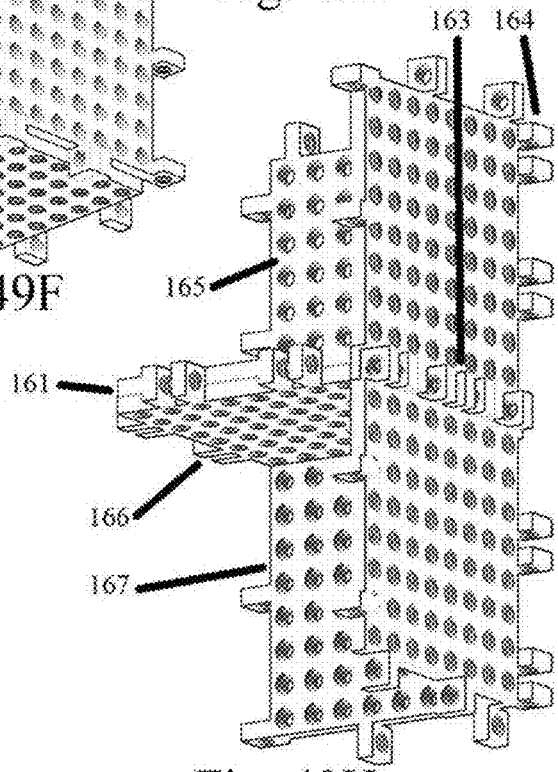

FIG. 49A is a panel that can be assembled into a larger panel, into a cube (FIGS. 49D and 49E) and into cube walls that form the shape of shelving (see, for example, FIG. 49H). FIG. 49G is a profile view from the top of the partially assembled cube at FIGS. 49D and 49E. For the panel to fully assemble into intersecting cubes at each 90-degree angle, the hollow cubes on its edges must be aligned in the manner shown in FIG. 49F. That way, when assembled into the shape at FIG. 49H, that shape will in turn fit into itself (FIG. 49H forms a partial set of cubes, but does not fit into itself on the right side because the hollow cubes on the edges are not aligned to all fit snugly).

FIG. 49B is a close-up view at an angle of a side of FIG. 49A.

FIG. 49C is a profile view from the top of FIG. 49A.

FIG. 49D is a demonstration of a partially assembled cube with FIG. 49A shapes.

FIG. 49E is a view of the back side of FIG. 49D.

FIG. 49F is a demonstration of a different way to assemble panels that are FIG. 49A.

FIG. 49G is a profile view from the top of FIG. 49A panels assembled into each other.

FIG. 49H is an example of more FIG. 49A panels assembled into each other.

Figure 50A:
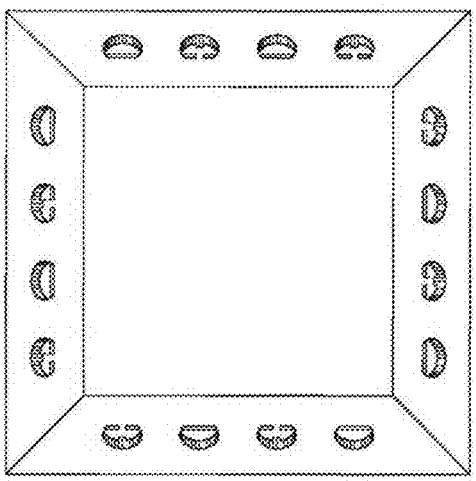
Figure 50B:
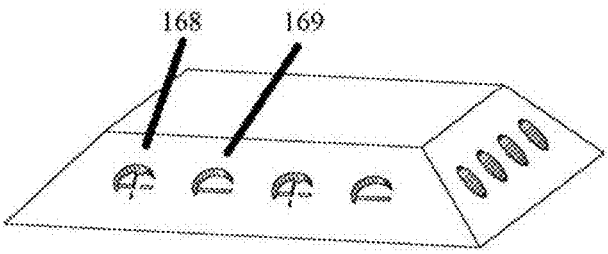

FIG. 50A is a profile view from the top of FIG. 50B.

FIG. 50B is a panel that can have disc magnets inserted in the positive and negative pattern shown to attract the panel to itself to form larger panels and cubes.

Figure 51A:
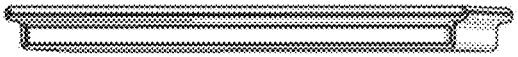

FIG. 51A is a coaster that also fits into boxes to form a lid. It also forms vertical stacked constructions when assembled with the panels that follow it at FIG. 52A and following.

Figure 51B:
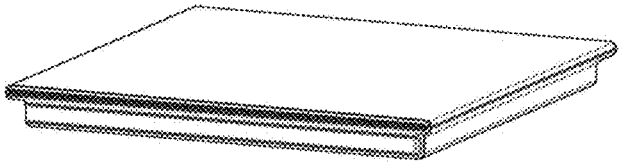

FIG. 51B is a view from a top corner of FIG. 51A.

Figure 51C:
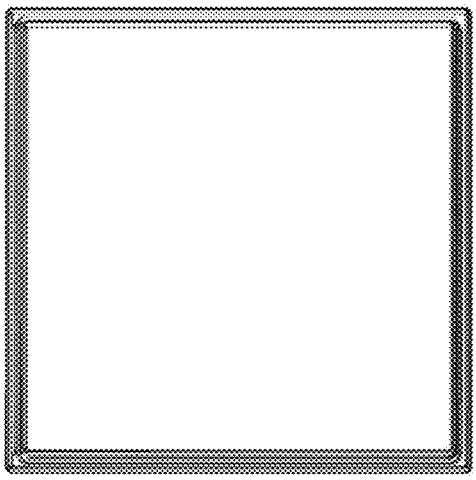

FIG. 51C is a profile view from the bottom of FIG. 51A

Figure 52A:
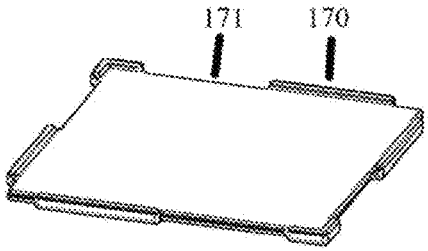
Figure 55A:
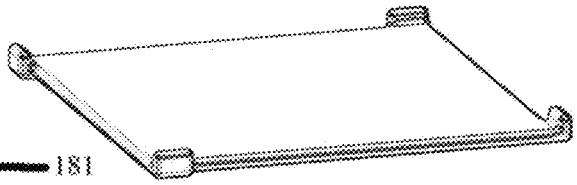
Figure 55B:
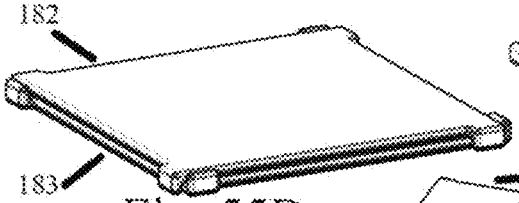

FIG. 52A is a reversible coaster series that can stack with pieces in the series itself manner generally similar to the assembled pieces demonstrated in FIG. 55B.

Figure 52B:
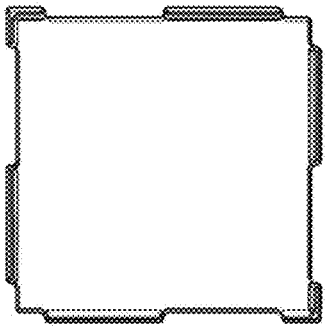

FIG. 52B is a profile view from the top of FIG. 52A.

Figure 52C:
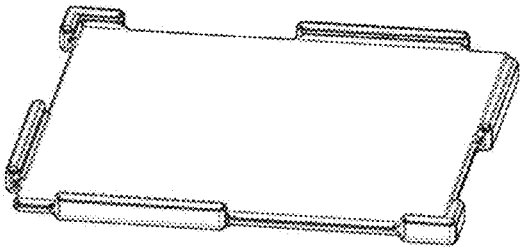

FIG. 52C is another view from a top corner of FIG. 52A but from a slightly different angle.

Figure 52D:
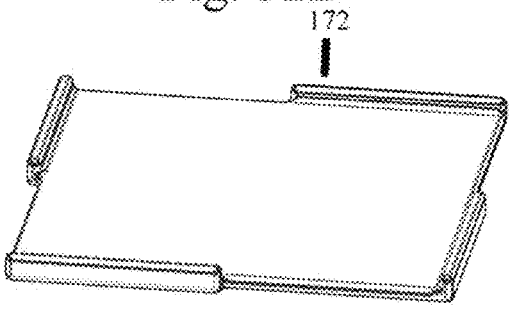

FIG. 52D is similar to FIG. 52A except it has longer simpler lips on the side.

Figure 53A:
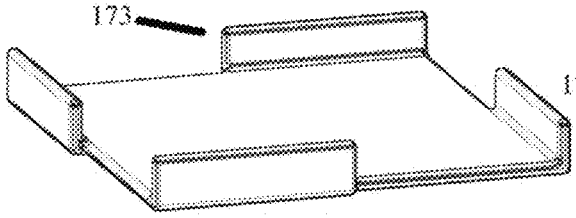
Figure 53B:
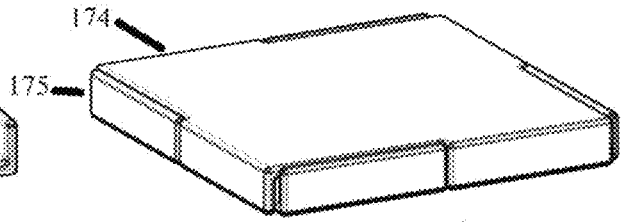

FIG. 53A is similar to FIG. 52A except that it stacks higher and it forms a box as shown in FIG. 53B.

FIG. 53B shows how FIG. 53A stacks higher than FIG. 52A.

Figure 54A:
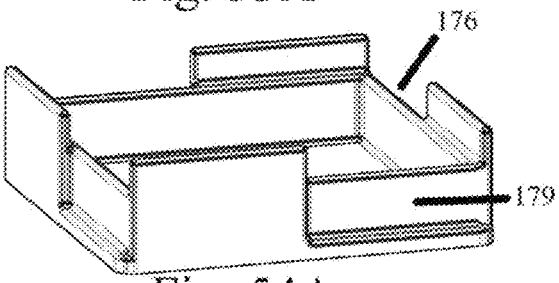

FIG. 54A is similar to FIG. 53A except that it also forms a bowl whose sides grab onto themselves to secure it in place.

Figure 54B:
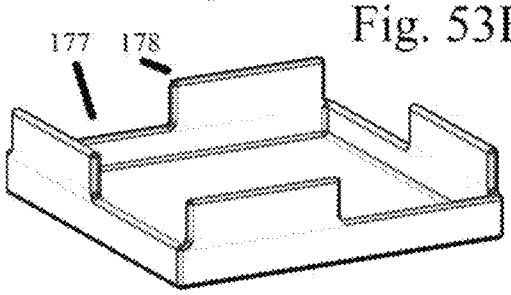

FIG. 54B is similar to FIG. 54A except that it only rests on itself and grabs onto itself at the ends of the protruding sides (not on the face of the protruding sides as is the case with FIG. 54A.

Figure 54C:
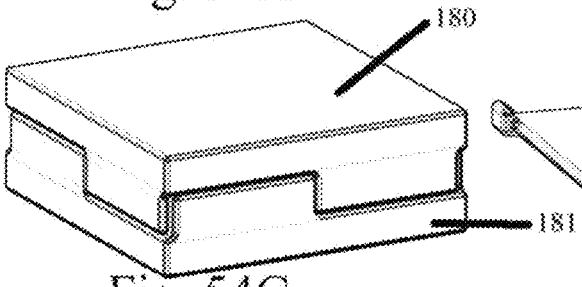

FIG. 54C is a demonstration of how FIG. 54B fits into itself.

FIG. 55A is a simple coaster panel that fits into itself in the manner shown in FIG. 558 and it fits into a large number of the other panels at FIG. 52A and following.

FIG. 55B is a demonstration of how a simple coaster panel fits into itself.

Figure 56A:
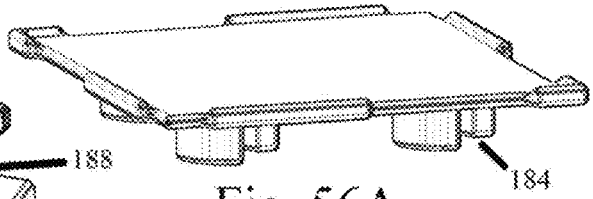
Figure 56B:
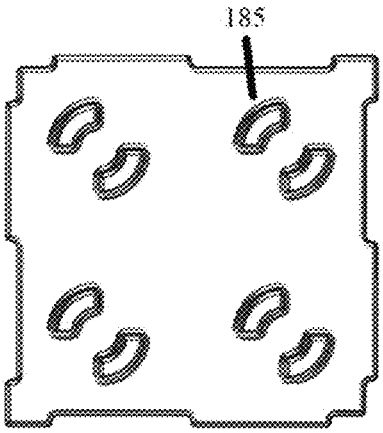

FIG. 56A is similar to the prior panels except it has feet that are reversible knobs on the bottom that can be easily seen in the view of FIG. 56B. It assembles into itself in the manner shown in FIG. 58.

FIG. 56B is a profile view from the bottom of FIG. 56A.

Figure 57:
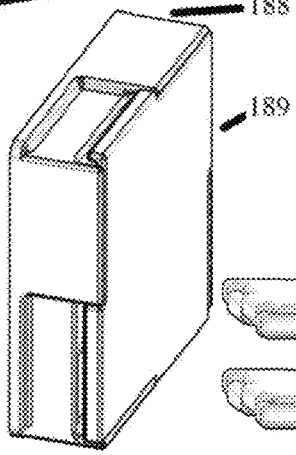

FIG. 57 is an example of how coaster panels of different geometries fit together. Specifically, FIG. 57 is panel 54A fit into 52D.

Figure 58:
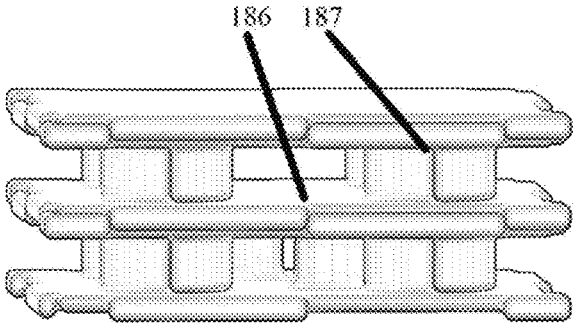

FIG. 58 is an example of how FIG. 56A assembles into itself.

Figure 59A:
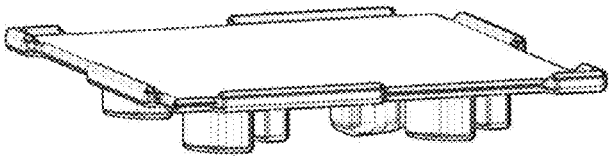

FIG. 59A is similar to FIG. 56A except it has an additional large reversible knob in the middle that is twice the size of the other knobs as is clearly shown in FIG. 598.

Figure 59B:
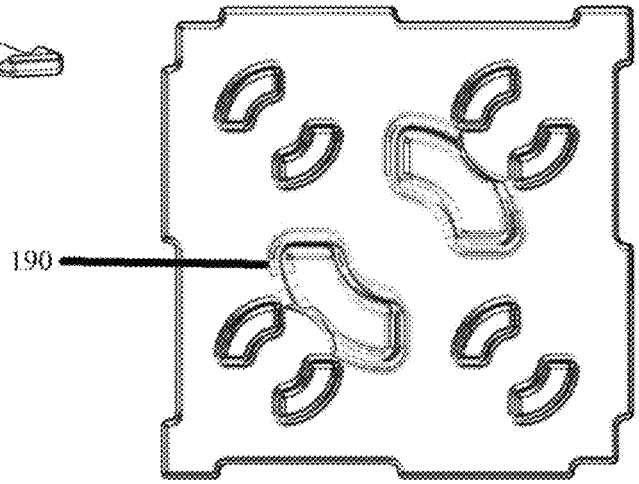

FIG. 59B is a profile view from the bottom of FIG. 59A.

Figure 60A:
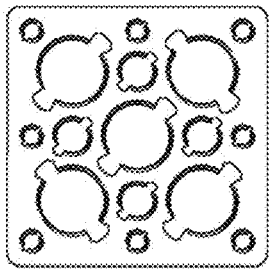
Figure 60B:
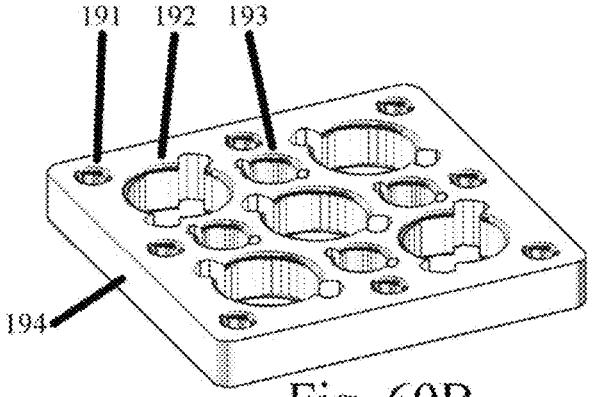

FIG. 60A is a profile view from the top of FIG. 60B.

FIG. 60B is a panel that holds knobs, reversible knobs (like those shown in FIG. 59B) and hooks. Its sides can be magnetized to be affixed into panels with the basic configuration shown in FIG. 39D. If holes are placed through the sides of FIG. 60B, it can also be secured with knobs and poles from the sides.

Figure 61A:
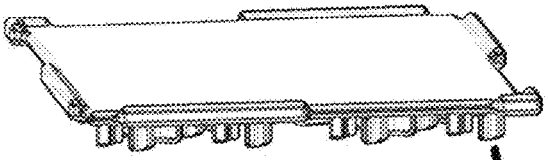

FIG. 61A is similar to FIG. 59A except it has more reversible knobs.

Figure 61B:
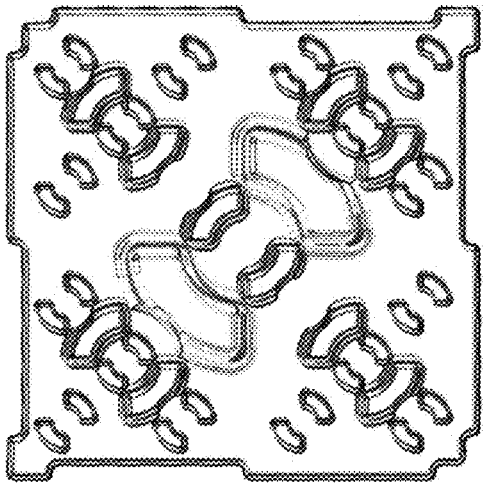

FIG. 61B is a profile view from the bottom of FIG. 61A.

Figure 61C:
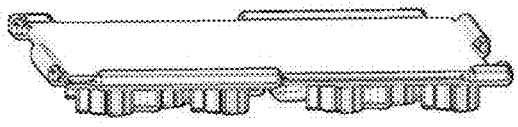

FIG. 61C is a view from the side of FIG. 61A.

Figure 61D:
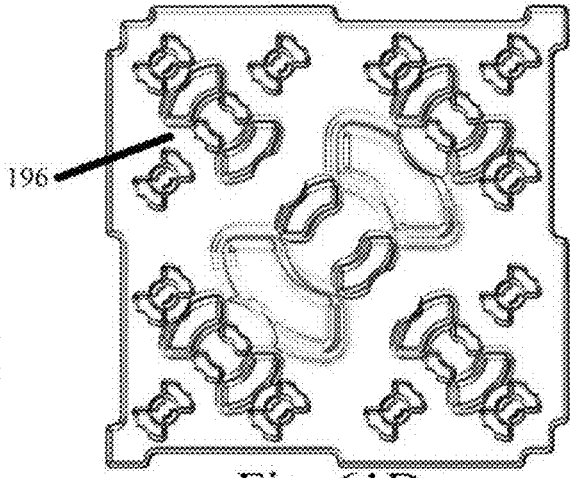

FIG. 61D is a demonstration of how FIG. 61B can be rotated 180 degrees and keep the same interfaces.

Figure 62A:
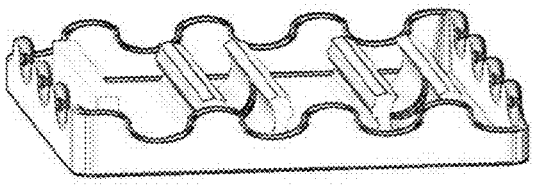
Figure 62B:
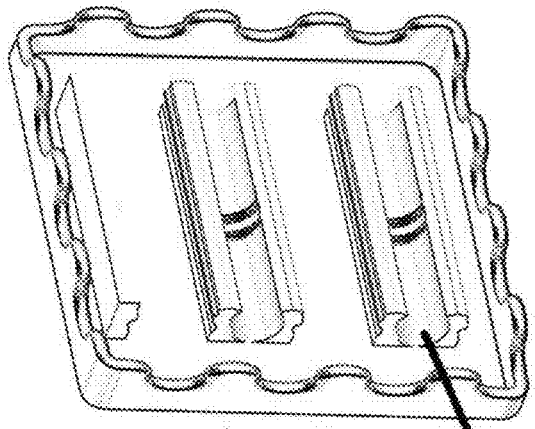
Figure 62C:
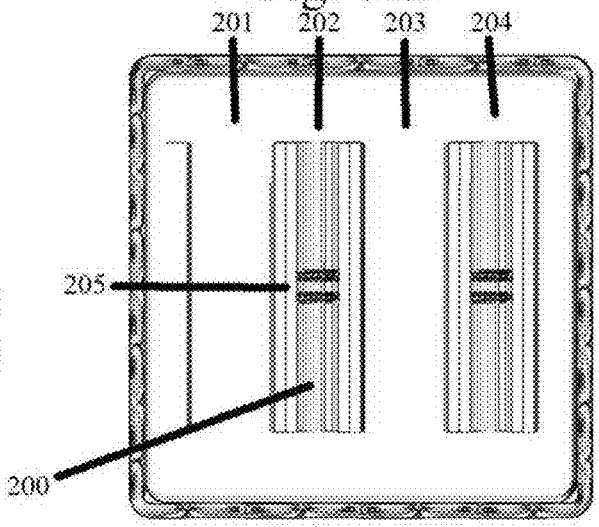
Figure 63A:
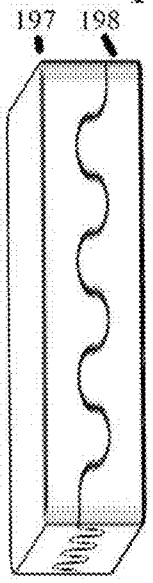
Figure 63B:
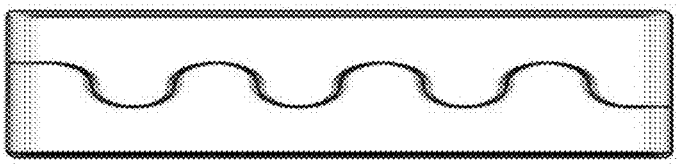

FIG. 62A is a coaster panel that can be snapped into itself in the manner shown in FIG. 63B. When it is snapped together it can be locked with a sphere being placed in the middle of the cavities that snap together, two of which are on each panel that are also easily visible in FIGS. 62B and 62C. Up to four spheres will fully lock this piece once it is snapped shut. To do so, the user must first place the spheres on the sides of the locking cavities that are at the top and bottom of FIG. 62C. Then, when another FIG. 62A piece is snapped onto that piece, the snapped-in-place construction must be shaken so the spheres move to the middle of the shafts in the cavities and get lodged in the middle. Then, those cavities will not un-snap as easily as they would have in the absence of the spheres being held in place. To unlock, the snapped object must be jolted so the spheres become dislodged from the middle and fall to one side. Then the construction can be un-snapped.

FIG. 62B is a view from the top of FIG. 62A.

FIG. 62C is a profile view from the top of FIG. 62C.

FIG. 63A is an example of how FIG. 62B pieces fit together vertically.

FIG. 63B is a side profile view of FIG. 63A.

Figure 63C:
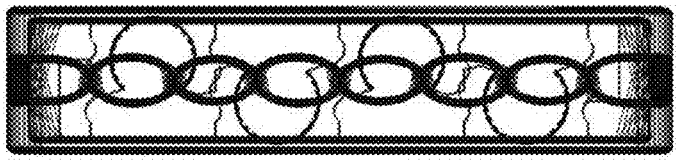

FIG. 63C is a wireframe view of FIG. 63B.

Figure 64A:
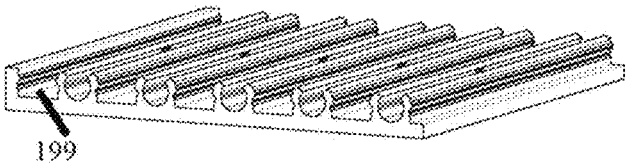

FIG. 64A is similar to FIG. 62A except the sides of the piece are open so that both spheres and poles can be inserted to lock the assembled pieces. The assembled pieces are in FIG. 65B.

Figure 64B:
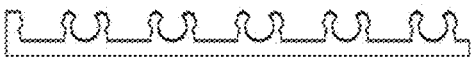

FIG. 64B is a profile view from the side of FIG. 64A.

Figure 64C:
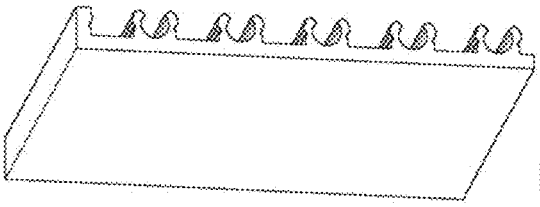
Figure 64D:
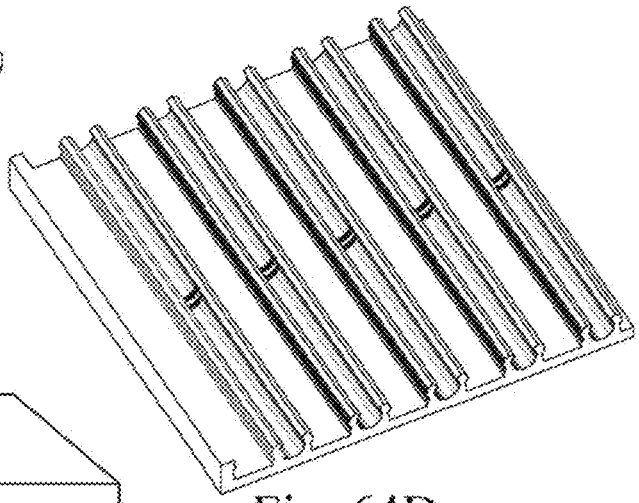

FIG. 64C is a view from a bottom side of FIG. 64A.

Figure 65A:
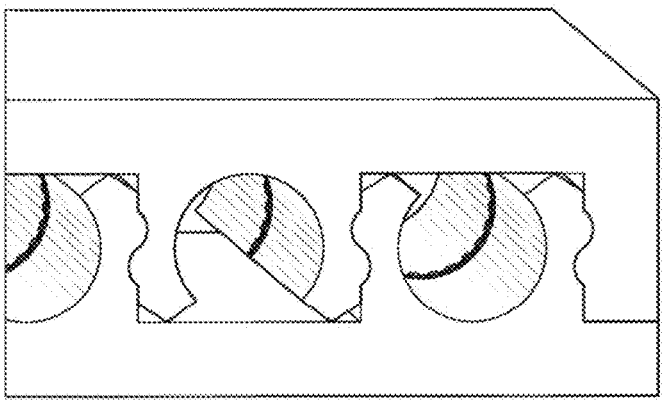
Figure 65B:
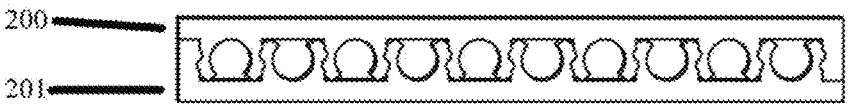

FIG. 65A is a close-up view of FIG. 65B.

Figure 65C:
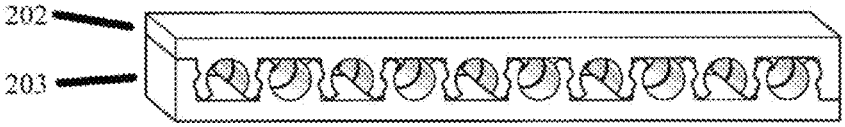

FIG. 65B is a profile view of the side of FIG. 65C.

FIG. 65C is a demonstration of how FIG. 64A pieces assemble.

Figure 66A:
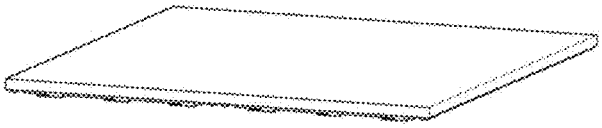
Figure 66C:
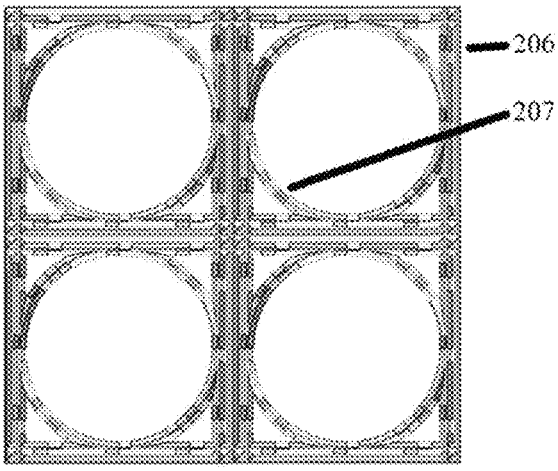
Figure 67A:
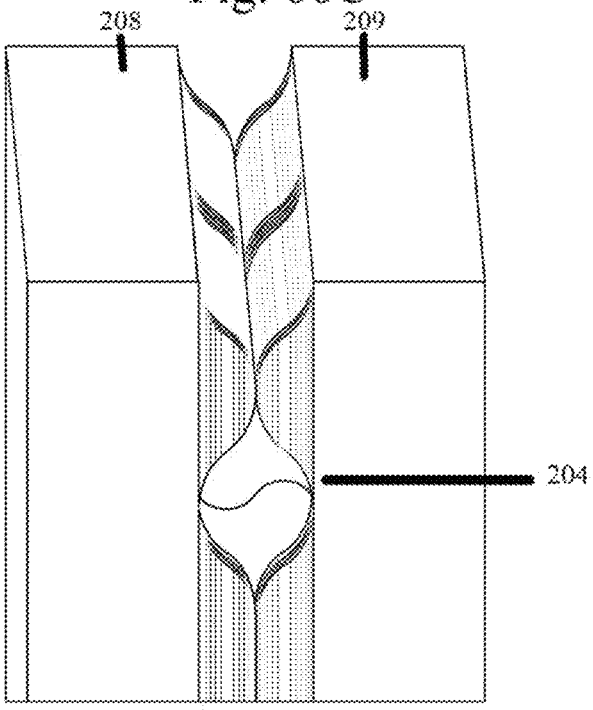
Figure 67B:
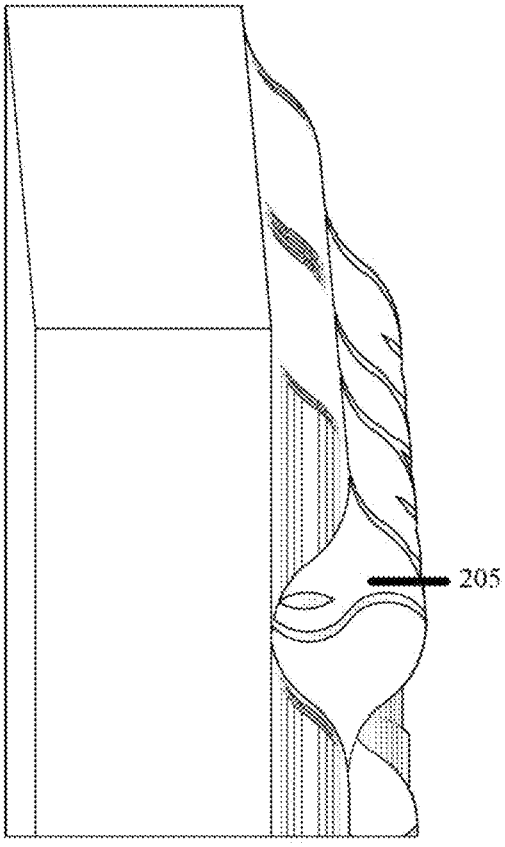

FIG. 66A is a coaster that snaps together with "s" snaps, the intersection of which is denoted by element 1 in FIG. 67A. Element 2 in FIG. 67B is a close-up view of FIG. 66A that shows the "s" shaped snap. This snap is arranged along the straight lines shown in FIG. 66C and it appears in the circular part of that FIG.

Figure 66B:
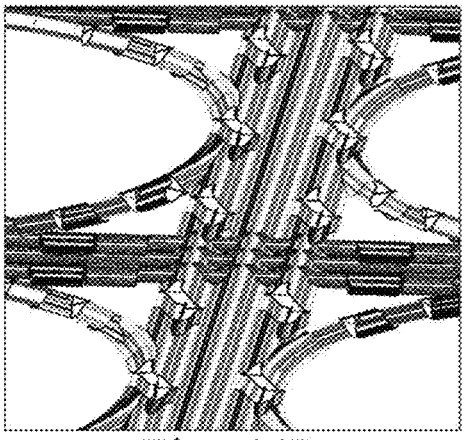

FIG. 66B is a close-up view of ridges on FIG. 66A.

FIG. 66C is a profile view of the bottom of FIG. 66A.

FIG. 67A is a demonstration of how FIG. 66A pieces come together.

FIG. 67B is a close-up view of FIG. 66A.

Figure 68A:
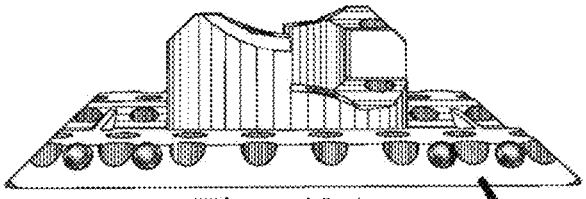
Figure 68B:
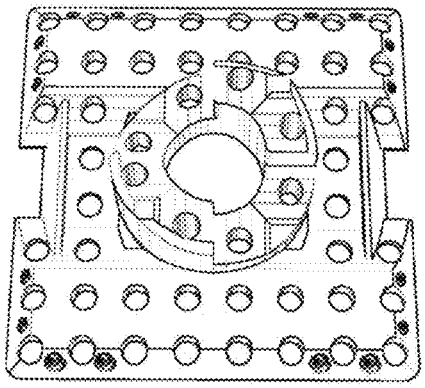
Figure 68C:
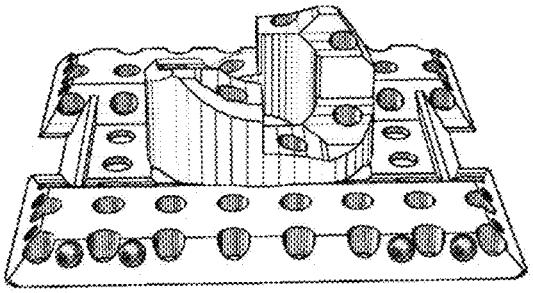
Figure 68D:
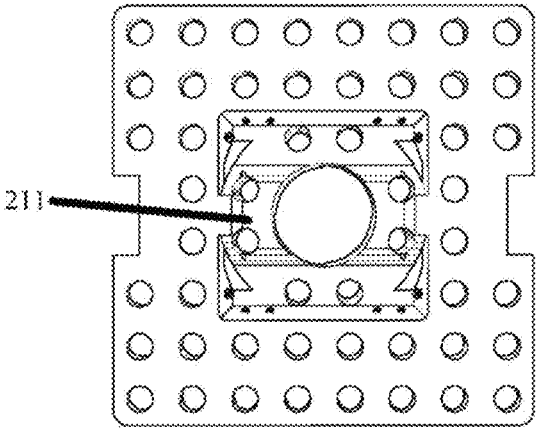

FIG. 68A is similar to FIG. 11 except the holes are smaller in relation to the piece and FIG. 68 can also have an object with a smaller shape snap into the indented area shown in the middle of FIG. 68D.

FIG. 68B is a top view of FIG. 68A.

FIG. 68C is a side view of FIG. 68A.

FIG. 68D is a profile view from the bottom of FIG. 68A.

Figure 68E:
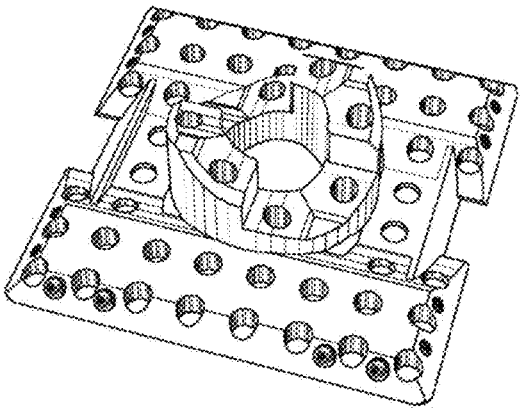

FIG. 68E is a top corner view of FIG. 68A.

Figure 69A:
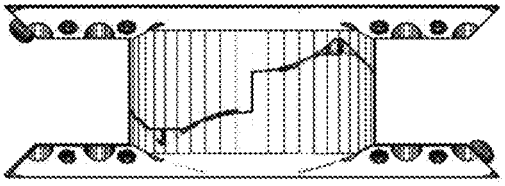
Figure 69B:
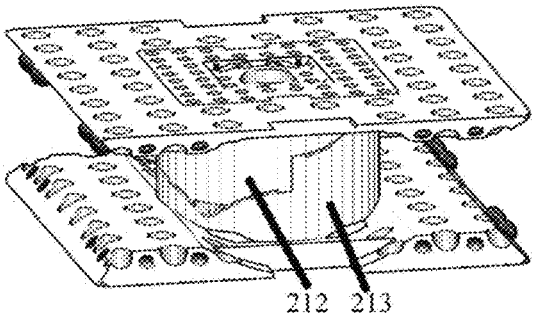

FIG. 69A is a profile view of FIG. 69B.

FIG. 69B shows how a flexible materials construction of this piece can fit into itself using the reversible knob.

Figure 70A:
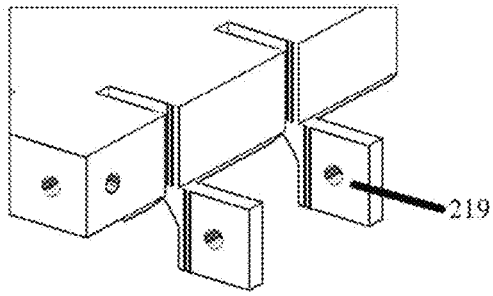
Figure 71A:
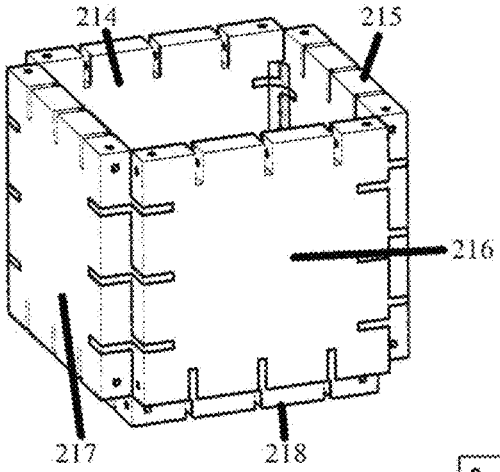

FIG. 70A is a close-up view of a coaster panel that can be assembled into a cube in the manner shown in FIG. 71A. This piece follows the same principles as prior panels (like the panel assembled at FIG. 49H) except the hole in the center of the squares on the edges is smaller to correspond to roughly the size of a nail in certain objects.

Figure 70B:
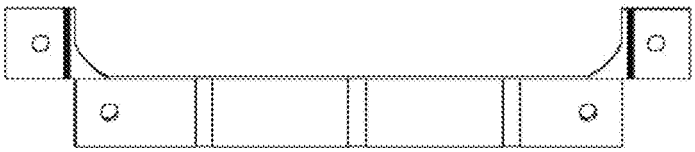

FIG. 70B is a profile view of the side of the panel shown in FIG. 70A.

Figure 70C:
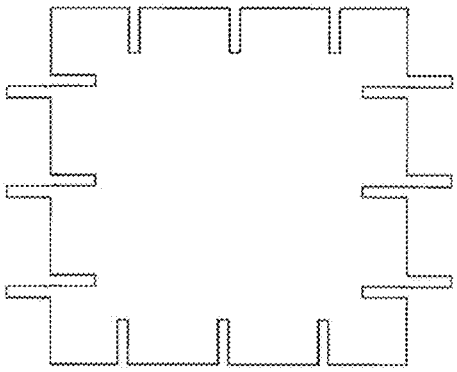

FIG. 70C is a profile view from the top of the panel shown in FIG. 70A.

FIG. 71A is a demonstration of how panels that are FIG. 70A can be assembled.

Figure 71B:
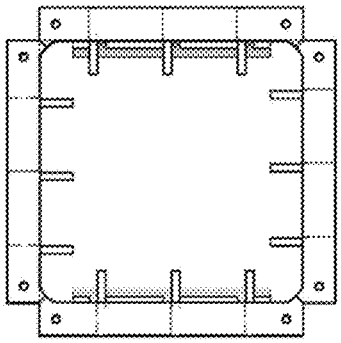

FIG. 71B is a profile view from the top of FIG. 71A.

Figure 71C:
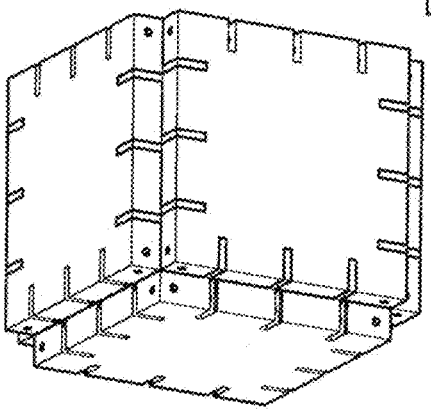

FIG. 71C is a view from a bottom corner of FIG. 71A.

Figure 71D:
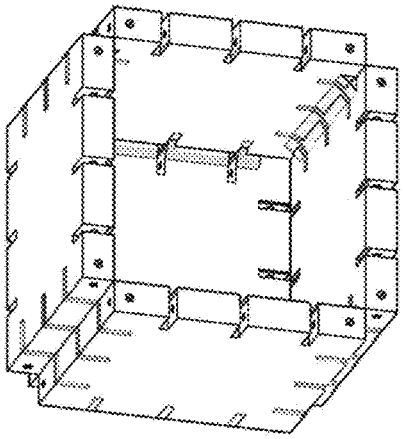

FIG. 71D is a view from a top corner of FIG. 71A.

Figure 72A:
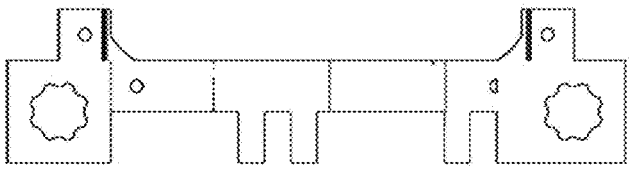
Figure 72B:
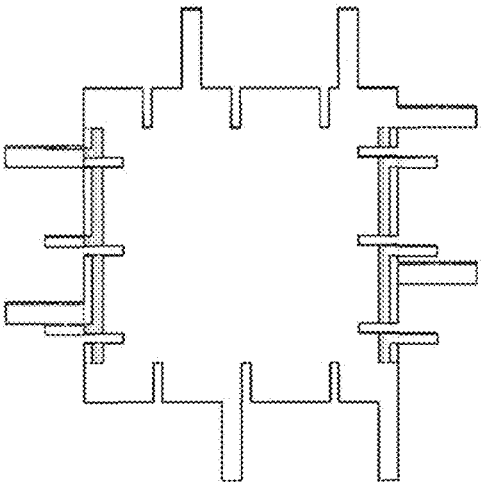
Figure 72C:
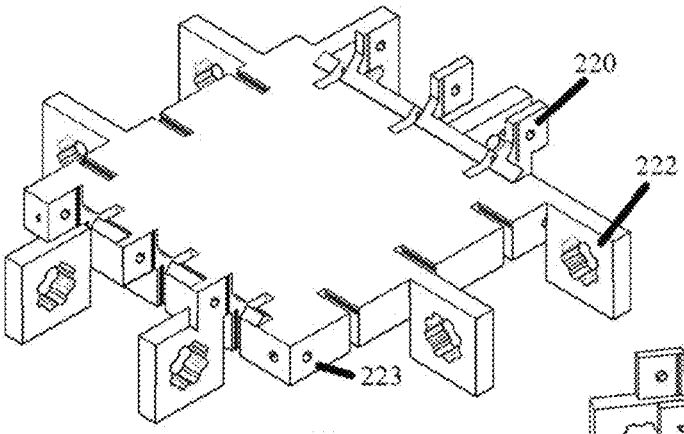

FIG. 72A is a profile view from the side of FIG. 72C.

FIG. 728 is a profile view from the top of FIG. 72C.

FIG. 72C is a panel that has both small and wide holes for side shafts to secure the panels in place. This way panels can form cubes secured with small poles in the way shown in FIGS. 73A through 73L and those cubes can in turn be assembled with holes for the large poles in the manner shown in FIGS. 73M through 73V.

Figure 72E:
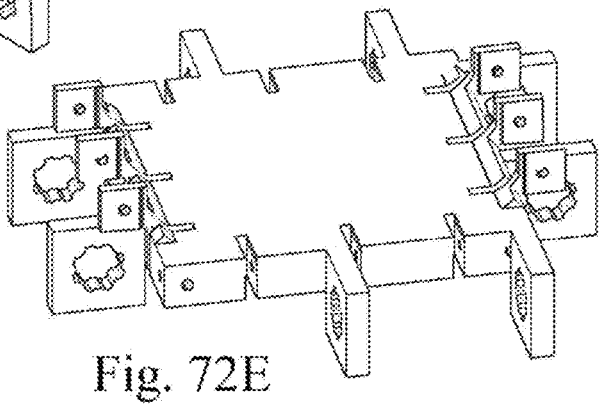
Figure 72D:
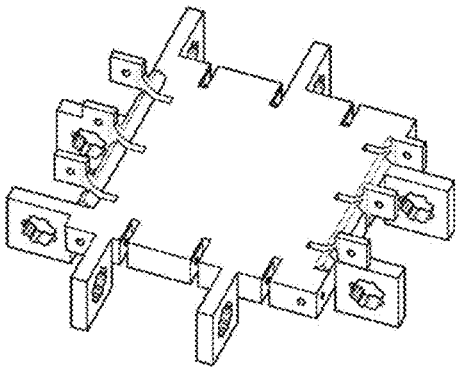

FIG. 72D is another top corner view of FIG. 72C.

FIG. 72E is a side view of FIG. 72C.

Figure 73A:
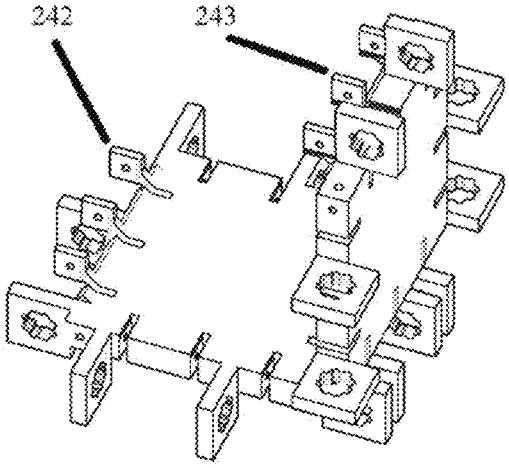

FIG. 73A is a demonstration of how panels that are FIG. 72A assemble.

Figure 73B:
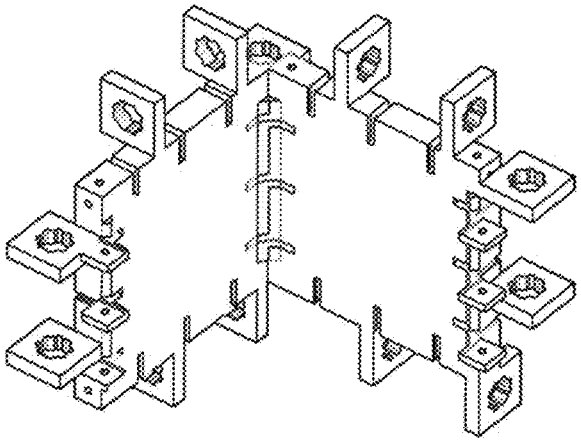

FIG. 73B is a different view of FIG. 73A.

Figure 73C:
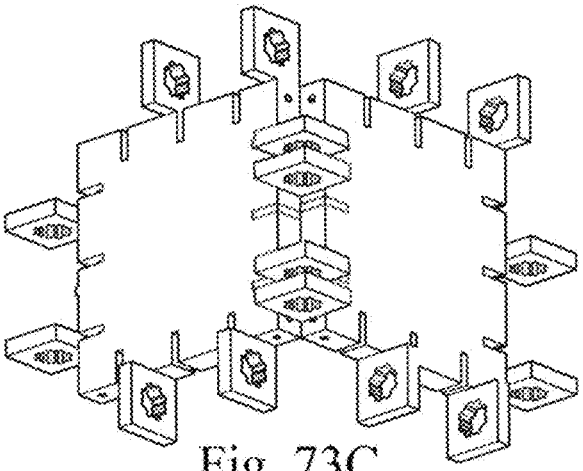

FIG. 73C is a backside view of FIG. 73B.

Figure 73D:
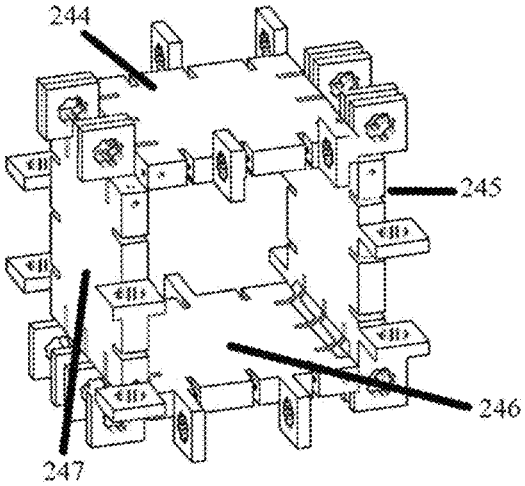

FIG. 73D is a demonstration of how two FIG. 73C can be assembled.

Figure 73E:
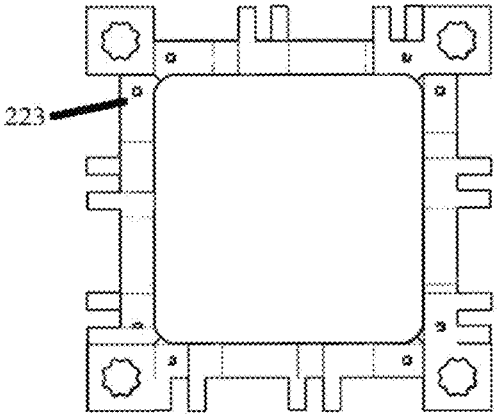

FIG. 73E is a profile view from the top of FIG. 73D.

Figure 73F:
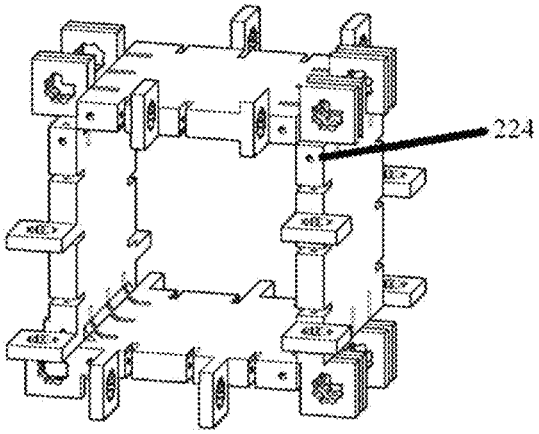

FIG. 73F is a view of FIG. 73D from a different angle.

Figure 73G:
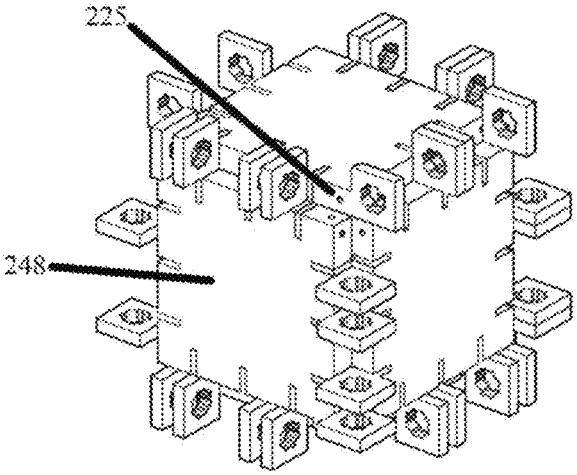

FIG. 73G is FIG. 73F with an additional FIG. 72A panel.

Figure 73H:
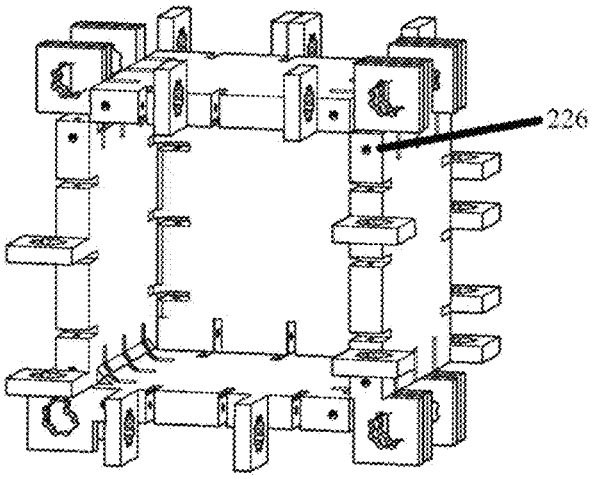

FIG. 73H is a view of the opening of FIG. 73G.

Figure 73I:
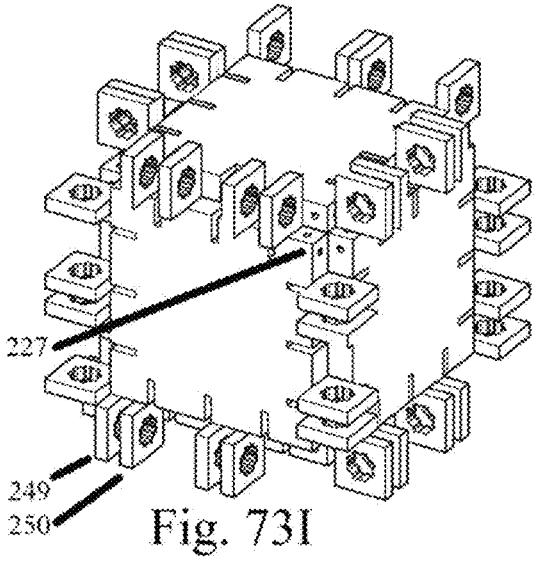

FIG. 73I is an example of how FIG. 72A panels assemble without the corner squares being together.

Figure 73J:
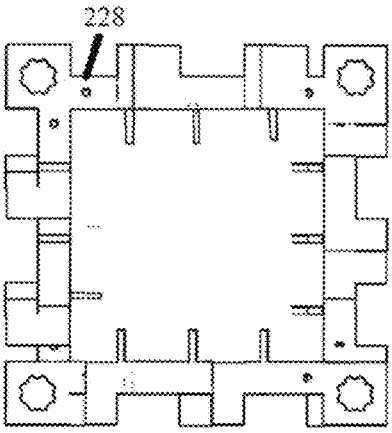

FIG. 73J is a profile view of the top of FIG. 73H.

Figure 73K:
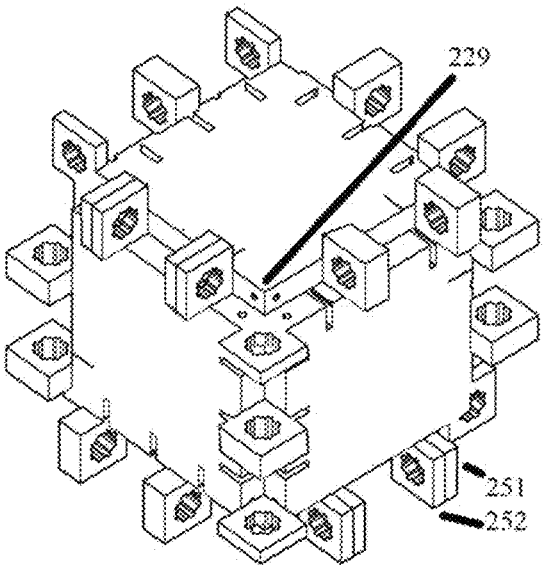

FIG. 73K is an example of how FIG. 72A panels assemble with the corner squares being together.

Figure 73L:
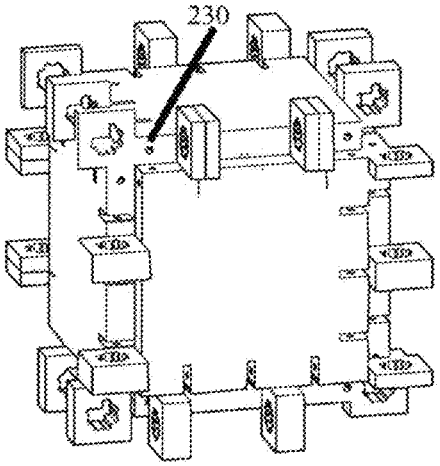

FIG. 73L is a view of FIG. 73K from a different angle.

Figure 73M:
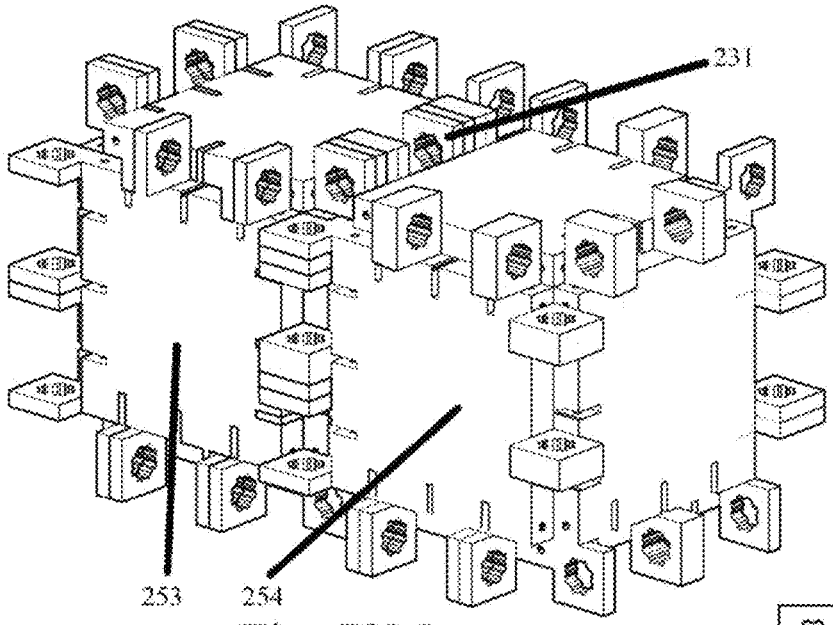

FIG. 73M is a demonstration of how two FIG. 73L objects assemble.

Figure 73N:
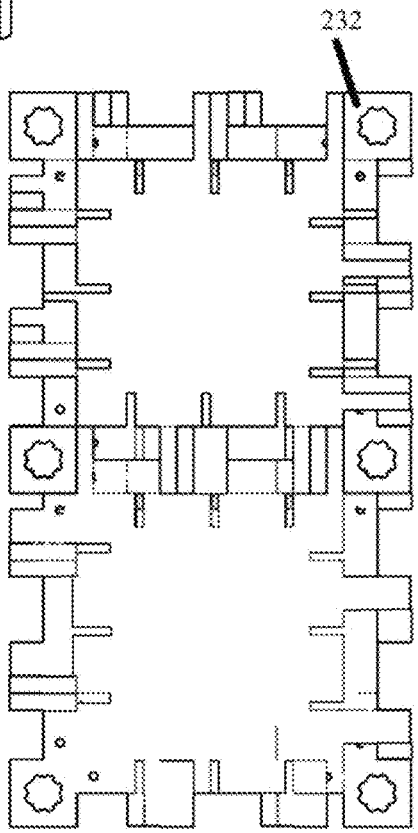

FIG. 73N is a profile view from the top of FIG. 73M.

Figure 73O:
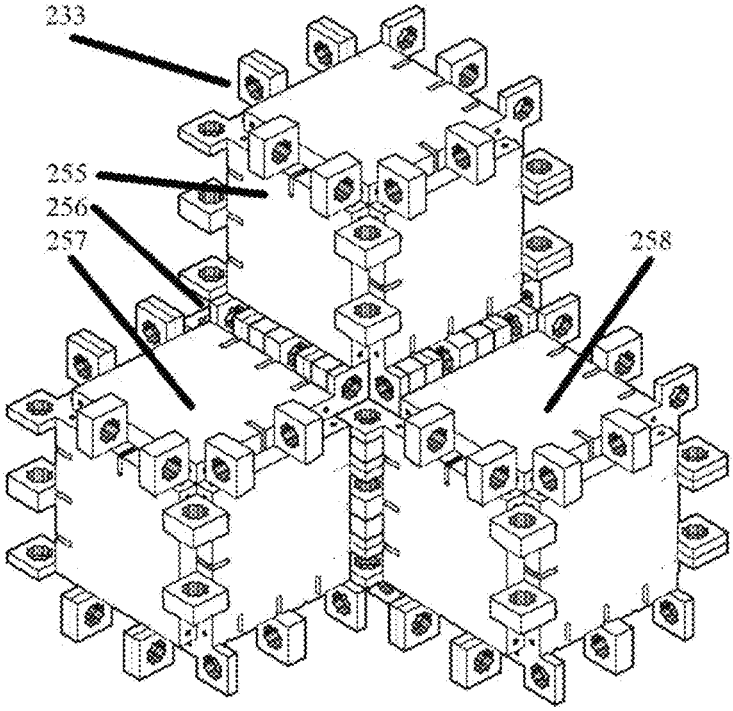

FIG. 73O is a demonstration of how four FIG. 73L objects assemble.

Figure 73P:
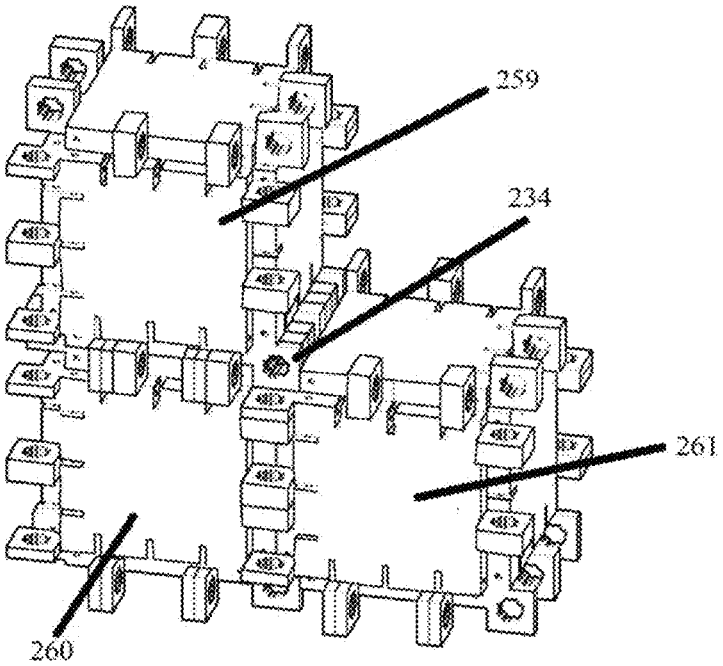

FIG. 73P is a demonstration of how three FIG. 73L objects assemble.

Figure 73Q:
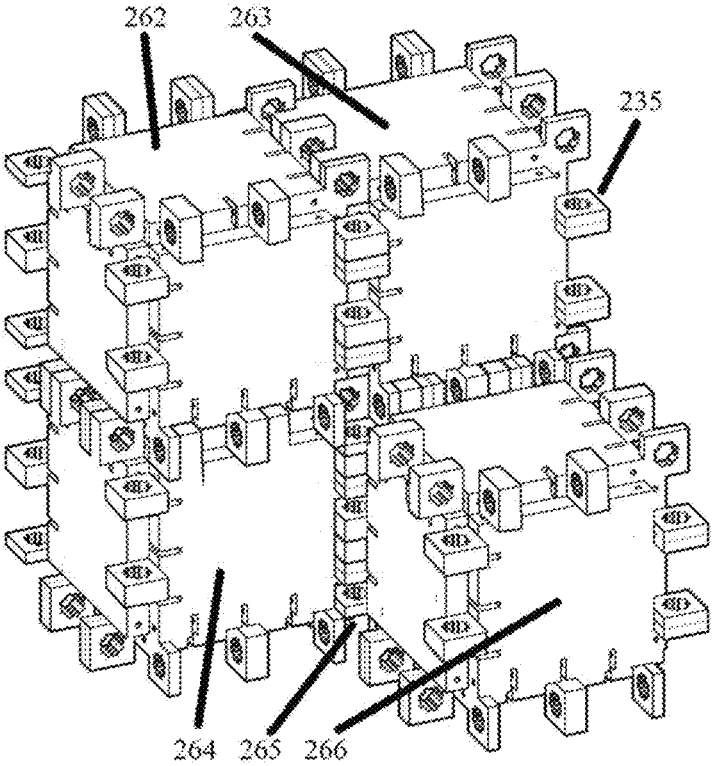

FIG. 73Q is a demonstration of how five FIG. 73L objects assemble.

Figure 73R:
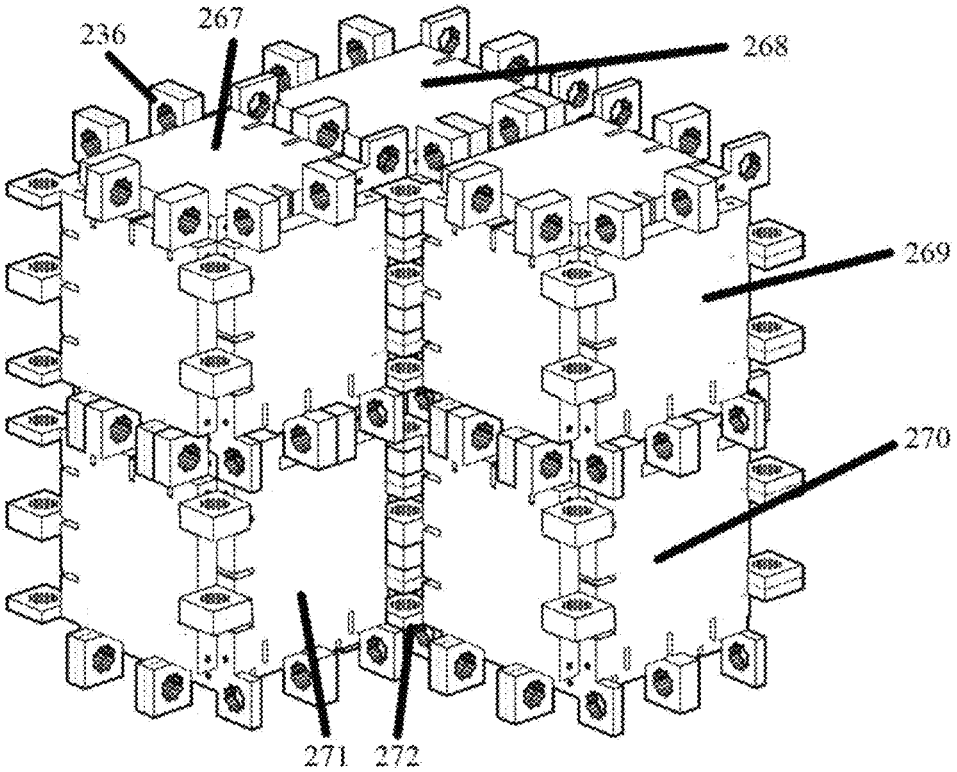

FIG. 73R is a demonstration of how six FIG. 73L objects assemble.

Figure 73S:
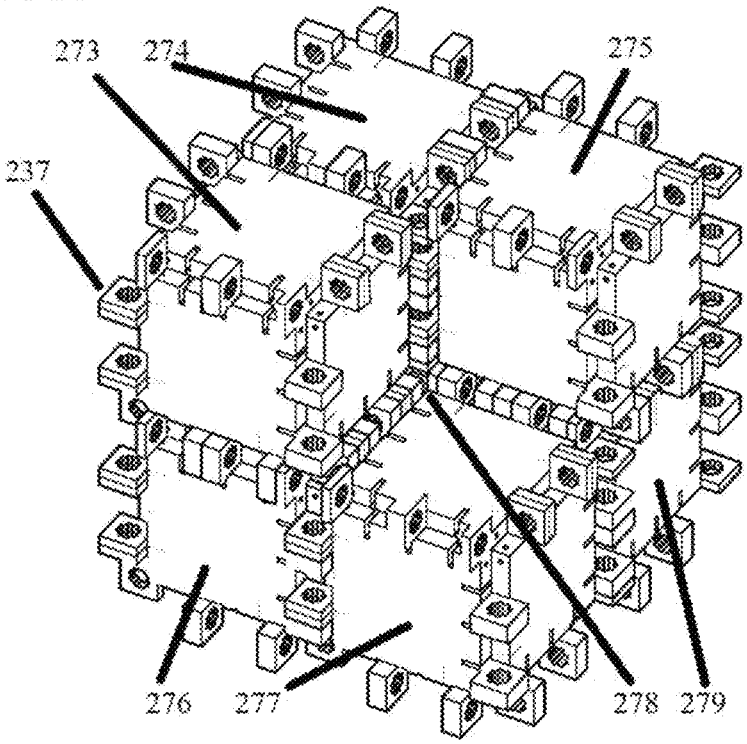

FIG. 73S is a demonstration of how seven FIG. 73L objects assemble.

Figure 73T:
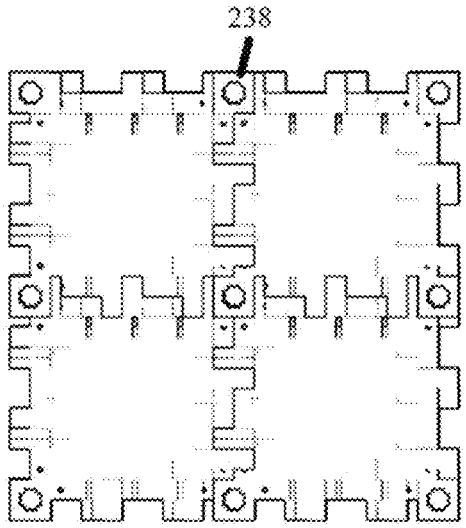
Figure 73U:
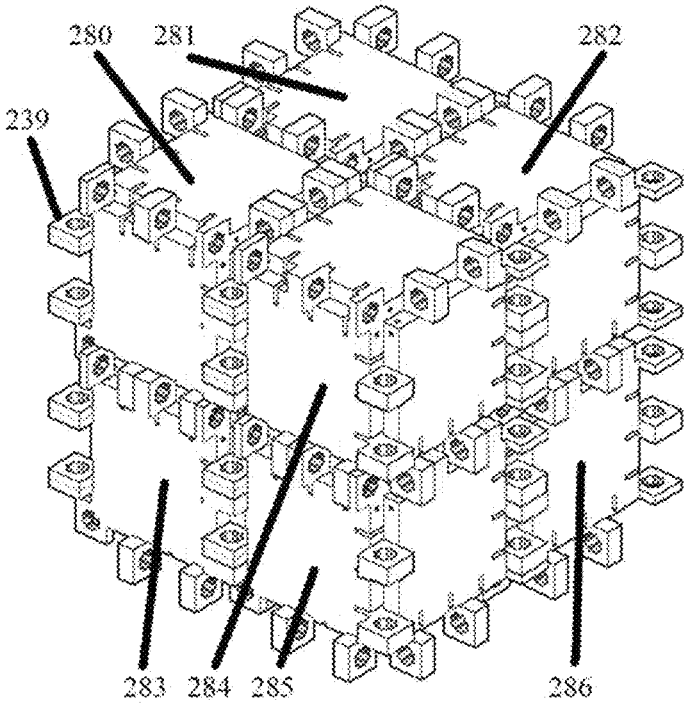

FIG. 73T is a profile view from a side of FIG. 73U.

FIG. 73U is a demonstration of how eight FIG. 73L objects assemble.

Figure 73V:
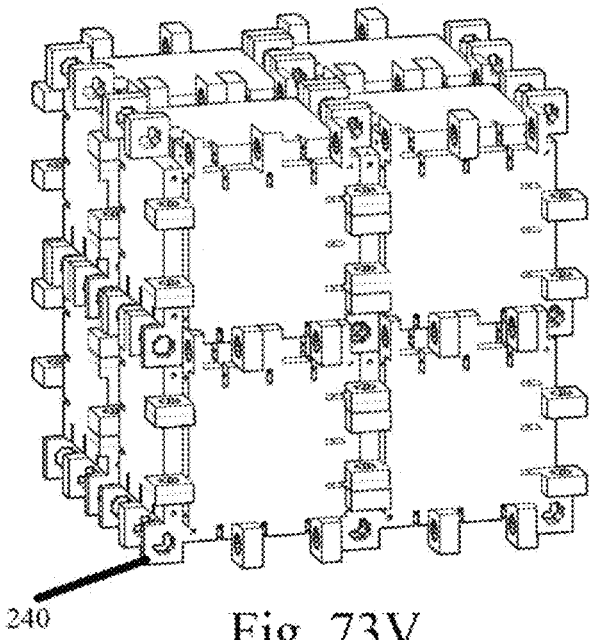

FIG. 73V is a different view of FIG. 73U.

Figure 74A:
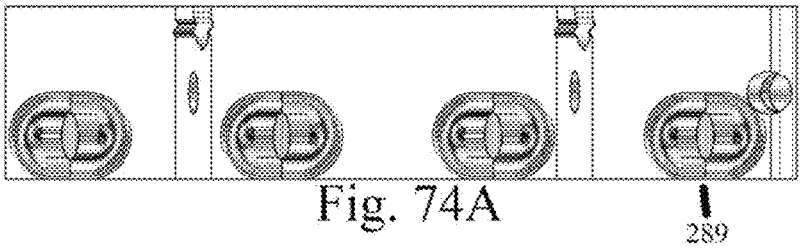
Figure 74B:
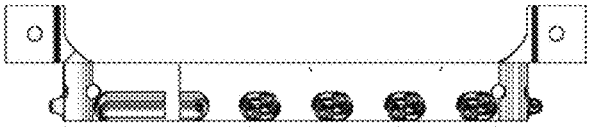
Figure 74C:
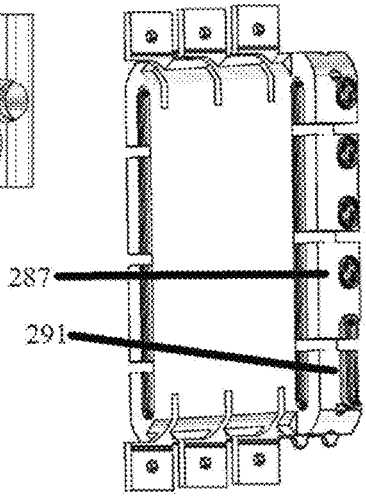

FIG. 74A is a close-up view of the side of FIG. 74C.

FIG. 74B is a side profile view of FIG. 74C.

Figure 75A:
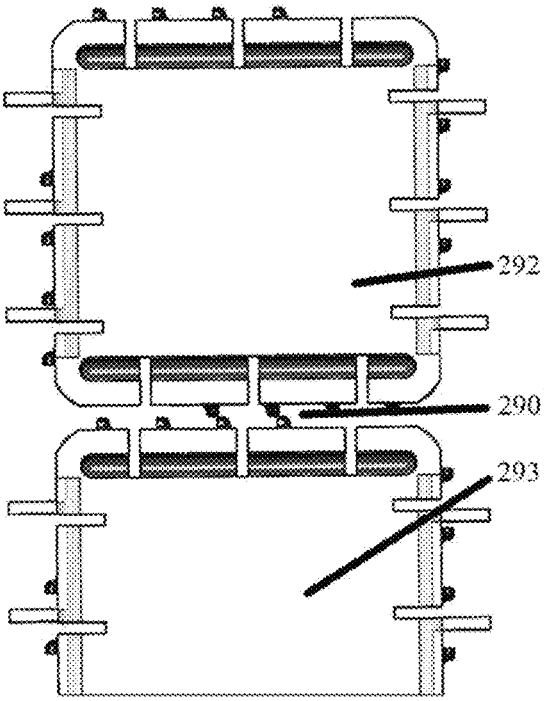
Figure 75B:
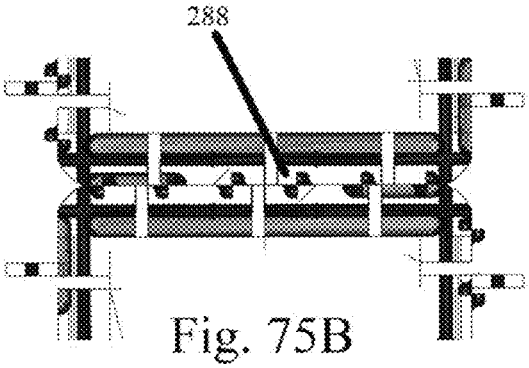

FIG. 74C is like FIG. 70A except it has bumpy protrusions that have "s" snaps with which the pieces snap together on the sides in the manner shown in FIG. 75B. A closeup view of the snaps is in FIG. 74A. Their orientation just before being snapped together is in FIG. 75A.

FIG. 74C also has indentations where these protrusions can rest so the constructions build with it can be stabilized.

Figure 74D:
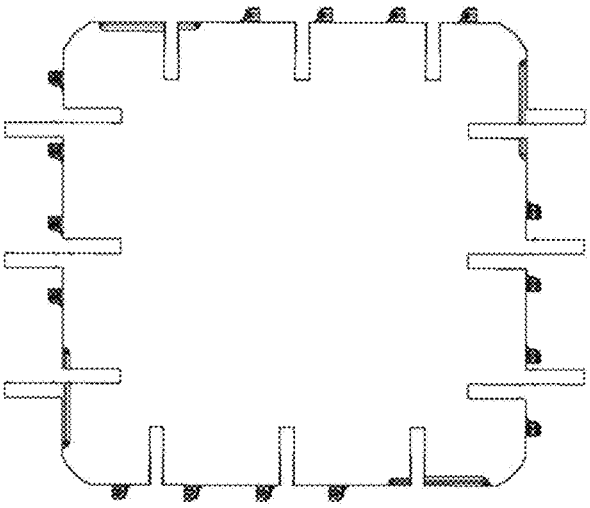

FIG. 74D is a profile view from the bottom of FIG. 74C.

FIG. 75A is a demonstration of how FIG. 74C pieces fit together.

FIG. 75B is a wireframe view of FIG. 74C pieces fitting together.

Figure 76A:
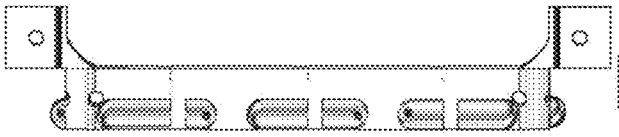
Figure 76B:
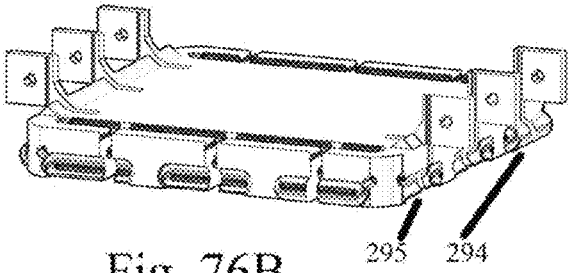

FIG. 76A is a side profile view of FIG. 76B.

FIG. 76B is similar to FIG. 74C except it only has protruding and receding areas and not protruding "s" snaps. FIGS. 74, 70 and 76 can be used together.

Figure 76C:
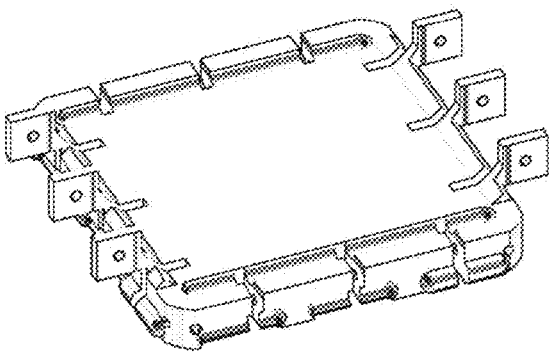

FIG. 76C is another view from a top corner of FIG. 76B.

Figure 76D:
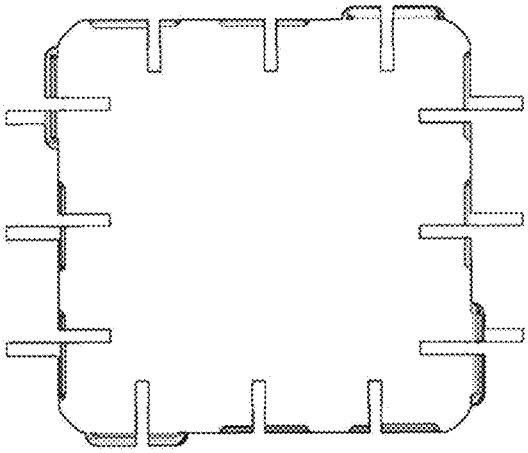

FIG. 76D is a profile view from the bottom of FIG. 76B.

Figure 77:
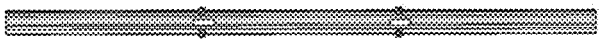

FIG. 77 is a pencil-like object that locks the panel constructions in place.

Figure 78:
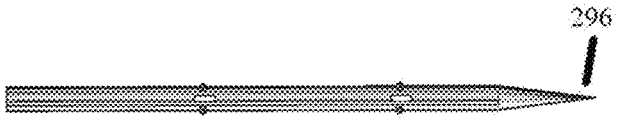
FIG. 78 is a profile view from the bottom of FIG. 7A.

FIG. 78 is similar to FIG. 77 except it has a pointed end. These pieces have two snap areas on them where they snap onto the panels when inserted. Because the pieces can be of any size, FIGS. 77 and 78 can be pens, pencils, nails, straws or toothpicks.

Figure 79A:
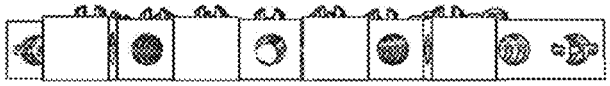
Figure 79B:
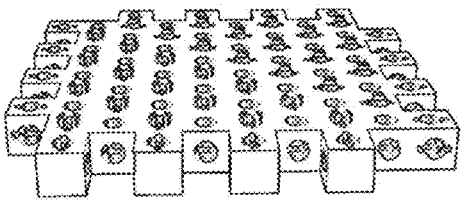
Figure 79C:
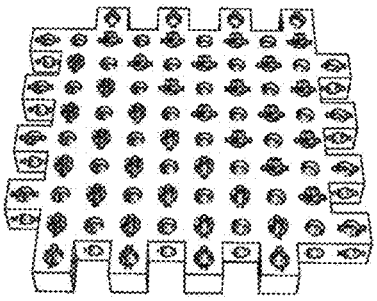
Figure 79D:
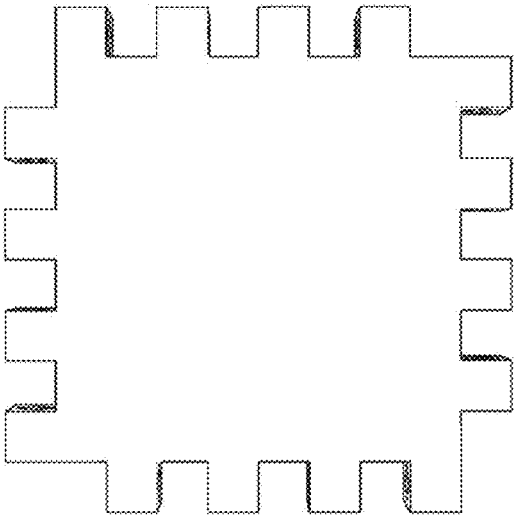
Figure 79E:
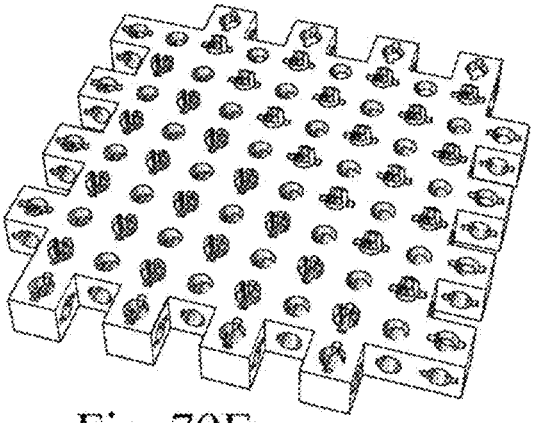

FIG. 79A is a profile view from the side of FIG. 79E.

FIG. 79B is a side view of FIG. 79E.

FIG. 79C is a top view of FIG. 79E.

FIG. 79D is a profile view of the bottom of FIG. 79E.

Figure 15A:
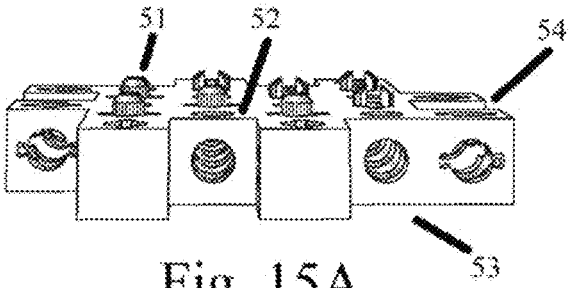
FIG. 15A is a coaster panel that has male and female knob interfaces on one side and that is smooth on the other side. The male and female knob interfaces can fit into themselves. It can also be assembled into panels and cubes by using the block pattern on its edges.

FIG. 79E is similar to FIG. 15A except it is larger so that it can interface with other larger panels, like FIG. 49A.

Figure 79F:
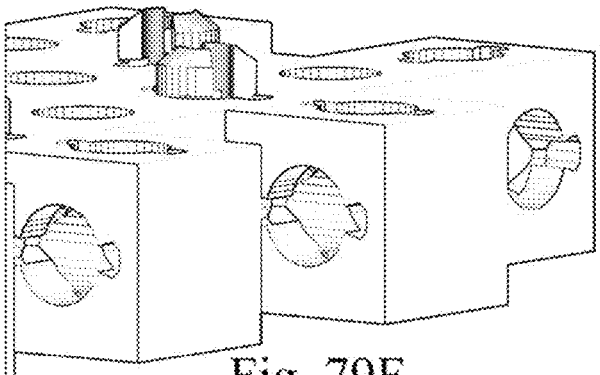

FIG. 79F is a close-up view of a side of FIG. 79E.

Figure 79G:
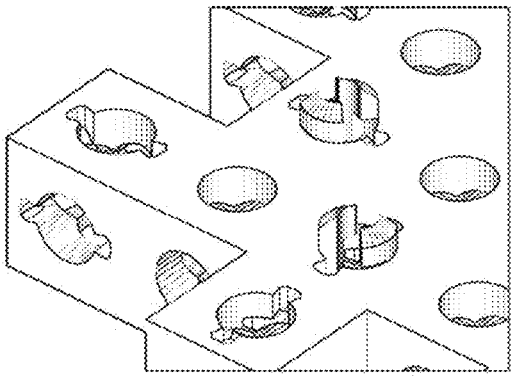

FIG. 79G is a close-up view of a corer of FIG. 79E.

Figure 80A:
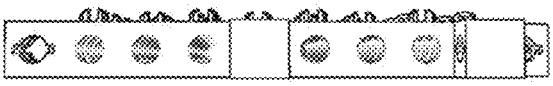
Figure 80B:
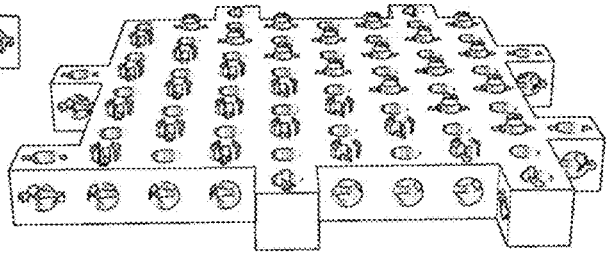
Figure 80C:
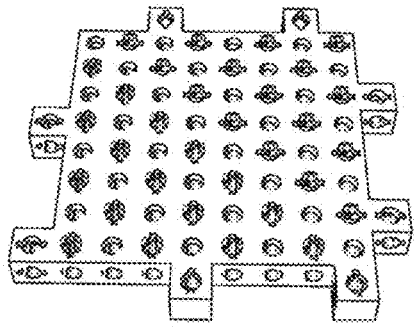
Figure 80E:
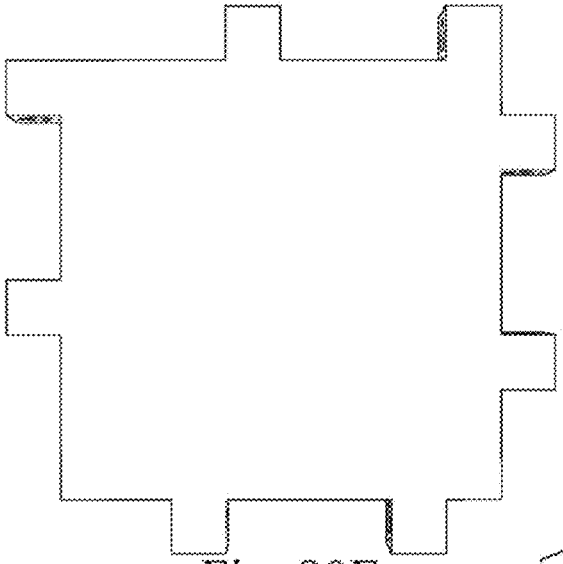
Figure 80D:
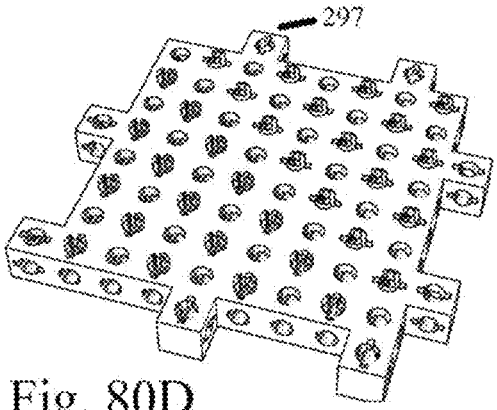

FIG. 80A is a side profile view of FIG. 80D.

FIG. 80B is a side view of FIG. 80D.

FIG. 80C is a top view of FIG. 80D.

FIG. 80D is similar to FIG. 79E except it has less block protrusions on the edges so that it can build a more versatile set of constructions. Not only can it build cubes and larger panels as is shown in FIG. 81B, it can also build shelves by continuing to build out the area shown at FIG. 81A.

FIG. 80E is a profile view from the bottom of FIG. 80D.

Figure 81A:
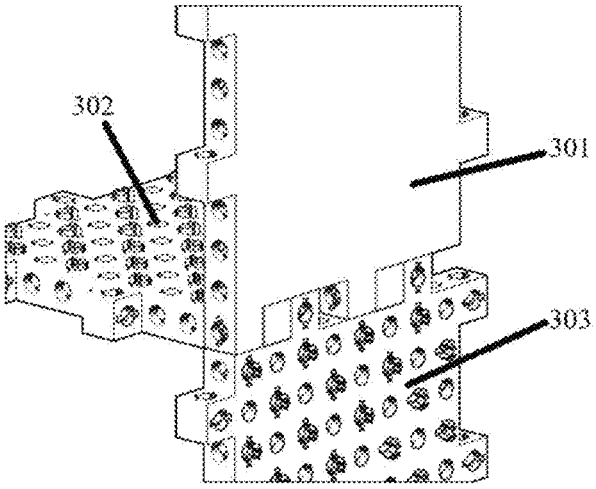

FIG. 81A is an example of how FIG. 80D panels can build shelves.

Figure 81B:
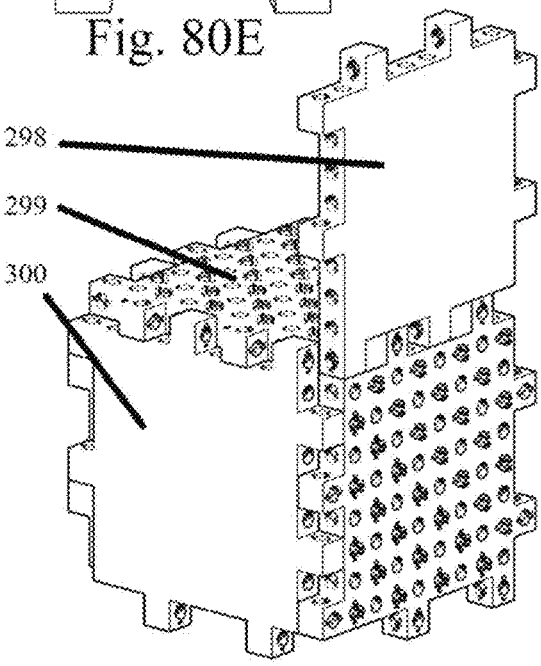

FIG. 81B is an example of how FIG. 80D can build more versatile constructions.

Figure 82A:
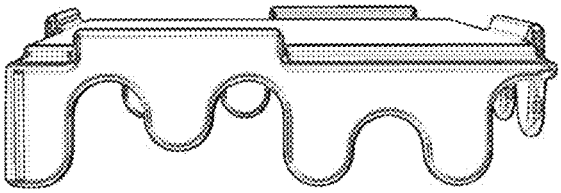
Figure 82B:
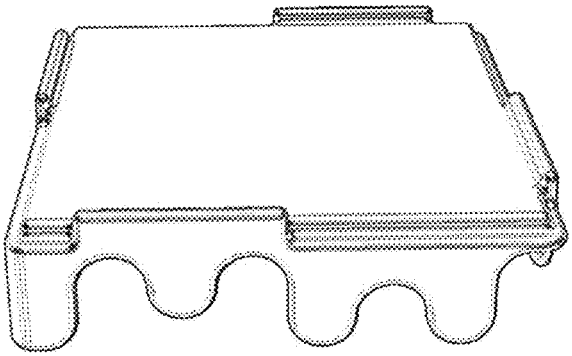
Figure 82C:
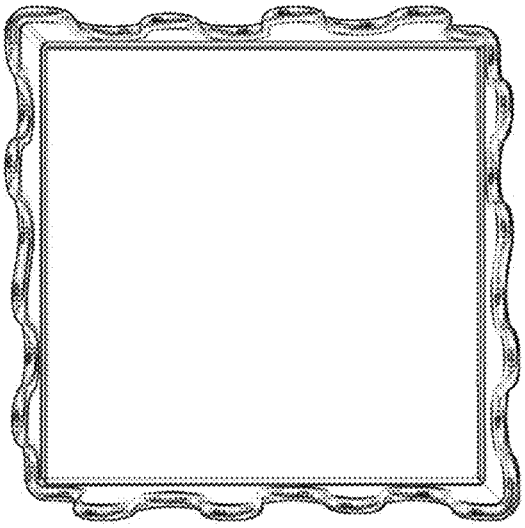
Figure 82D:
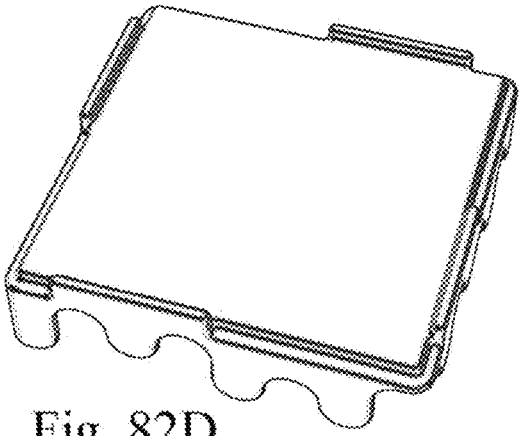

FIG. 82A is a side view of FIG. 82D.

FIG. 82B is a top side view of FIG. 82D.

FIG. 82C is a profile bottom view of FIG. 82D.

Figure 83A:
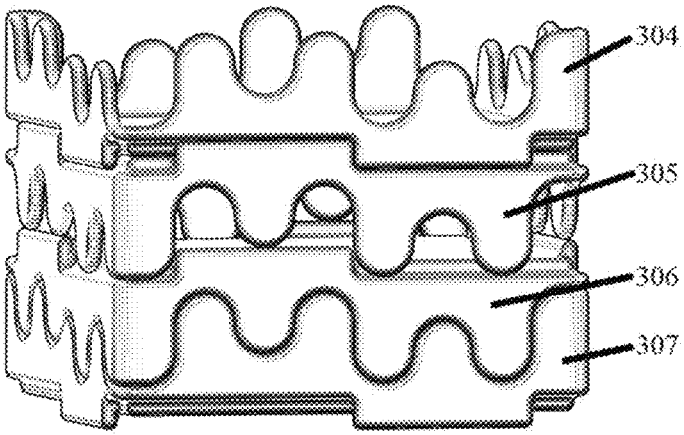

FIG. 82D is a coaster that fits into itself in the ways shown in FIG. 83A that is also compatible with the pieces at FIGS. 51A through 61A.

FIG. 83A is an example of how FIG. 82D coasters fit into themselves.

Figure 83B:
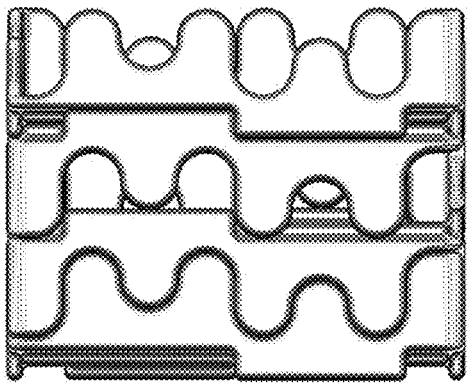

FIG. 83B is a side profile view of FIG. 83A.

Figure 84A:
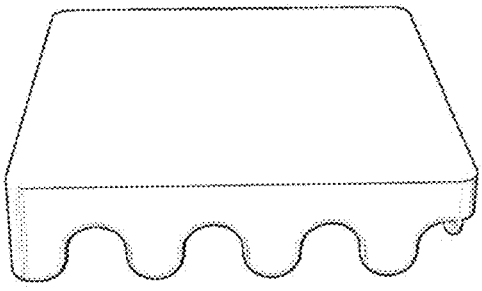
Figure 84B:
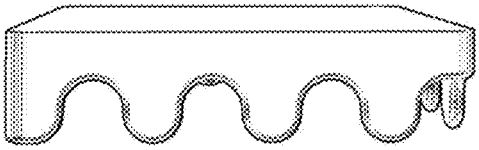
Figure 84C:
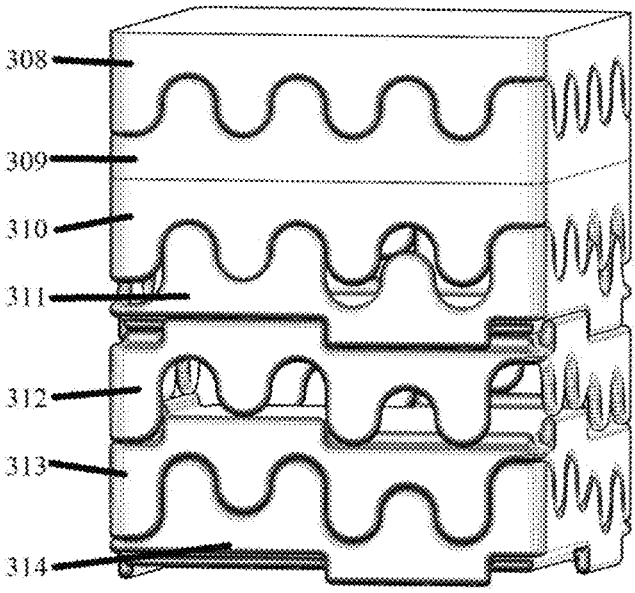

FIG. 84A can fit into itself in the manner shown in FIG. 84C.

FIG. 84B is a side view of FIG. 84A.

FIG. 84C is an example of how FIG. 84A pieces fit into themselves.

Figure 85A:
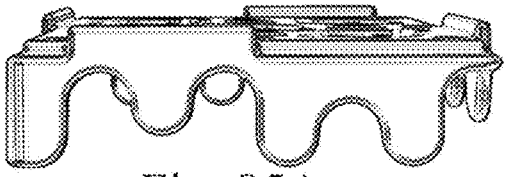
Figure 85B:
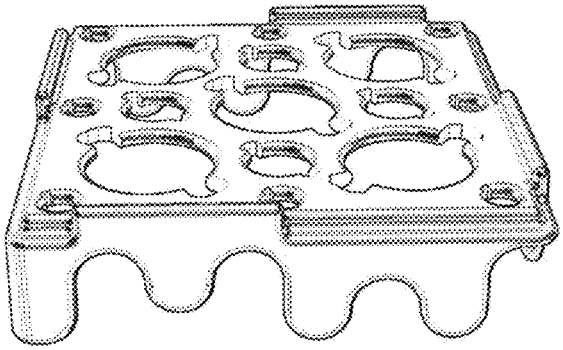
Figure 85C:
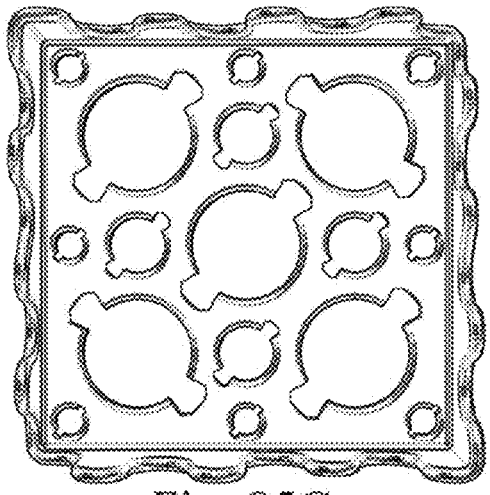
Figure 85D:
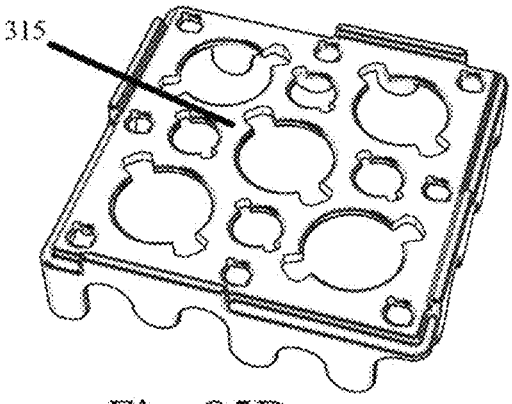

FIG. 85A is a side view of FIG. 85D.

FIG. 85B is a top side view of FIG. 85D.

FIG. 85C is a bottom profile view of FIG. 85D.

FIG. 85D fits into itself and can hold large knobs and hooks in the circles at its center.

Figure 86A:
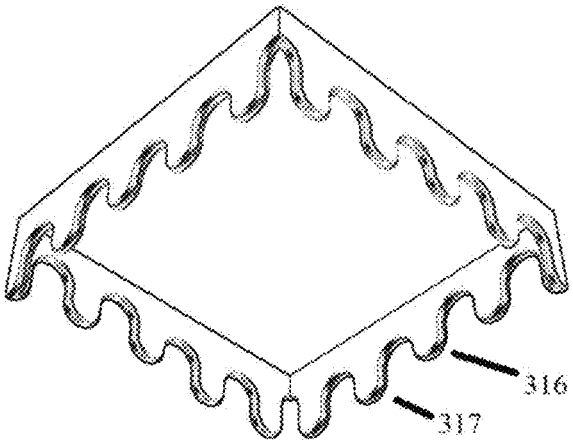

FIG. 86A is similar to FIG. 84A except it has a snake pattern that undulates at different heights.

Figure 86B:
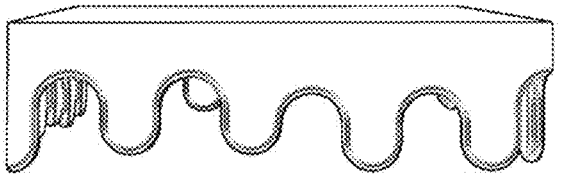

FIG. 86B is a side view of FIG. 86A.

Figure 86C:
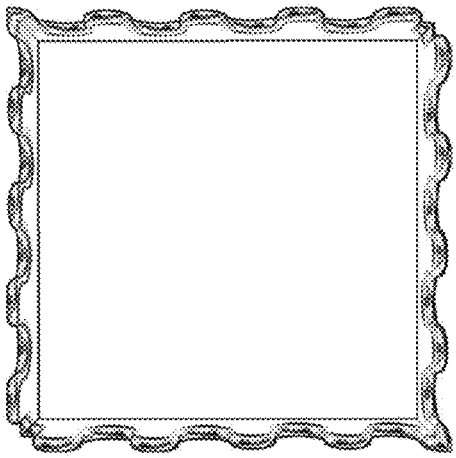

FIG. 86C is a bottom profile view of FIG. 86A.

Figure 87A:
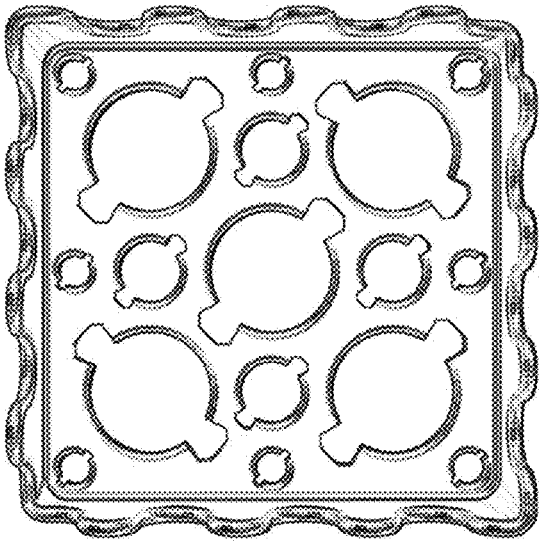
Figure 87B:
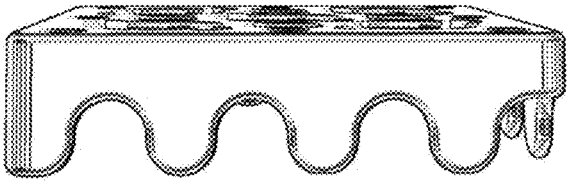
Figure 87C:
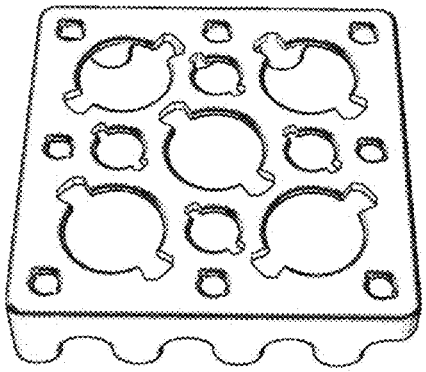

FIG. 87A is a profile view from the bottom of FIG. 87C.

FIG. 87B is a side view of FIG. 87C.

FIG. 87C is a coaster with different combinations of interfaces found in prior pieces to demonstrate that these interfaces are modular because they are interchangeable. These are modular pieces with modular interfaces.

Figure 88A:
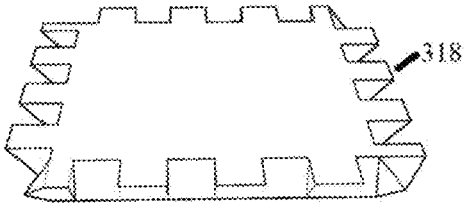
FIG. 88 is a top profile view of FIG. 8A.
Figure 89A:
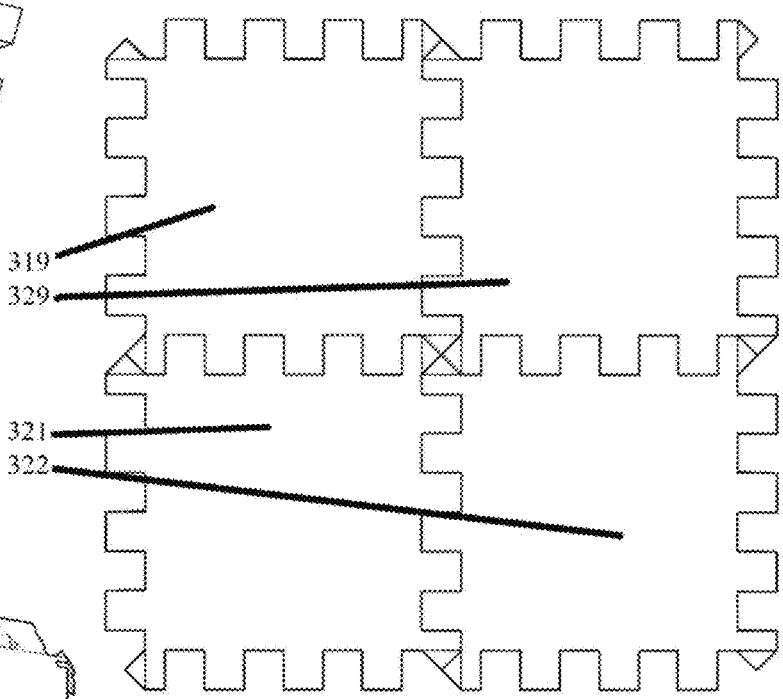

FIG. 88A is a coaster panel with blocks on the edges that allow it to be assembled to form a larger continuous flat panel as is shown in FIG. 89A. It can also be assembled to form a cube in a manner that is similar to FIG. 91 (FIG. 91 itself is specifically an assembly of FIG. 90B into a cube; these panels operate in a similar manner to build both panels and cubes).

Figure 88B:
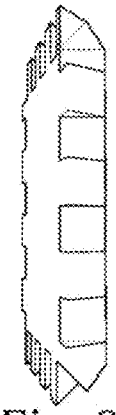

FIG. 88B is a vertical view of FIG. 88A.

Figure 88C:
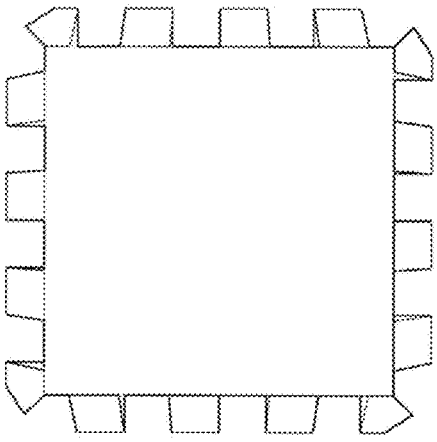

FIG. 88C is a profile view from the bottom of FIG. 88A.

Figure 88D:
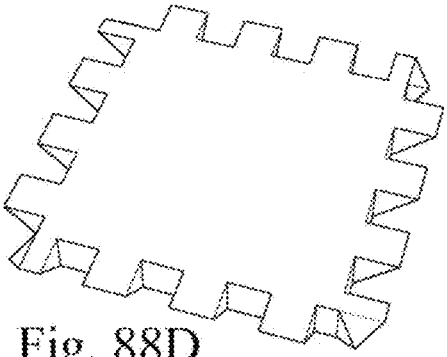

FIG. 88D is a view from the top of FIG. 88A.

FIG. 89A is a demonstration of how FIG. 88A panels assemble.

Figure 90A:
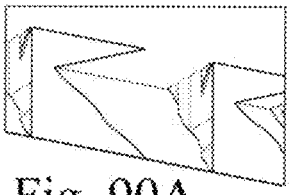
Figure 89B:
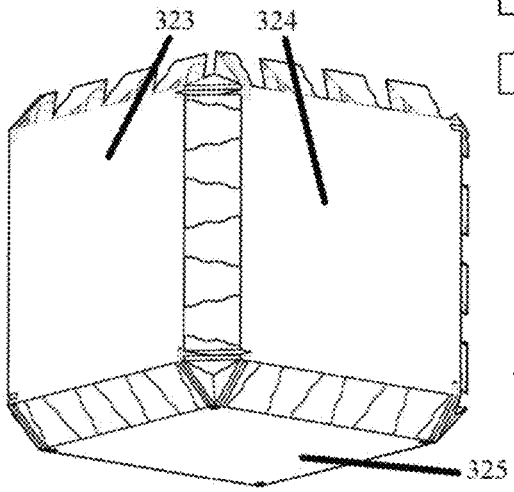
Figure 90B:
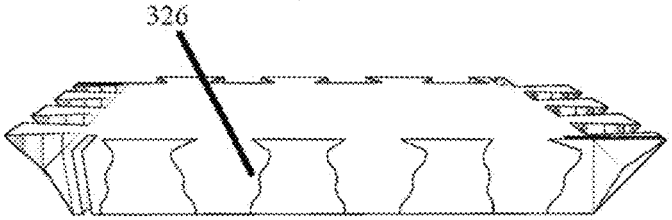

FIG. 89B is a demonstration of how FIG. 90B panels assemble.

FIG. 90A is a close-up view of a side of FIG. 90B.

Figure 17A:
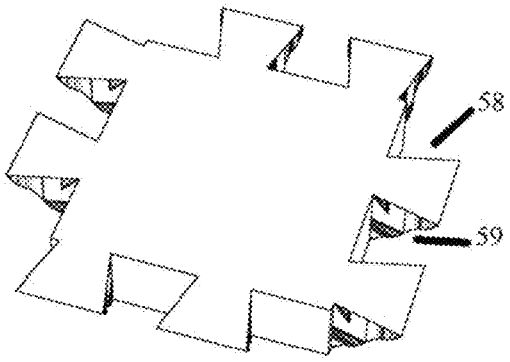
FIG. 17A is similar to FIG. 15A and FIG. 16A except its block edges have a wavy pattern that stabilizes it when the panel is assembled into a larger panel or into a cube.
Figure 17B:
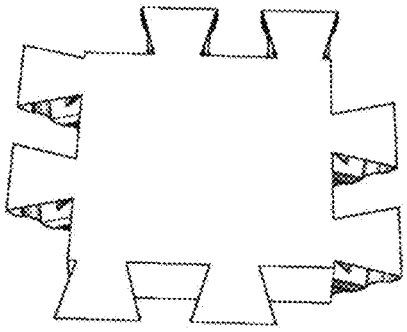
FIG. 17B is a top side view of FIG. 17A.

FIG. 90B has a wavy pattern on the blocks on the edges that is like FIG. 17A except FIG. 90A has a middle area that is larger relative to the geometries on its edges to allow it to interface with other pieces with similar ratios. While it is tempting to think of FIG. 908 as being larger than FIG. 17A, they are not necessarily of different sizes and in fact FIG. 17A could be larger than FIG. 90B. The ratios of the features to each other are the guiding principle and not the absolute size of the pieces.

Figure 90C:
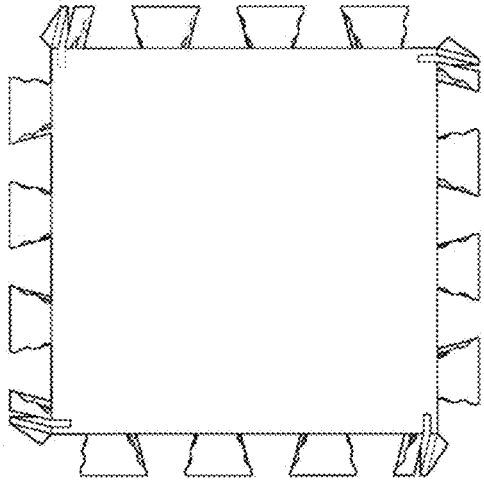

FIG. 90C is a profile view from the bottom of FIG. 90B.

Figure 91A:
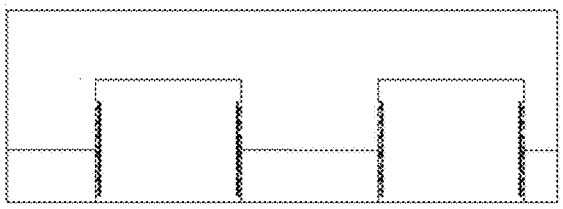
Figure 91B:
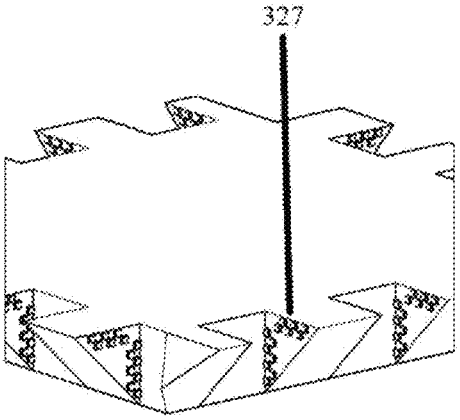

FIG. 91A is a close-up view of a side of FIG. 91B.

Figure 91C:
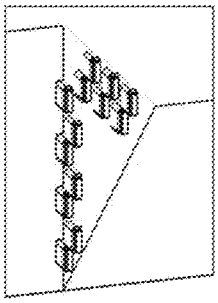

FIG. 91B is similar to FIG. 90B except it has a pattern of square snaps on the protruding triangles on its edges that are visible in FIGS. 91B and 91C. This allows it to snap and lock in place when the panels are assembled perpendicularly (as is shown in FIG. 92A) and then they are assembled horizontally (as is shown in FIG. 92B, where the wireframe of one panel is black and the other panel is orange).

FIG. 91C is a close-up view at an angle of FIG. 91A.

Figure 91D:
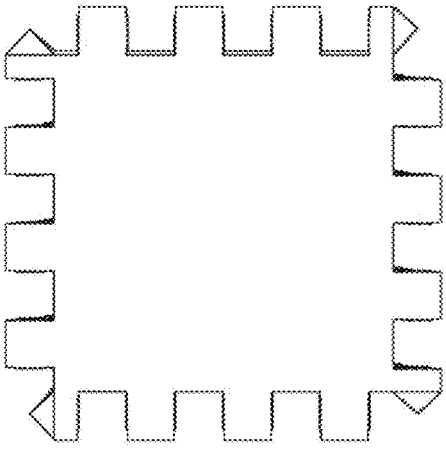

FIG. 91D is a profile view from the bottom of FIG. 91B.

Figure 92A:
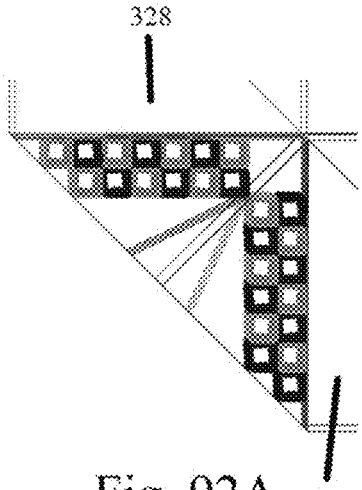
Figure 92B:
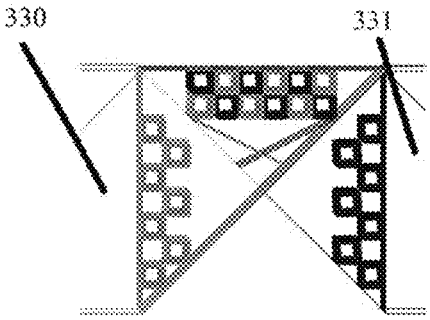

FIG. 92A shows how FIG. 91B assembles into itself perpendicularly.

FIG. 92B shows how FIG. 91B assembles into itself horizontally.

Figure 93A:
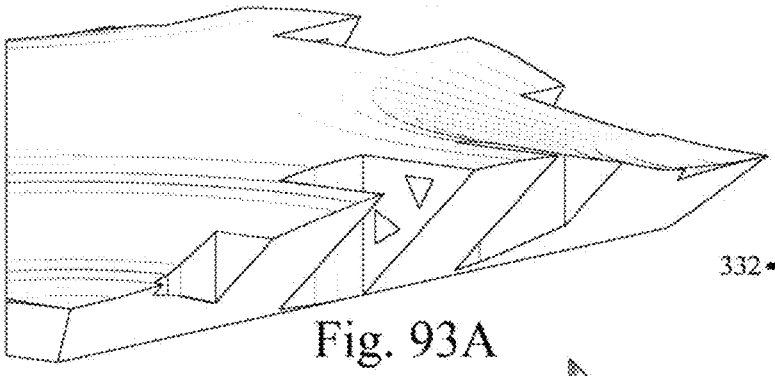
Figure 93B:
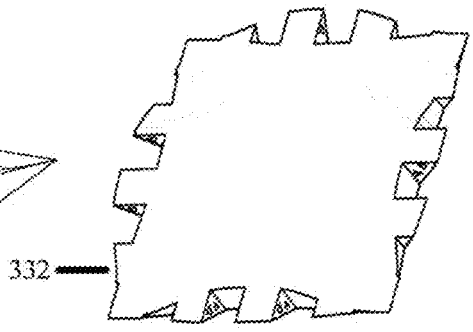

FIG. 93A is a close-up view of a corner of FIG. 93B.

Figure 93C:
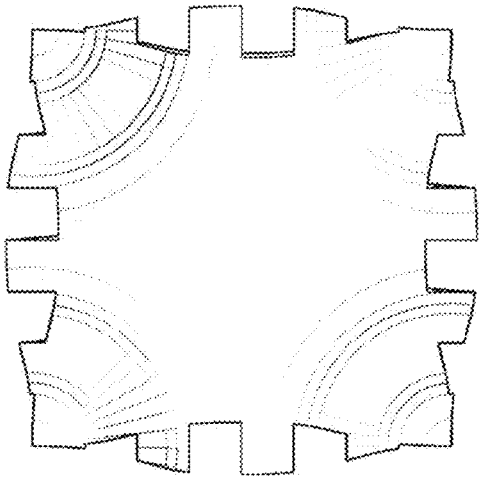
Figure 94A:
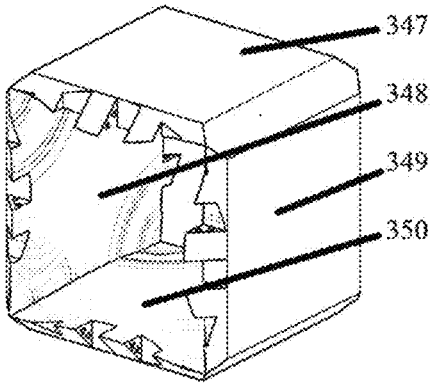
Figure 94B:
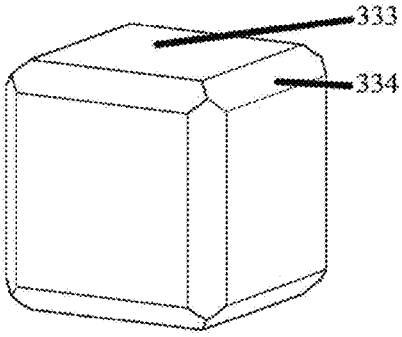
Figure 94C:
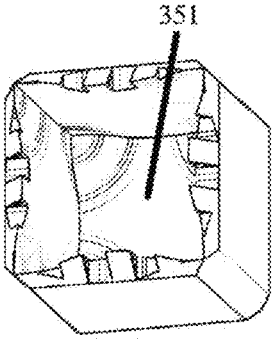
Figure 94D:
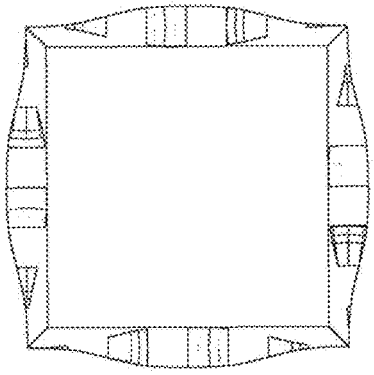
Figure 94E:
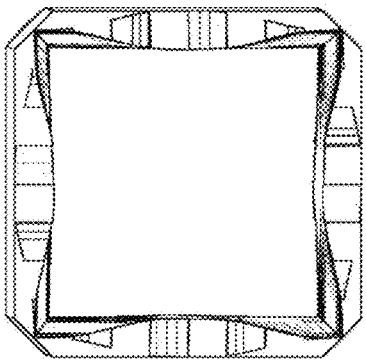
Figure 94F:
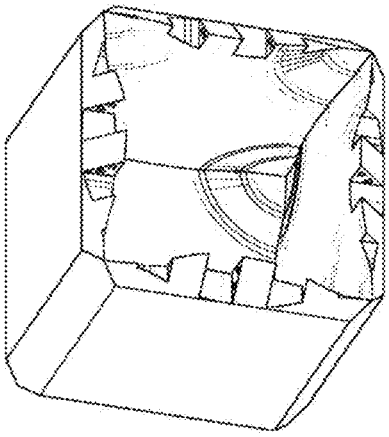
Figure 94G:
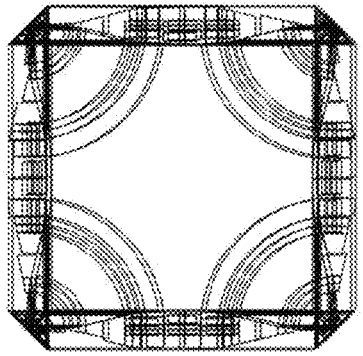
Figure 94H:
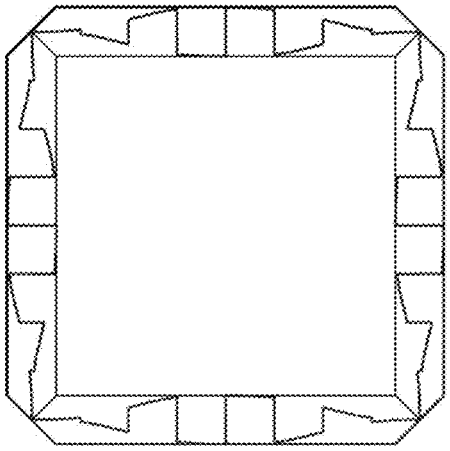
Figure 94I:
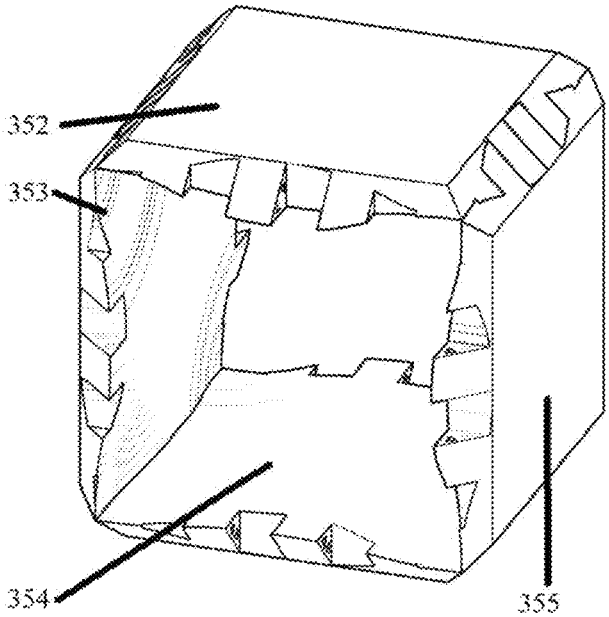
Figure 94J:
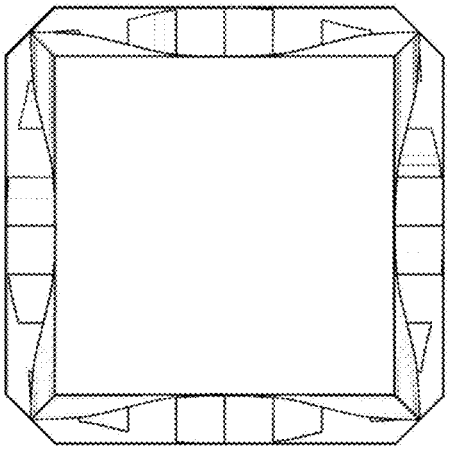
Figure 94K:
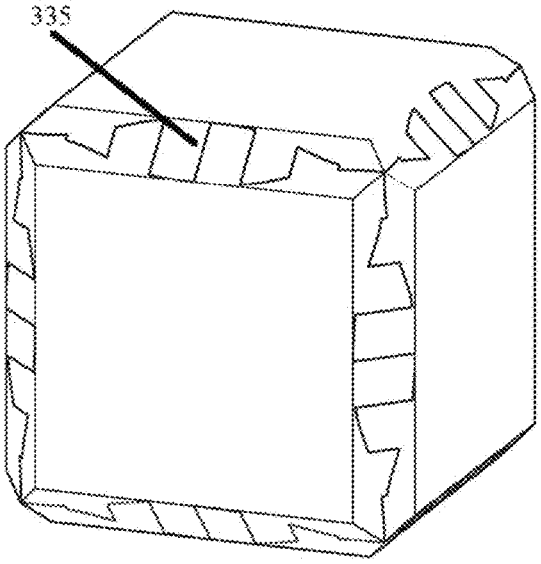
Figure 94L:
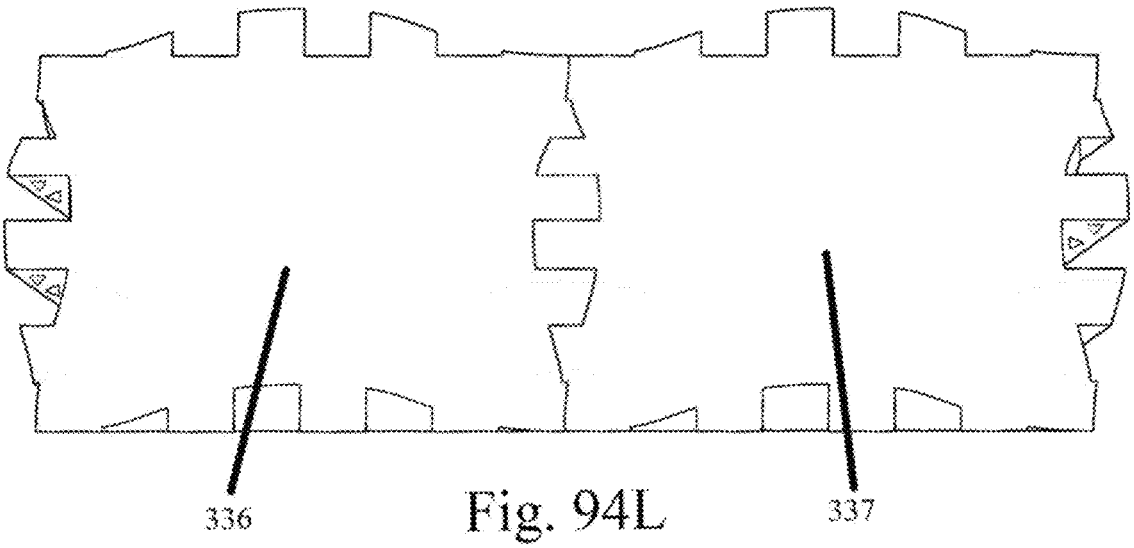
Figure 94M:
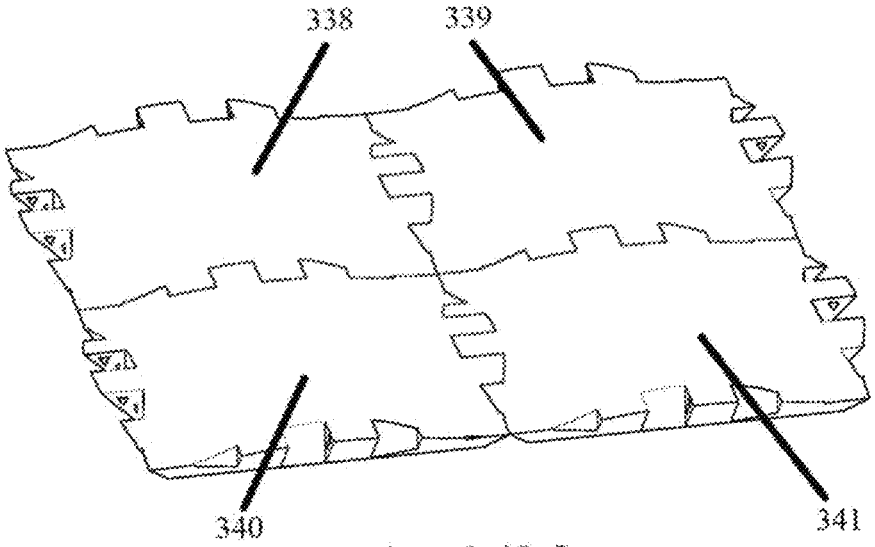
Figure 94N:
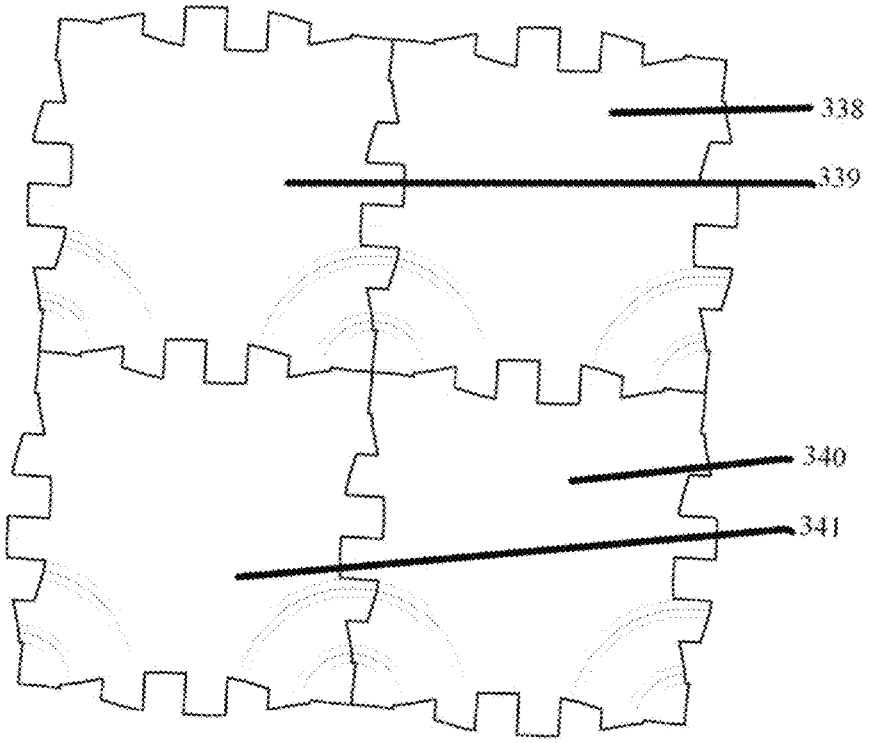
Figure 94O:
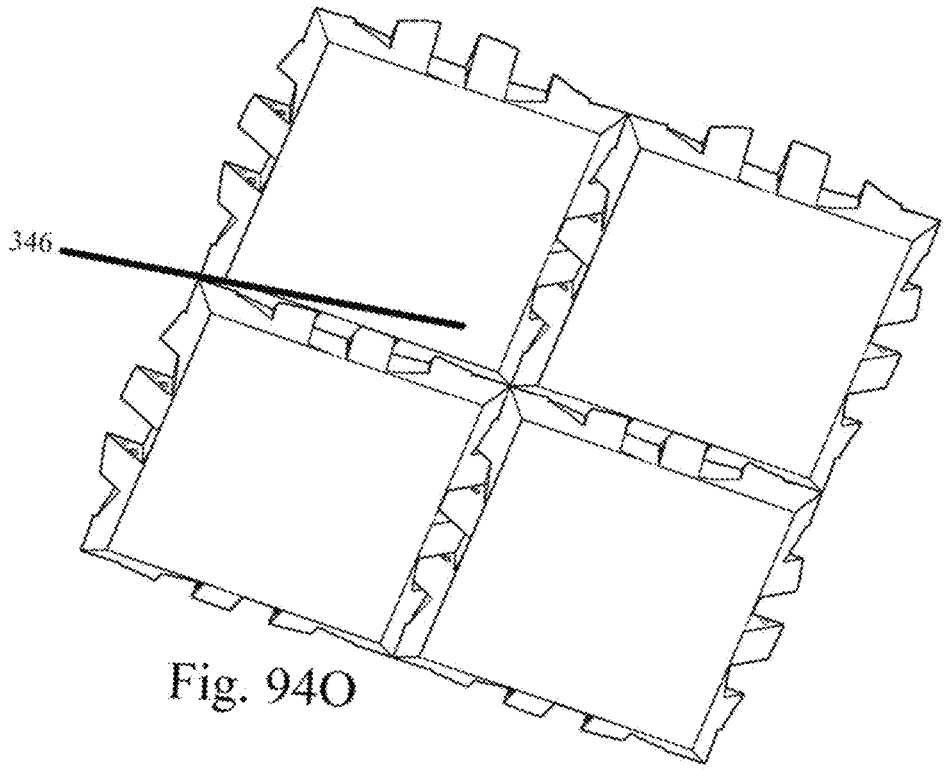

FIG. 93B is a panel that is similar to FIG. 91B except its edges undulate so that it can be assembled into a cube with flat sides (as is seen in FIG. 94B; the interlocking edges are most visible in FIG. 94K) and so that it can be assembled into smooth surfaces (as is seen in FIGS. 94L, 94M and 94N). The bottom side of the panel when assembled to form a smooth flat surface on the top is shown in FIG. 94O. Additional views of FIG. 94A are of the panel that is FIG. 93C assembled, or partially assembled, to form a cube.

FIG. 93C is a top profile view of FIG. 93B.

Figure 93D:
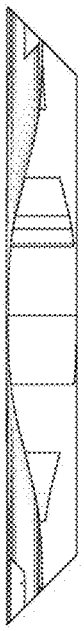

FIG. 93D is a side profile view of FIG. 93B.

Figure 93E:
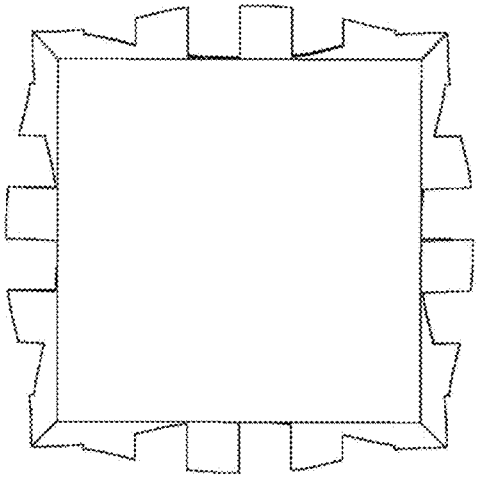

FIG. 93E is a profile view of the bottom of FIG. 93B.

FIG. 94A is an example of how panels that are FIG. 93B assemble.

FIG. 94B is another example of how FIG. 93B panels assemble.

FIG. 94C is an example of how an additional FIG. 93B panel assembles into FIG. 94A.

FIG. 94D is a profile view from the bottom of assembled panels.

FIG. 94E is a profile view of the open side of FIG. 94A.

FIG. 94F is a view of the object at FIG. 94C from a different angle.

FIG. 94G is a wireframe view of a cube made from FIG. 93B panels.

FIG. 94H is a profile view of a cube of assembled panels.

FIG. 94I is a top side view of four panels assembled together.

FIG. 94J is a profile view of the open side of FIG. 94I.

FIG. 94K is a top corner view of the cube shown in FIG. 94H.

FIG. 94L is an example of how FIG. 93B panels assemble.

FIG. 94M is another view of FIG. 94L.

FIG. 94N is a profile view from the top of FIG. 94L.

FIG. 94O is a view from the bottom of FIG. 94N.

Figure 95A:
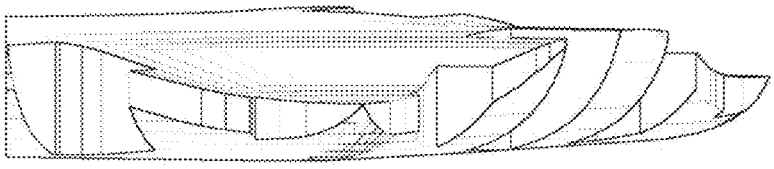
Figure 95B:
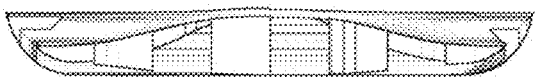
Figure 95C:
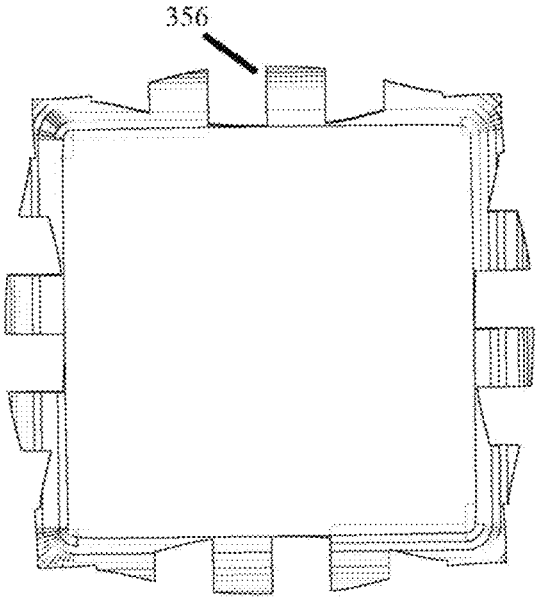

FIG. 95A is a close-up view of a side of FIG. 95C.

FIG. 95B is a profile view of the side of FIG. 95C.

FIG. 95C is similar to FIG. 93B except its edges are rounded, and not as pointed, for safety and to make them stronger. FIG. 95C assembles at 90-degrees in the manner shown in FIG. 96C and forms a cube in the manner shown in FIGS. 96D, 96E and 96F. FIG. 95C assembles into smooth panels surfaces as is shown in FIG. 96G, 96H, 96I and 96J. The bottom view of these smooth larger assembled panels is shown in FIGS. 96K and 97L.

Figure 95D:
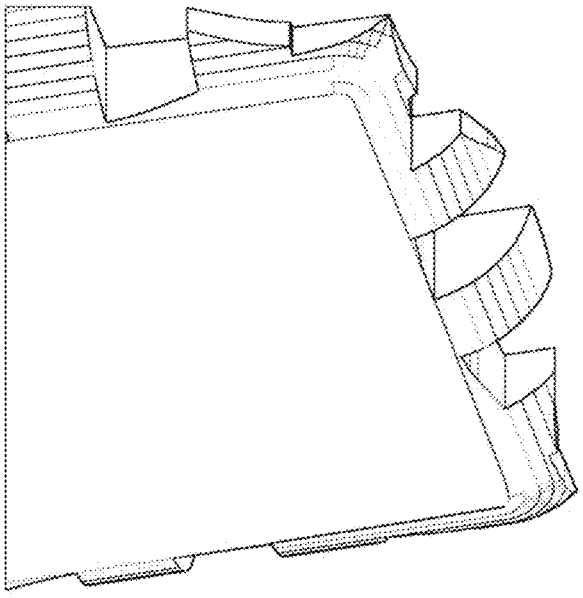

FIG. 95D is a close-up view from the bottom of FIG. 95C.

Figure 96A:
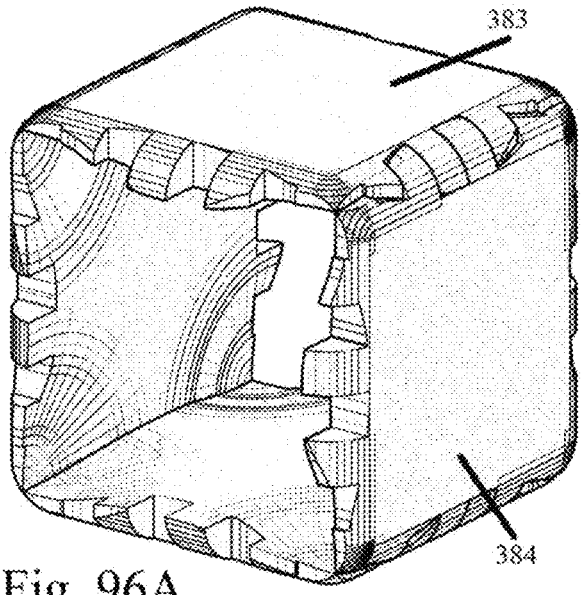

FIG. 96A is an example of how FIG. 95C pieces assemble.

Figure 96B:
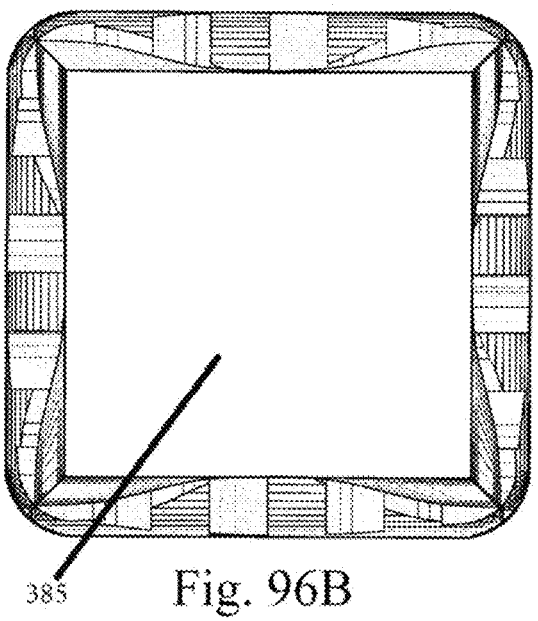

FIG. 96B is a profile view of an open side if FIG. 96A.

Figure 96C:
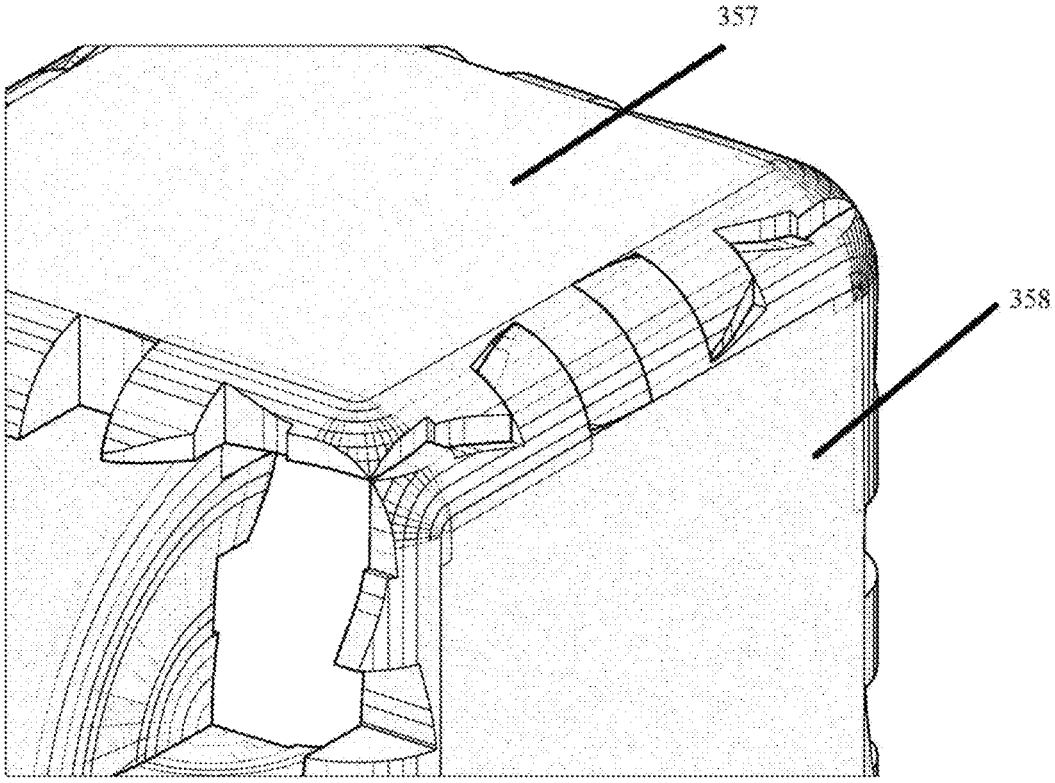

FIG. 96C shows how FIG. 95C assembles.

Figure 96D:
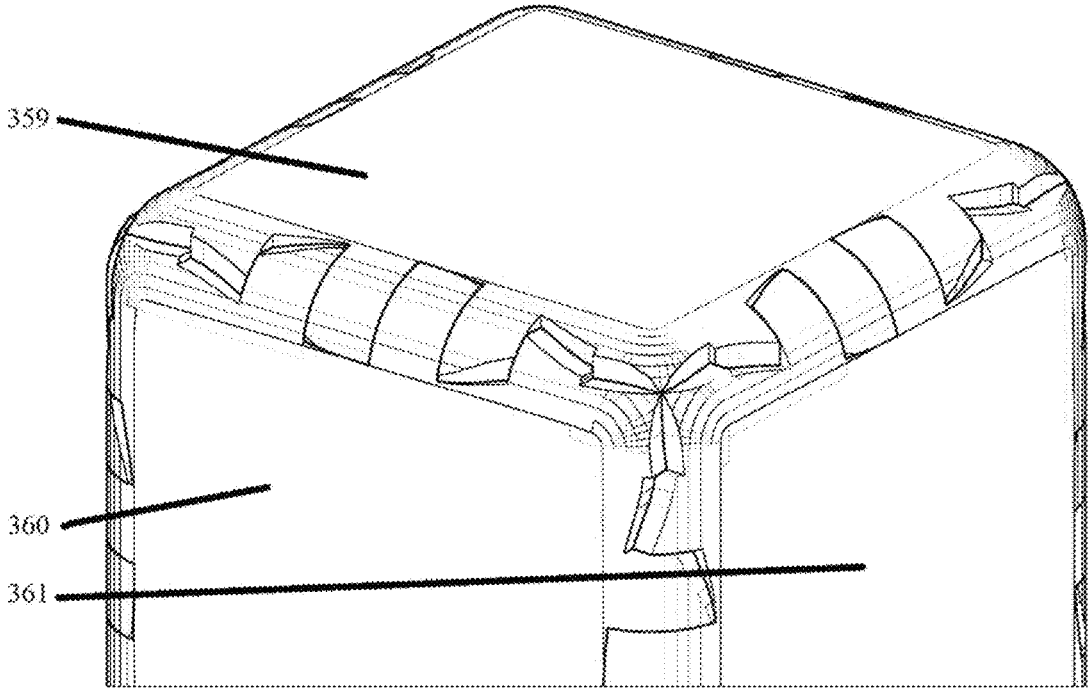

FIG. 96D is a close-up view of how FIG. 95C pieces assemble.

Figure 96E:
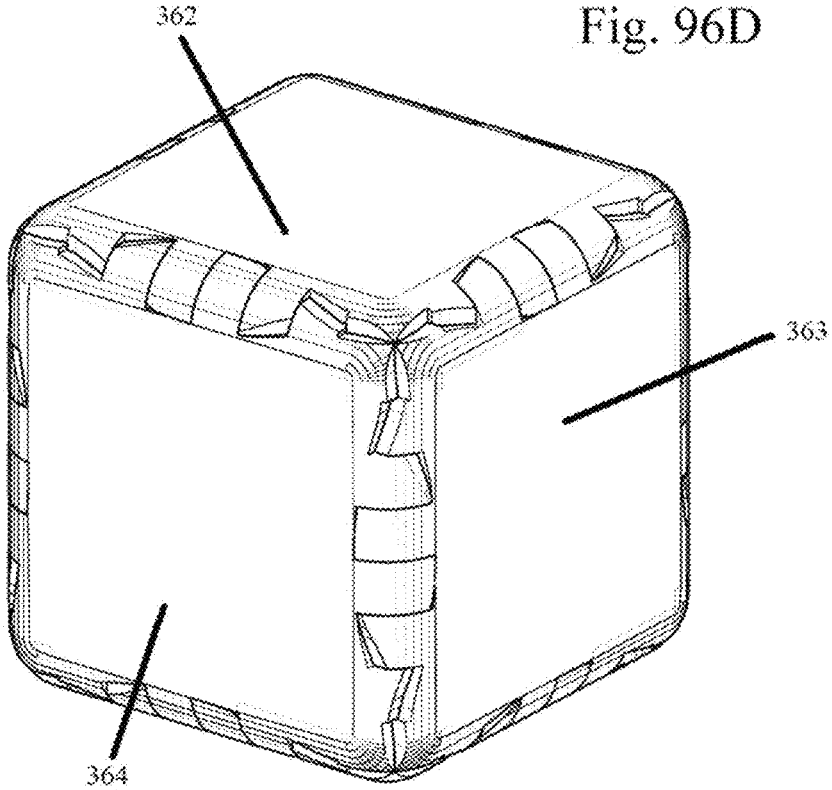

FIG. 96E is a view of how FIG. 95C pieces assemble.

Figure 96F:
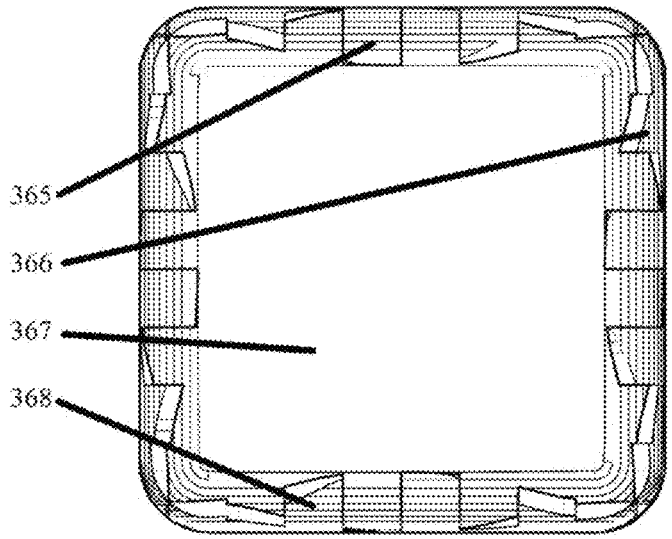

FIG. 96F is a profile view of FIG. 96E.

Figure 96G:
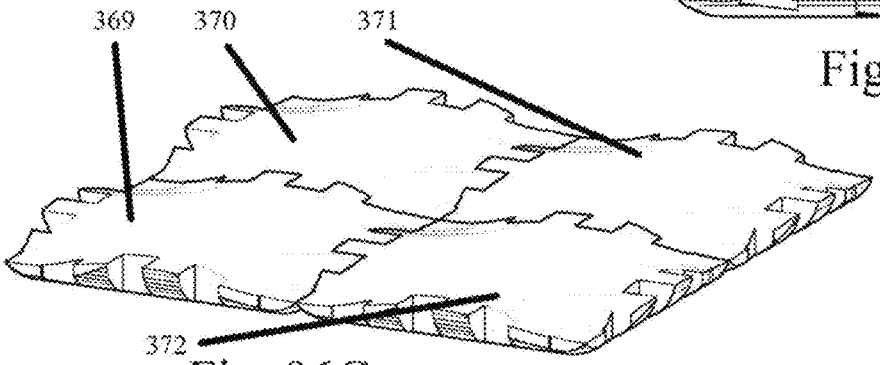

FIG. 96G is a view of how FIG. 95C pieces assemble horizontally.

Figure 96H:
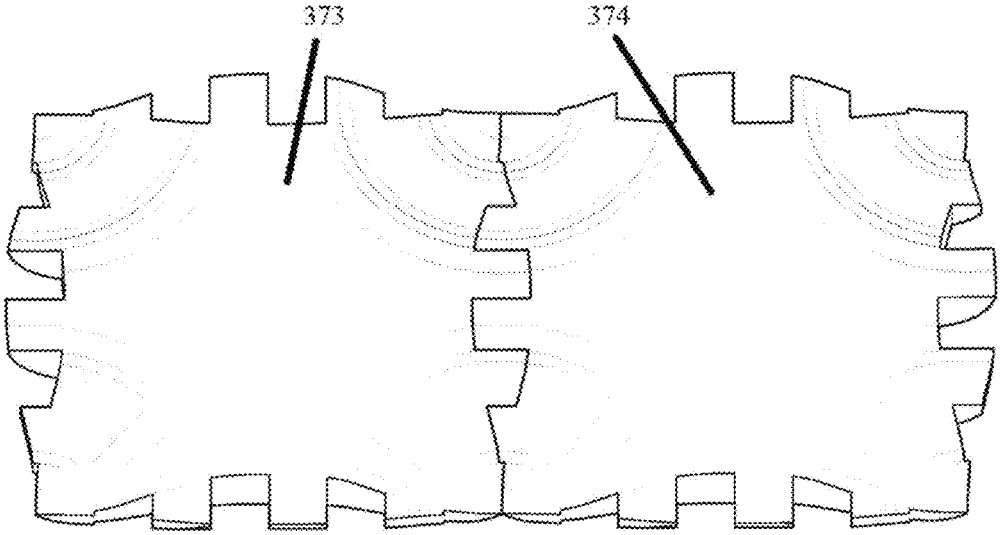

FIG. 96H is a top side view of FIG. 96G.

Figure 96I:
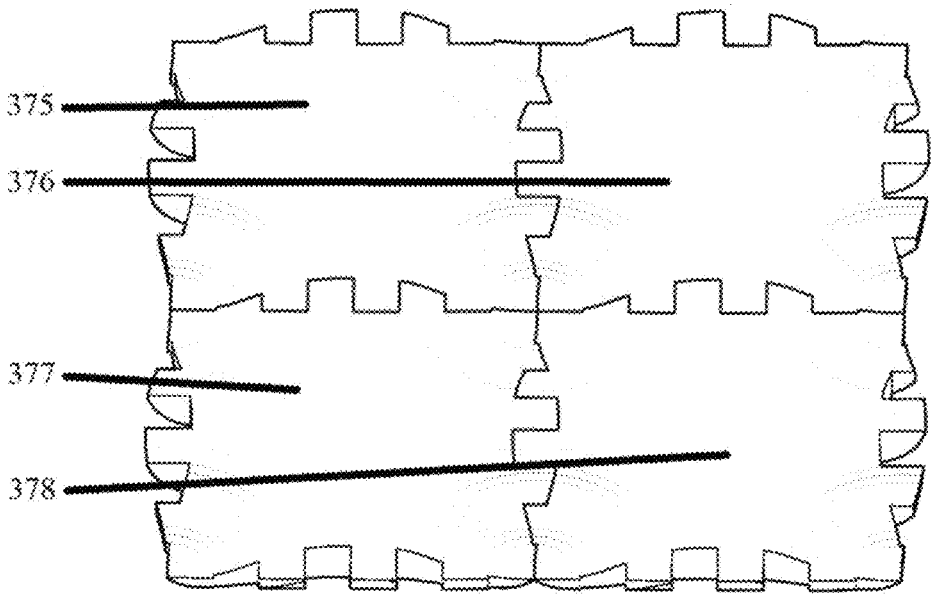

FIG. 96I is a view from a top side of FIG. 96G.

Figure 96J:
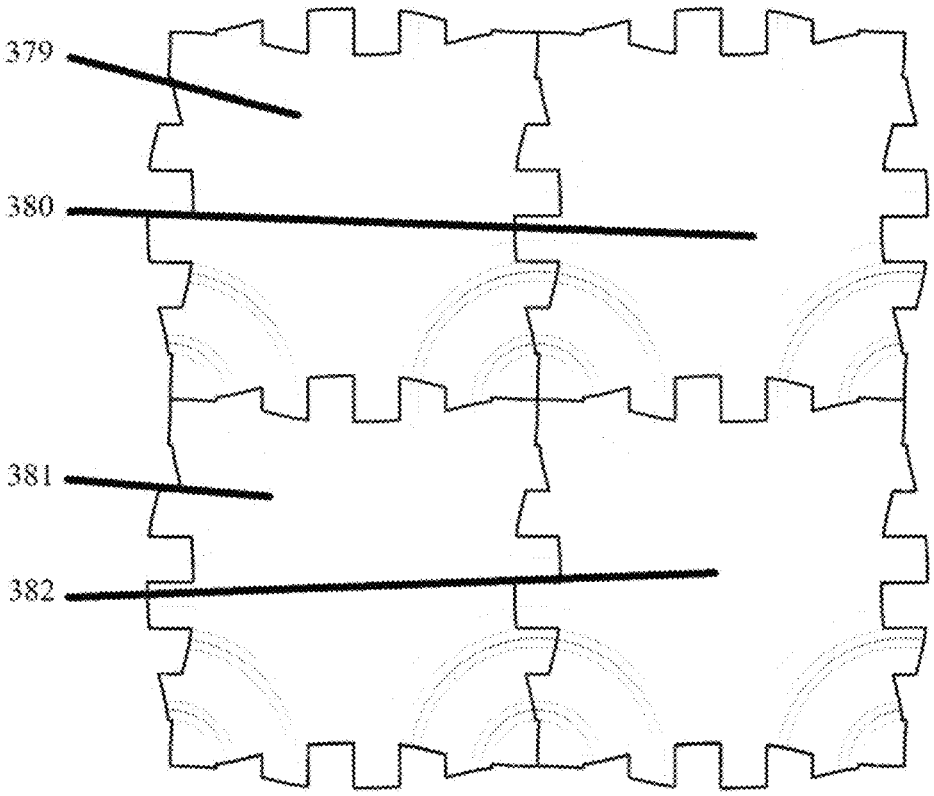
Figure 96K:
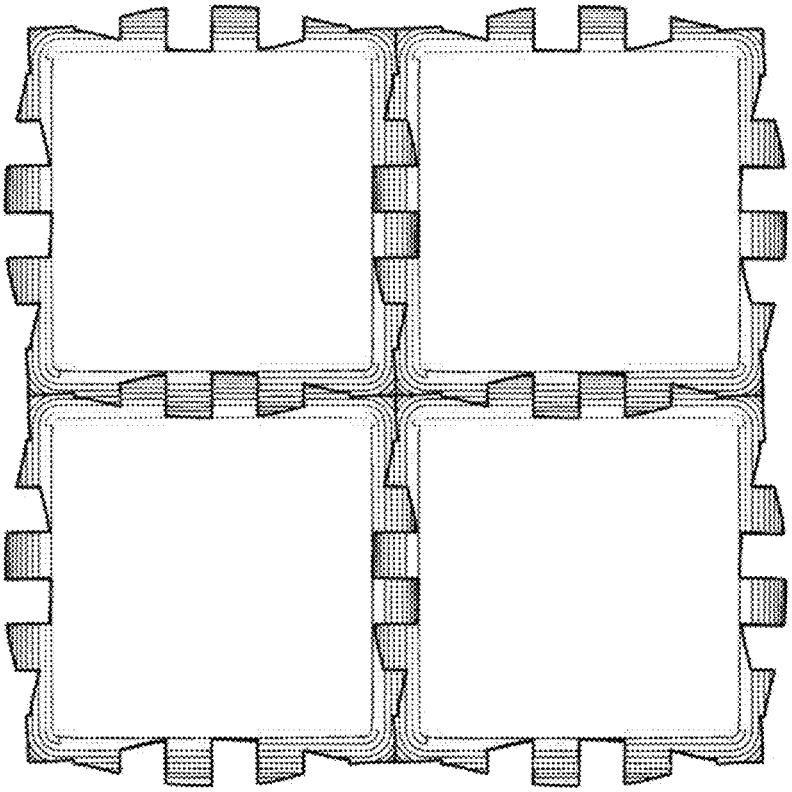

FIG. 96J is a top profile view of FIG. 96G.

FIG. 96K is a bottom view of FIG. 96G.

Figure 96L:
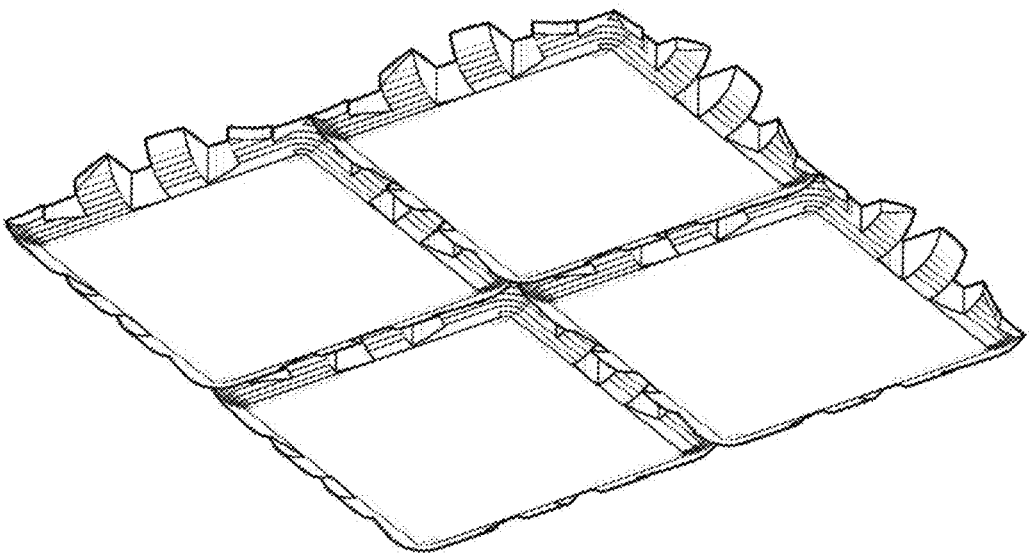

FIG. 96L is a bottom corner view of FIG. 96G.

Figure 97A:
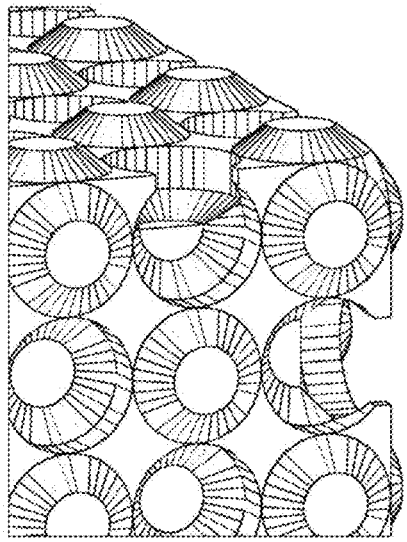
Figure 97B:
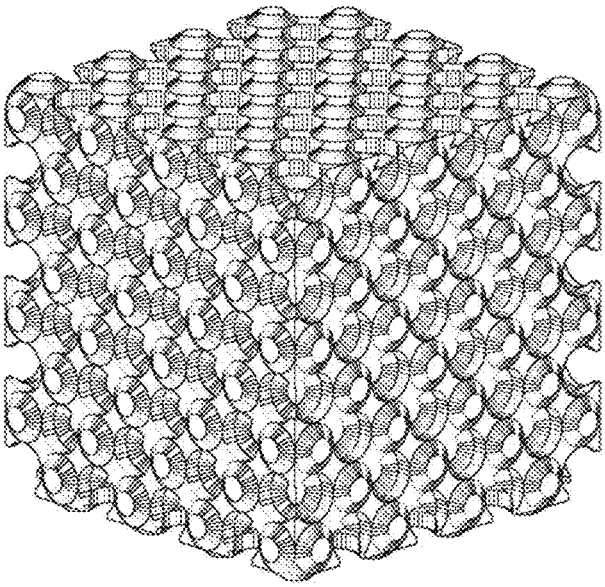

FIG. 97A is a close-up view of a corner of FIG. 97B.

FIG. 97B is a knob cube that can be assembled into coasters, walls, panels and larger cubes. It is a cube form of FIG. 29A.

Figure 97C:
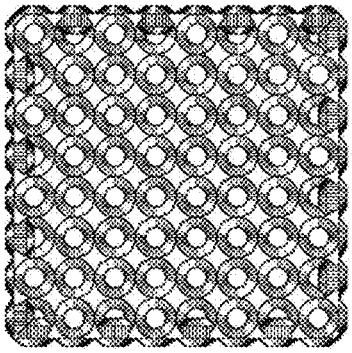

FIG. 97C is a profile view of FIG. 97B.

Figure 97D:
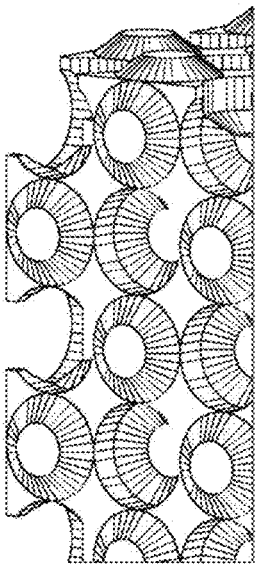

FIG. 97D is another close-up view of a corner of FIG. 97B.

Figure 98A:
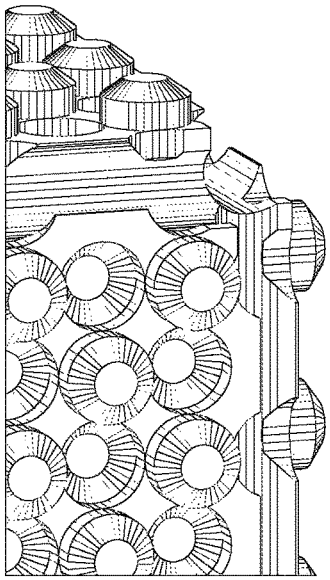
FIG. 98 is a view of FIG. 9A from the bottom.
Figure 98B:
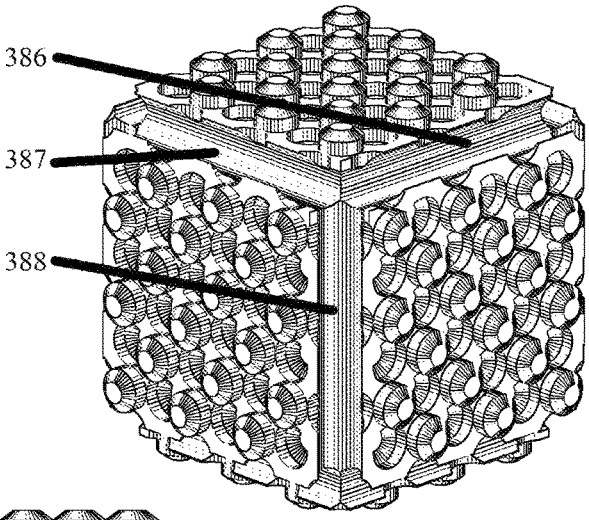

FIG. 98A is a close-up view of a corner of FIG. 98B.

FIG. 98B is similar to FIG. 978 except FIG. 98B has shafts on the side through which reinforcement poles can be inserted or through which poles and spheres can be transported. Those shafts and poles can be magnetized in a reversible manner to enable the inserted poles and spheres to attract cube constructions to be stronger.

Figure 98C:
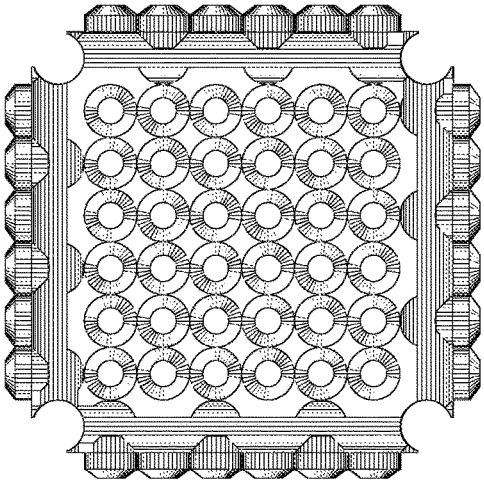

FIG. 98C is a profile view of a side of FIG. 98B.

Figure 99A:
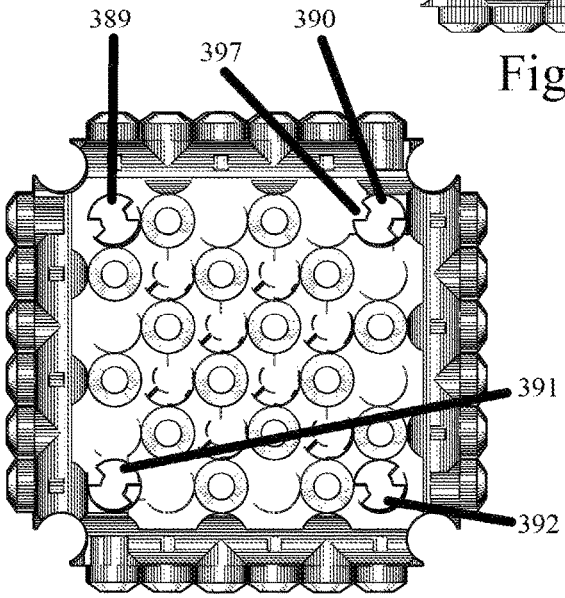
Figure 99B:
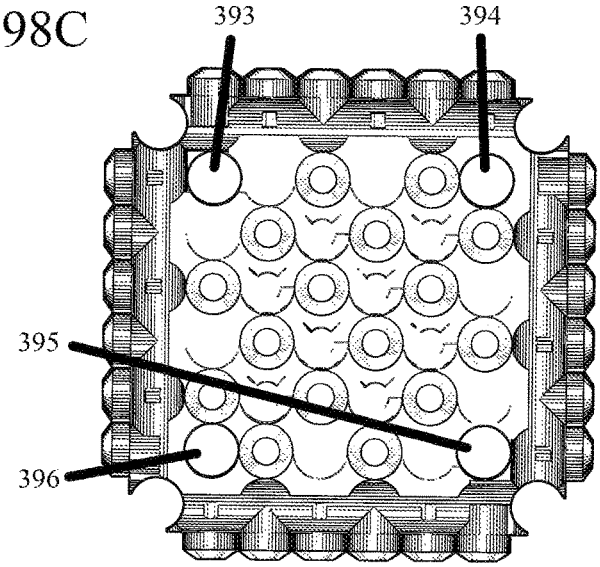

FIG. 99A is similar to FIG. 98B except it has four additional pole shafts on the edges of each profile view as can be seen in FIGS. 99A and 99B. FIG. 99A shows shafts that also have protruding knobs onto which poles can hook to affix the cubes together with hooked poles.

FIG. 99B is a profile view of FIG. 99A from a different angle.

Figure 99C:
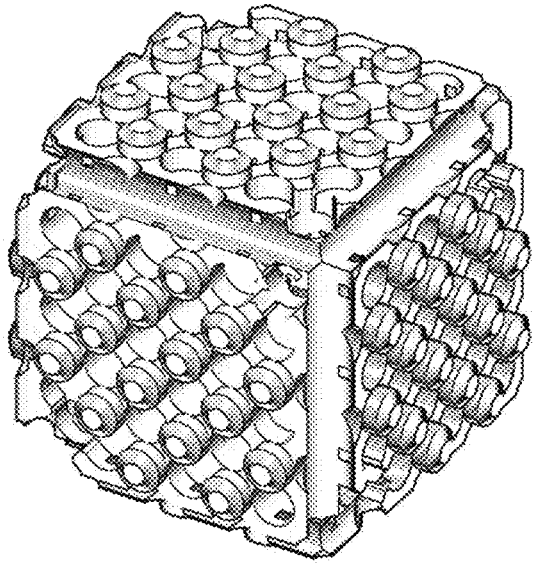

FIG. 99C is a top corner view of FIG. 99A.

Figure 100A:
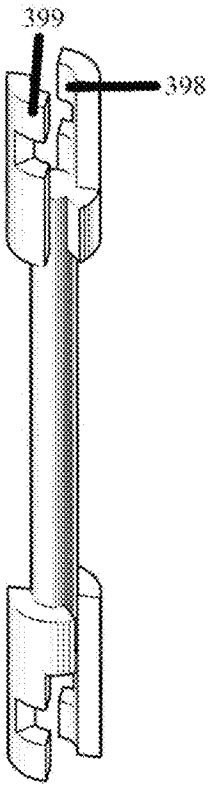

FIG. 100A is a pole with hook interfaces on its ends that hooks FIG. 99A pieces together. It is the same as FIG. 48B.

Figure 100B:
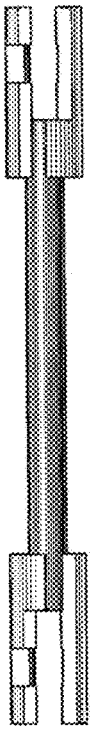

FIG. 100B is a side profile view of FIG. 100A.

Figure 100C:
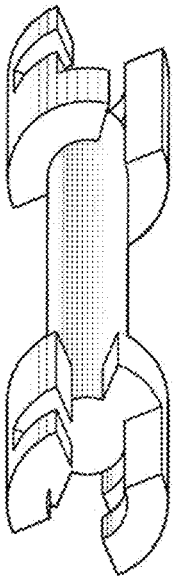

FIG. 100C is a view from an end of FIG. 100A.

Figure 101A:
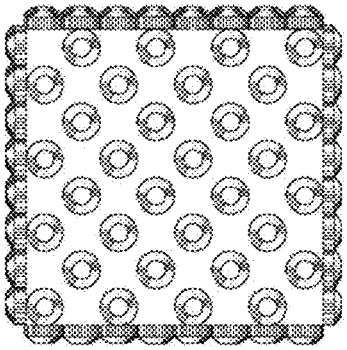
Figure 101B:
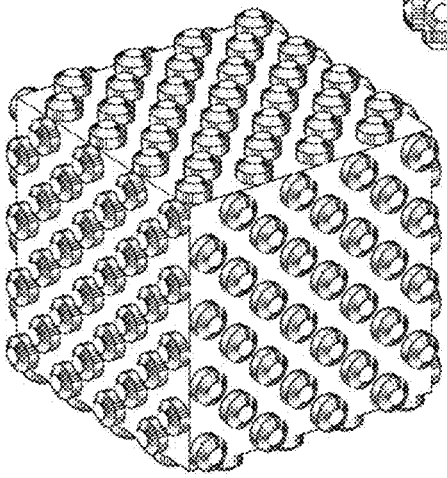
Figure 101C:
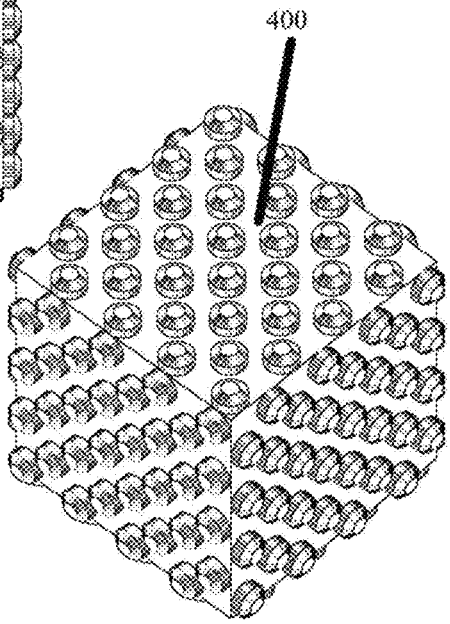

FIG. 101A is a side profile view of FIG. 101C.

FIG. 101B is a view of FIG. 101C from a slightly different angle.

Figure 28A:
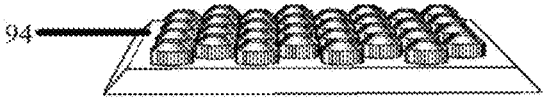
FIG. 28A can be assembled into itself because its knobs form female spaces into which other knobs can be inserted. It can also fit into a wide range of the other panels.

FIG. 101C is a cube version of the panel at FIG. 28A.

Figure 12A:
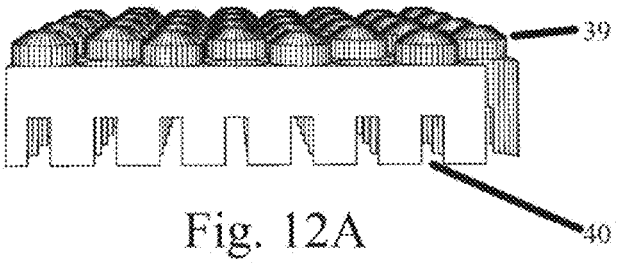
FIG. 12A is a panel comprised of male and female knob interfaces. The panel's male interfaces insert into the female interfaces and the male interfaces insert into the empty places on the male surface. This panel can insert into itself to form columns, floor surfaces and walls (when assembled in a staggered manner).
Figure 102A:
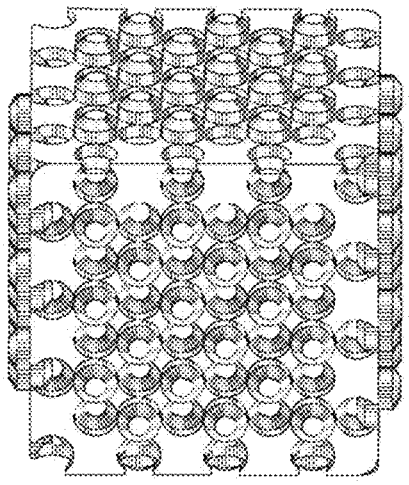
Figure 102B:
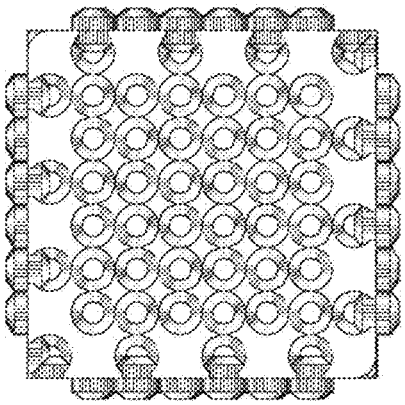
Figure 102C:
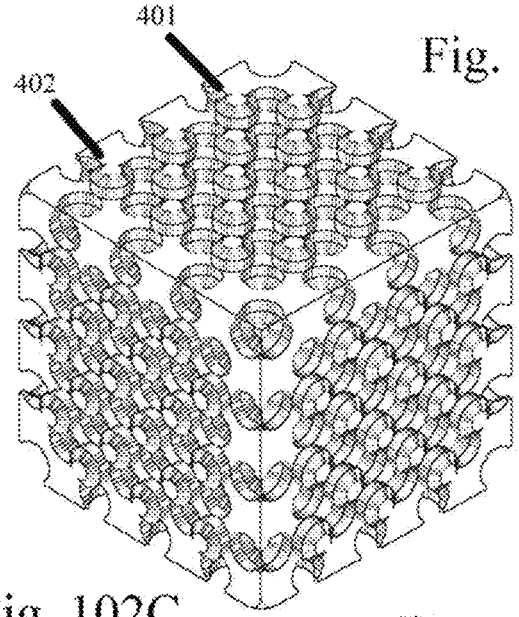

FIG. 12A is a top side view of FIG. 102C.

FIG. 102B is a side profile view of FIG. 102C.

FIG. 102C is similar to FIG. 97B except it has less protruding knobs on the edges to make it easier to stack it with other pieces.

Figure 103A:
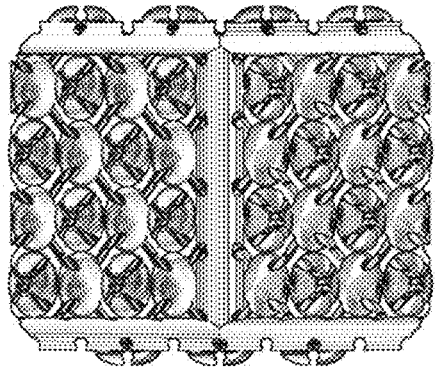
Figure 103B:
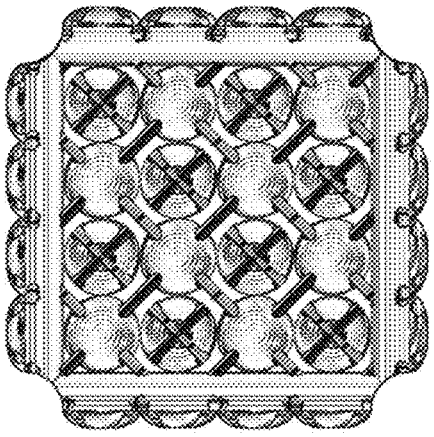
Figure 103C:
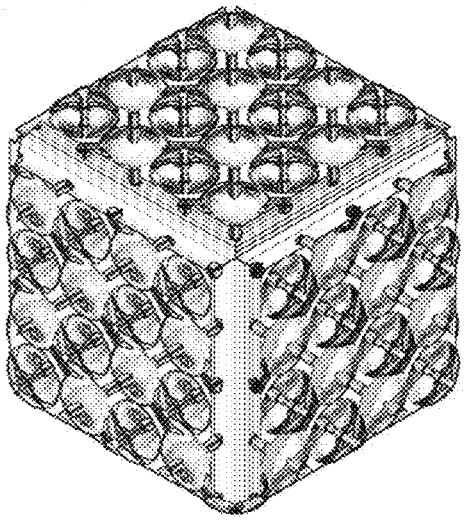

FIG. 103A is a corner side view of FIG. 103C.

FIG. 103B is a side profile view of FIG. 103C.

FIG. 103C is a cube version of FIG. 24A.

Figure 103D:
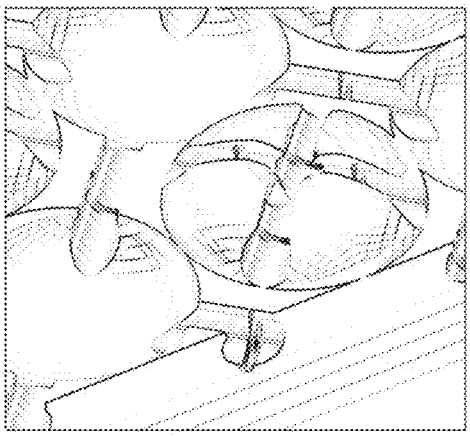

FIG. 103D is a close-up view of FIG. 103C.

Figure 103E:
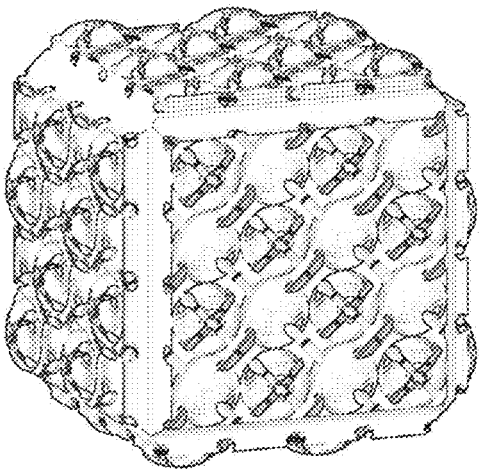

FIG. 103E is a different view of FIG. 103C.

Figure 104A:
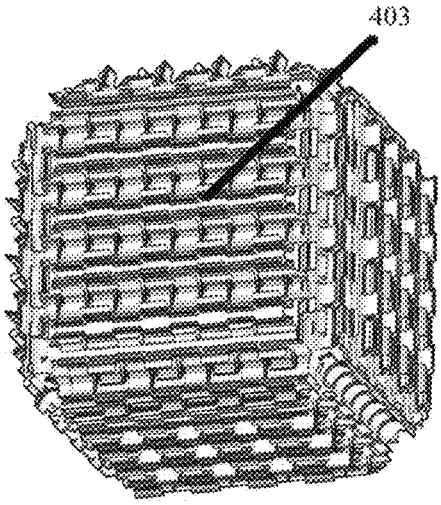

FIG. 104A is a cube version of FIG. 41A. The series of objects at FIG. 105A and following is comprised of FIG. 104A cubes assembled together. In those FIGs. it is clear how the cubes snap together to form hollow cavities into which poles or spheres can be inserted to lock the pieces in place.

Figure 104B:
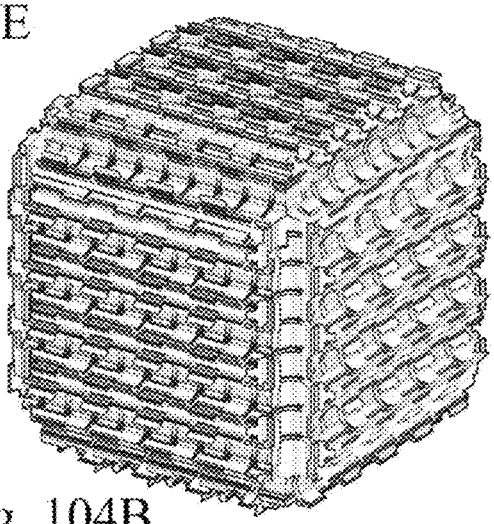

FIG. 104B is a slightly different view of FIG. 104A.

Figure 104C:
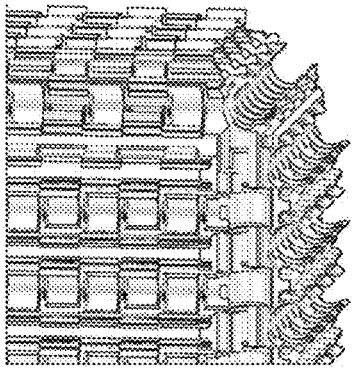

FIG. 104C is a close-up view of FIG. 140A.

Figure 104D:
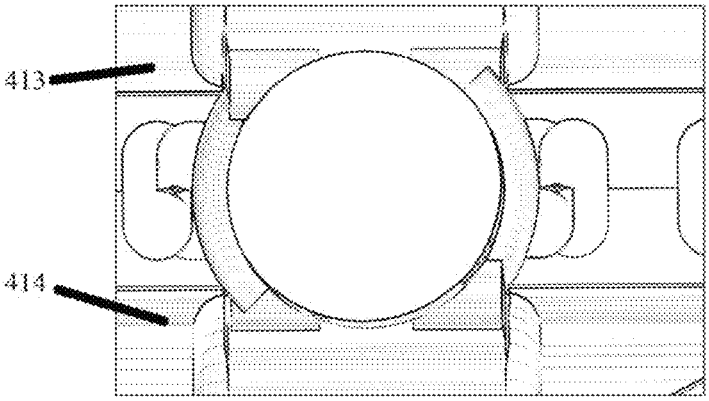

FIG. 104D is a close-up view of how two 104A pieces snap together.

Figure 104E:
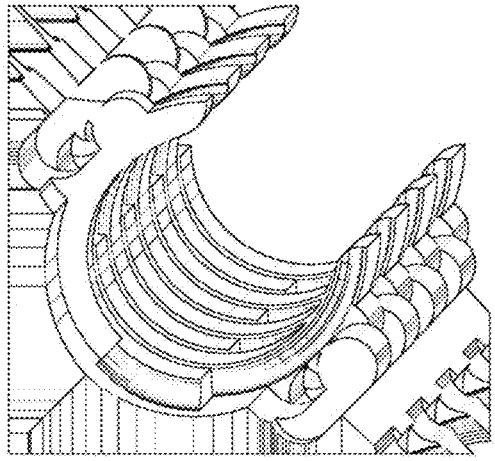

FIG. 104E is a close-up view of a corner edge of FIG. 104A.

Figure 104F:
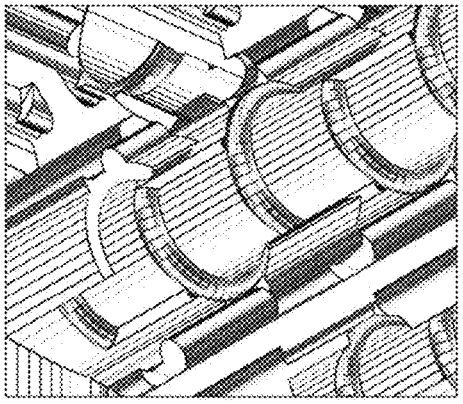

FIG. 104F is a close-up view looking directly at a corner edge of FIG. 104A.

Figure 104H:
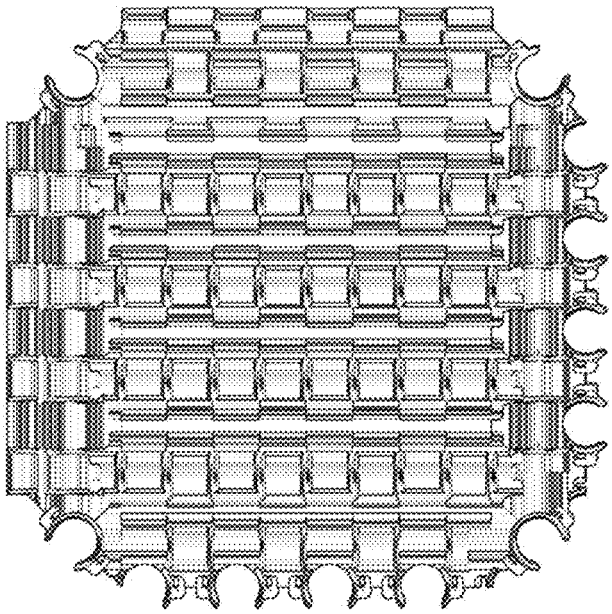
Figure 104G:
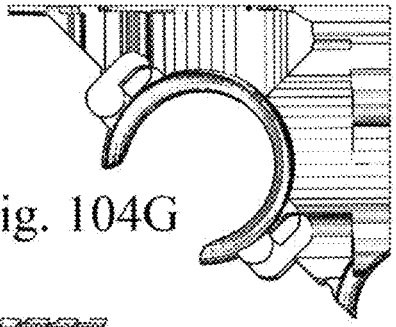

FIG. 104G is a profile close-up view of a corner edge of FIG. 104A.

FIG. 104H is a profile view from a side of FIG. 104A.

Figure 104I:
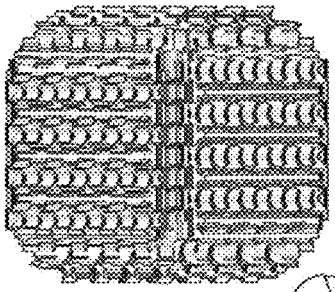

FIG. 104I is a corner view of FIG. 104A.

Figure 105A:
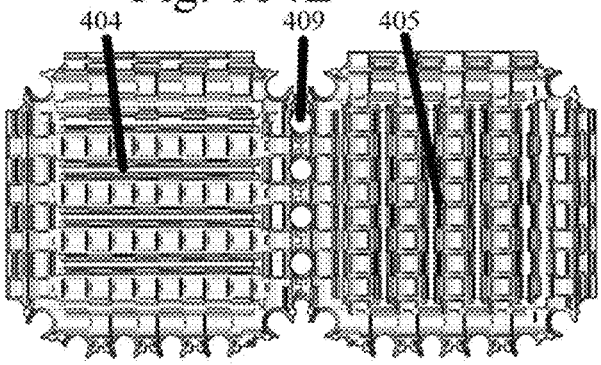

FIG. 105A is an example of how FIG. 104A pieces assemble.

Figure 105B:
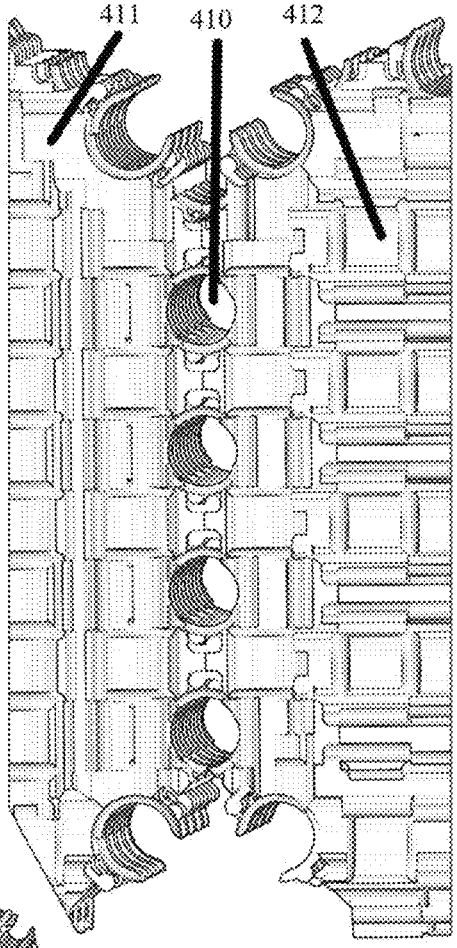

FIG. 105B is a close-up view of the intersection point of the objects that make up FIG. 105A.

Figure 105C:
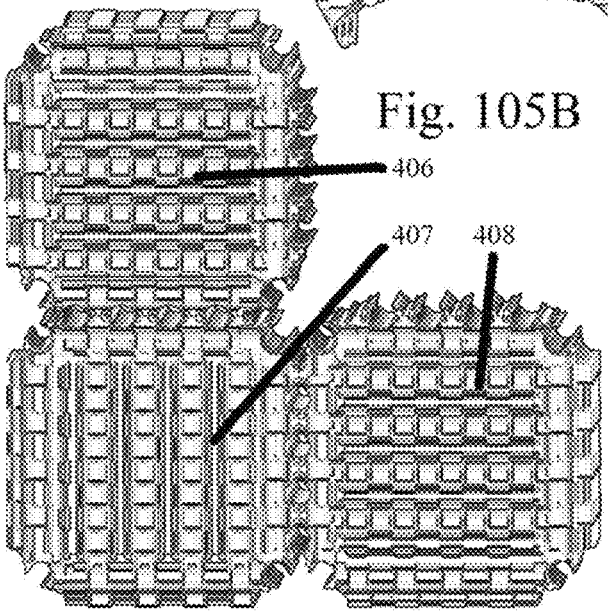

FIG. 105C is a demonstration of how an additional FIG. 104A piece assembles onto a FIG. 105A piece.

Figure 106A:
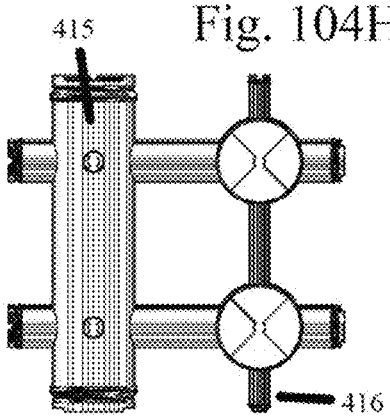

FIG. 106A is the beginning of a set of tubes of exponentially larger and smaller sized that are arranged into the dimensions of an equilateral cube that is as high as it is deep and wide. It fits into itself in the manner shown in FIG. 107A.

Figure 106B:
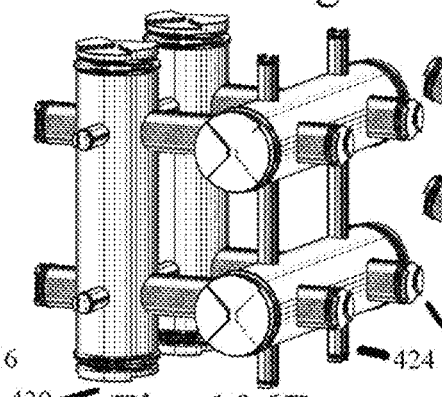

FIG. 106B is a different side view of FIG. 106A.

Figure 106C:
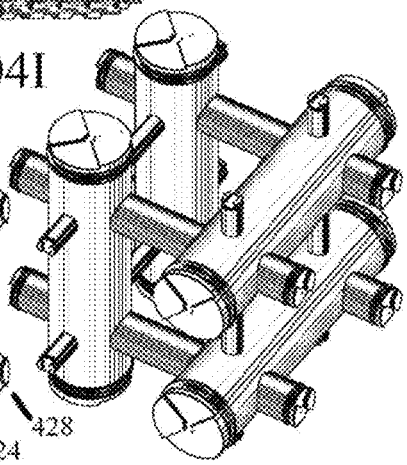

FIG. 106C is a top corner view of FIG. 106A.

Figure 107A:
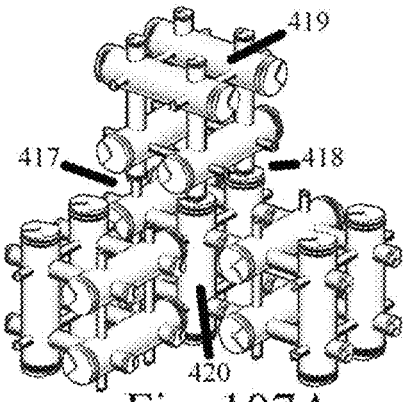

FIG. 107A shows how FIG. 106A fits into itself.

Figure 107B:
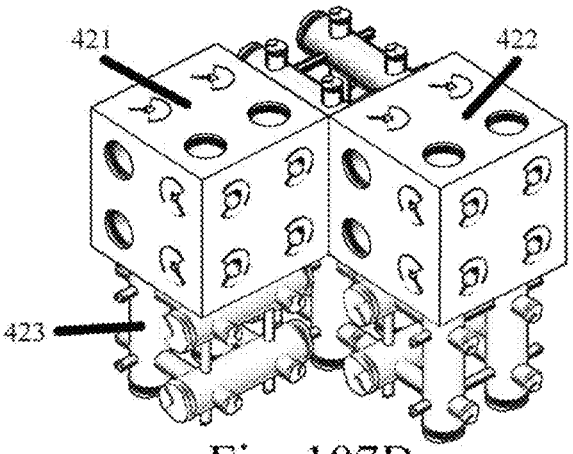
Figure 112A:
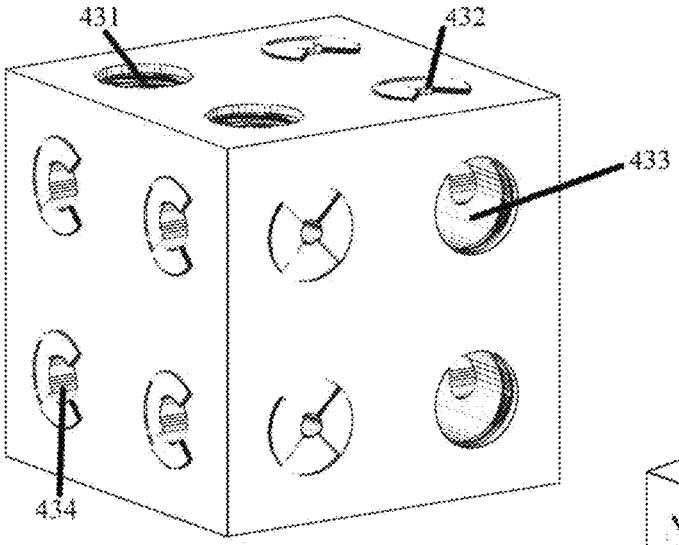

FIG. 107B is an example of how FIG. 112A pieces fit onto FIG. 107A.

FIGS. 108A through 111A are panels that can be affixed to the tubes on FIG. 106B to convert the tubes of that cube into a smooth cube.

FIG. 100A is a panel that fits onto FIG. 106B.

Figure 108A:
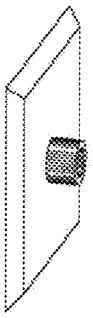
Figure 108B:
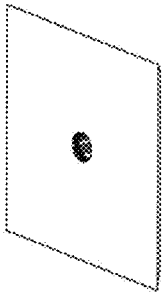

FIG. 108B is a front view of FIG. 108A.

Figure 108C:
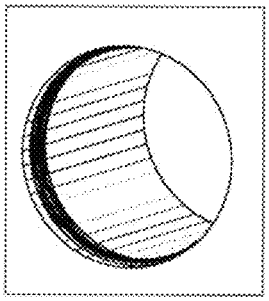

FIG. 108C is a close-up view of the hole in FIG. 108A.

Figure 109A:
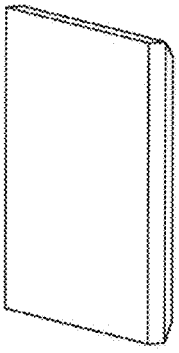
Figure 109B:
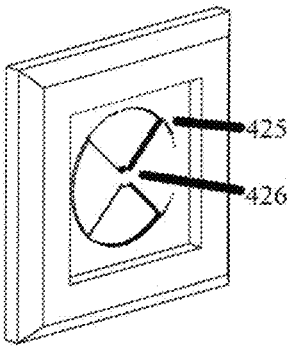

FIG. 109A is the front side of FIG. 109B.

FIG. 109B is a modular interface that fits onto each of the tube ends of FIG. 106B (the large and small ends) to form a smooth surface.

Figure 110A:
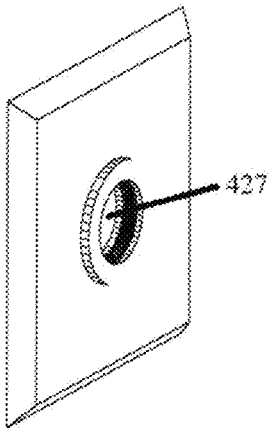

FIG. 110A is a panel with a center hole that fits onto poles in FIG. 106B.

Figure 110B:
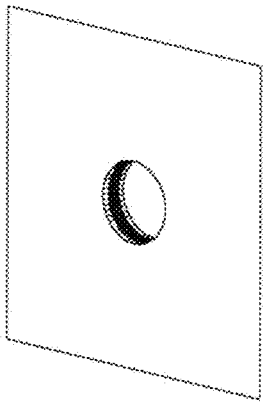

FIG. 110B is the front side of FIG. 110A.

Figure 111A:
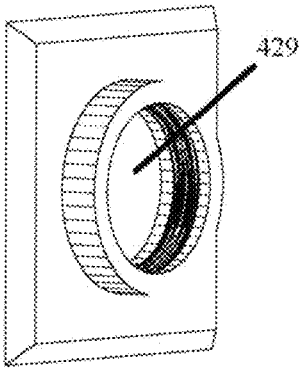

FIG. 111A is a panel with a center hole that fits onto poles in FIG. 106B.

Figure 111B:
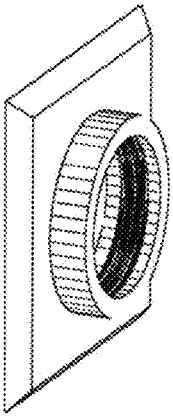

FIG. 111B is a slightly different view of FIG. 111A.

Figure 111C:
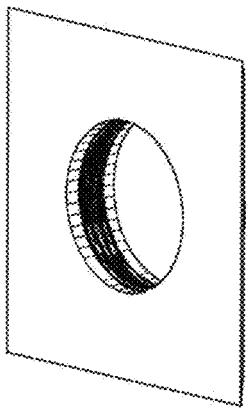

FIG. 111C is the front view of FIG. 111A.

FIG. 112A is cube with inverted space of FIG. 106B, meaning that instead of having tubes it has hollow shafts where tubes can be inserted. It can be affixed to itself and to FIG. 106B in the manner shown in FIG. 107B.

Figure 112B:
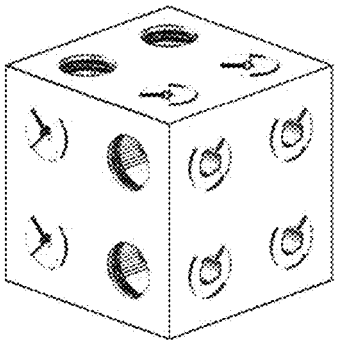

FIG. 112B is a view of FIG. 112A from a different angle.

Figure 112C:
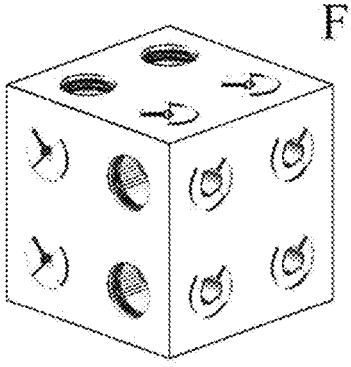

FIG. 112C is an additional example of FIG. 112A from a different view.

Figure 112D:
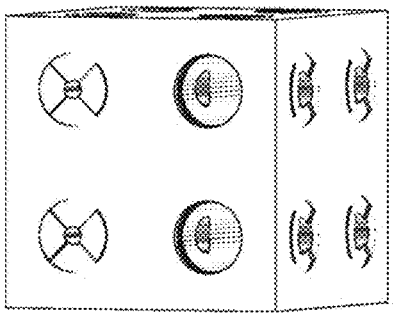

FIG. 112D is a view of FIG. 112A from a different angle.

Figure 113A:
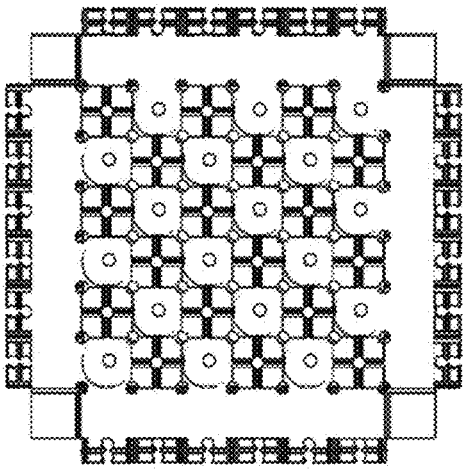
Figure 113B:
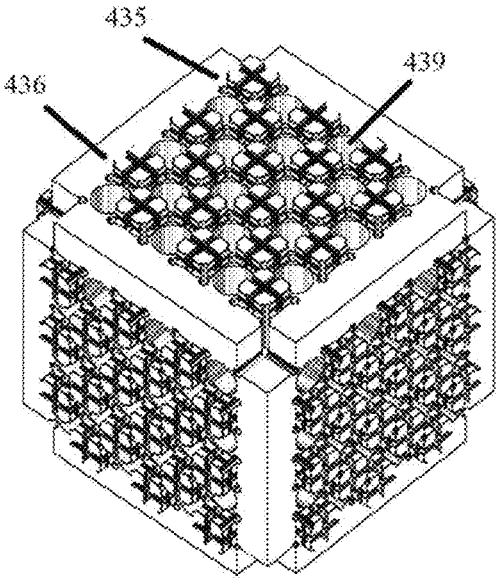

FIG. 113A is a profile view of FIG. 113B.

FIG. 113B is a cube that has square cubes on it that can be affixed to themselves in a reversible manner. Once affixed together they can be locked in place with smaller tubes in the holes shown in FIG. 135D. FIG. 113B also has larger circular shafts into which poles can be inserted to strengthen the constructions that it builds or to extend constructions into new areas or into new kinds of interfaces.

Figure 113C:
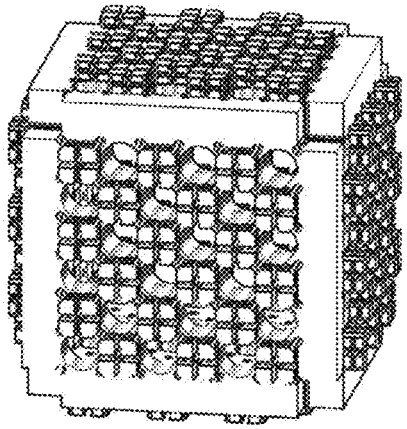

FIG. 113C is a view of FIG. 113B from a slightly different angle.

Figure 113D:
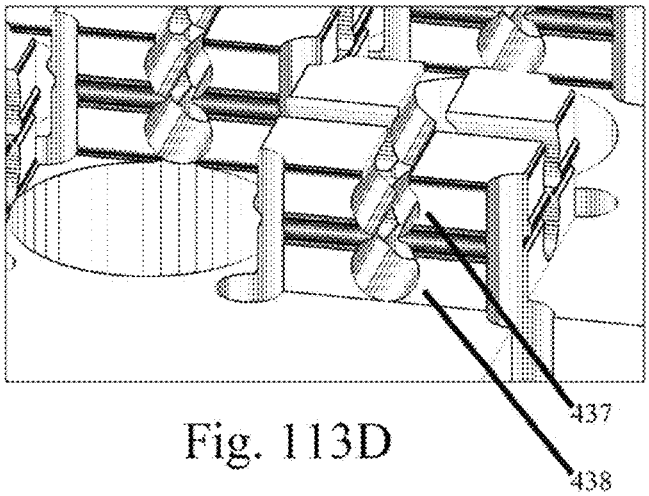

FIG. 113D is a close-up view of FIG. 1139.

Figure 114A:
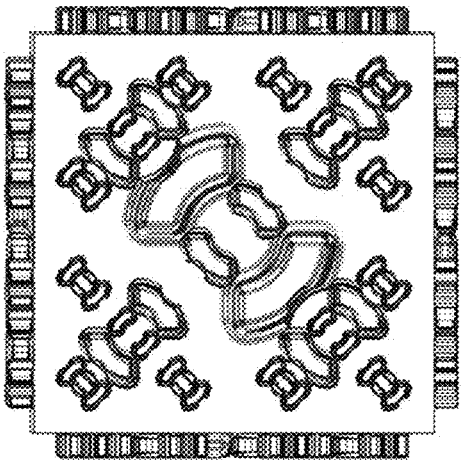
Figure 114B:
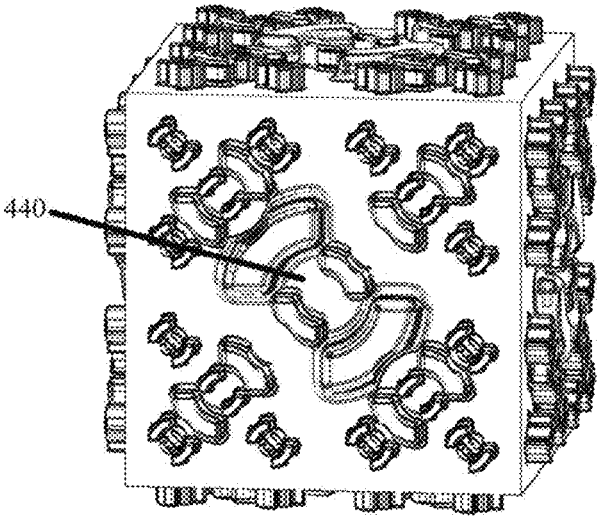

FIG. 114A is a profile view of FIG. 114B.

FIG. 114B is a cube version of FIG. 61A.

Figure 115A:
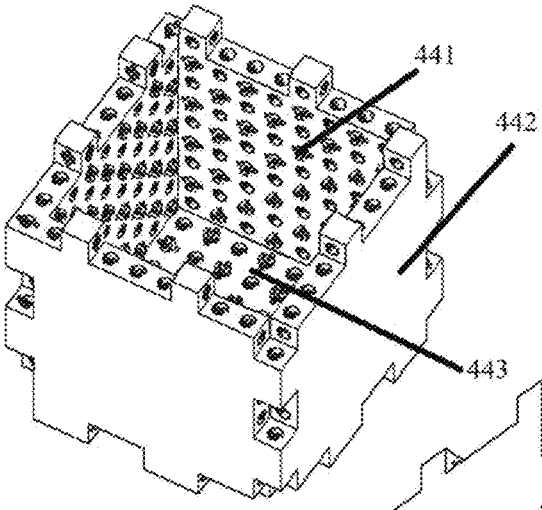

FIG. 115A is an assembled box version of the box that is built with FIG. 80A. Like the panel that is FIG. 80A, it can assemble with itself and with panels. It can also hold panels and other pieces.

Figure 115B:
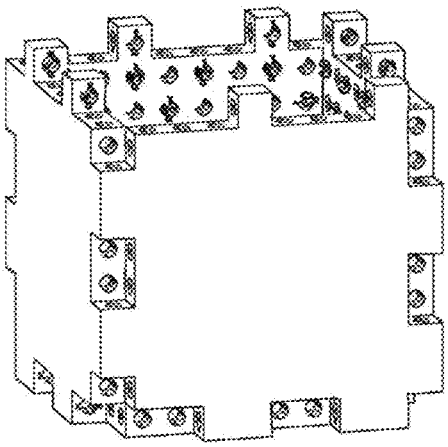

FIG. 115B is a different view of FIG. 115A.

Figure 115C:
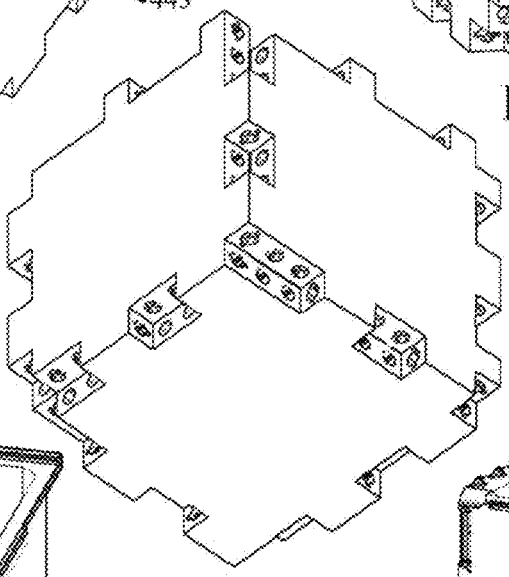

FIG. 115C is a view from the bottom of FIG. 115A.

Figure 116:
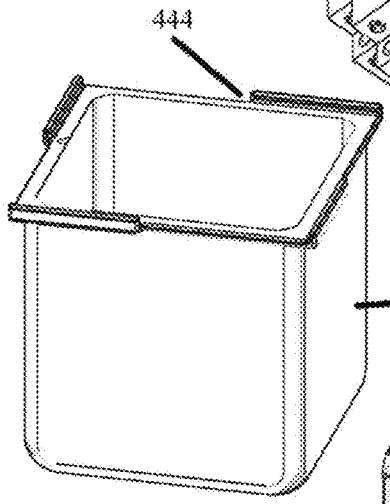
Figure 118:
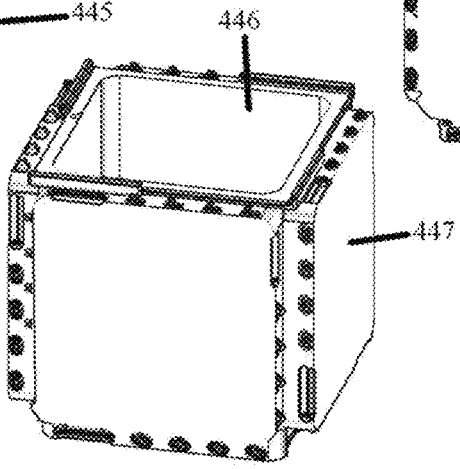

FIG. 116 is a box version of the panel at FIG. 52D that can hold other panels and can serve as a smooth lining of other boxes in the manner shown in FIG. 118.

Figure 117A:
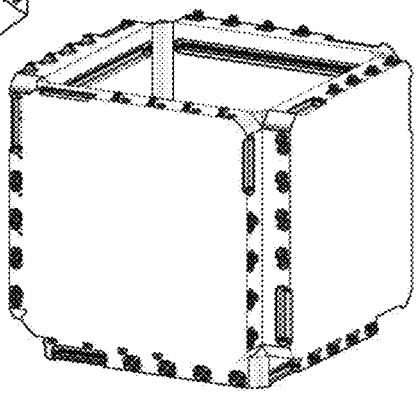

FIG. 117A is a box version of the panel at FIG. 74C.

Figure 117B:
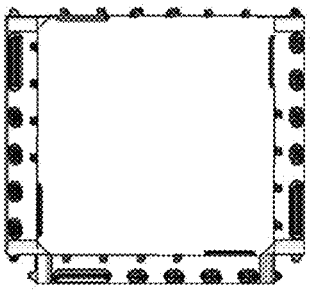

FIG. 117B is a profile view of FIG. 117A.

FIG. 118 shows how FIG. 116 fits into FIG. 117A.

DETAILED DESCRIPTION OF THE INVENTION

The guiding principle of the panels is that they are in the smallest configuration necessary for them to form larger panels and cubes. The panels can be extended to cover much larger surfaces and to cover different kinds of surface areas, like rectangle surfaces.

The knob, hole, snap, magnet and other interfaces can be doubled up many times (so that a screw interface is also a female knob interface, for example) and as the dimensions of the pieces get increased, more interfaces can be placed on the pieces. The pieces shown are therefore simple modular forms that can be enlarged, reduced in size, have their interfaces changed or doubled up. They are highly versatile building block shapes that serve to enhance and enable core block, building and object design. The pieces themselves are not the final embodiment of the pieces. Like an alphabet, they are designed to be altered with larger and smaller sizes and with alterations to their makeup (like a font that has bold added, or that is italicized or underlined, for example).

The panels, blocks and poles that are in the drawings, along with their features, are all modular in that they can be assembled together, with each other, their features can be exchanged, enlarged and combined to form all manner of objects, panels, buildings and other useful constructions.

Figure 1A:
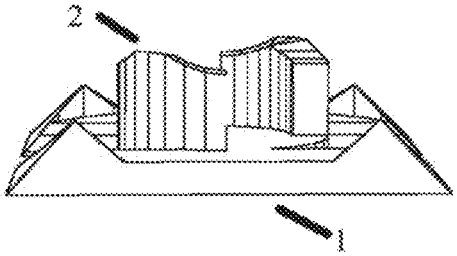
FIG. 1A is a panel side with a reversible knob in the middle that can assemble into itself to form a coaster in the manner shown in FIG. 4C. It also assembles in the manner shown in FIGS. 4A and 4B.
Figure 4A:
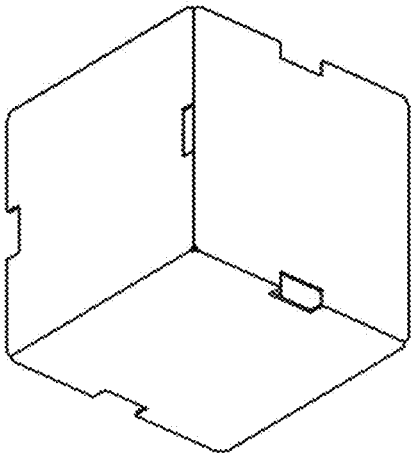
FIG. 4A is a different views of how FIG. 3A can be assembled. Cylindrical pieces with holes the size of the reversible knobs on the side panels can go in the middle of the constructions at FIG. 4A and FIG. 4B to stabilize them into more solid cubes.
Figure 4B:
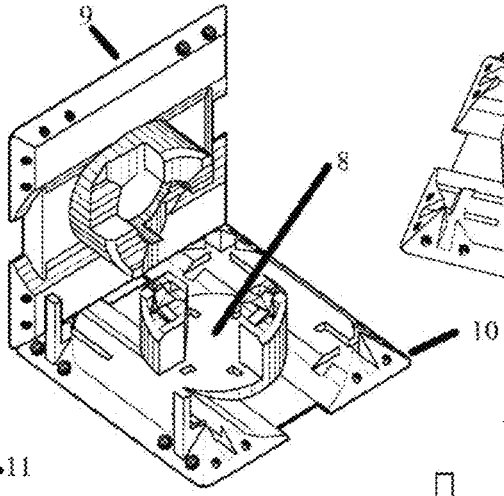
FIG. 4B is a view of FIG. 2A and FIG. 3A assembled together.
Figure 4C:
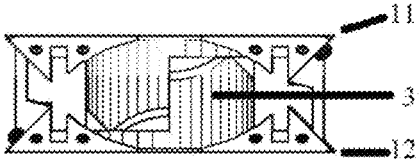
FIG. 4C is a profile view of two FIG. 3A pieces fitted together.

FIG. 1A is a panel side (1) with a reversible knob in the middle (2) that can assemble into itself to form a coaster in the manner shown in FIG. 4C (3). It also assembles in the manner shown in FIGS. 4A and 4B.

Figure 1B:
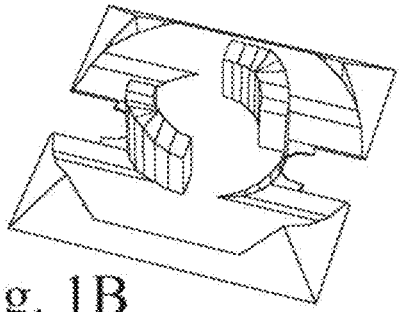
FIG. 1B is a top corner view of FIG. 1A.

FIG. 1B is a top corner view of FIG. 1A.

Figure 2A:
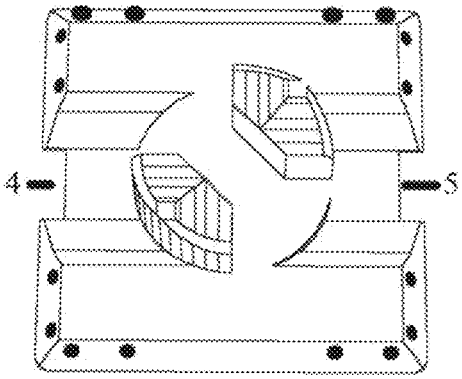
FIG. 2A is a panel that functions like FIG. 1A except its panel's indentations on the sides are smaller.

FIG. 2A is a panel that functions like FIG. 1A except its panel's indentations on the sides are smaller (4, 5).

Figure 2B:
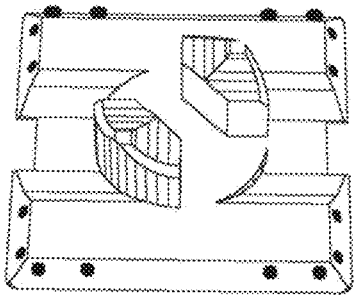
FIG. 2B is another view of FIG. 2A except it is more from the side.

FIG. 2B is another view of FIG. 2A except it is more from the side.

Figure 2C:
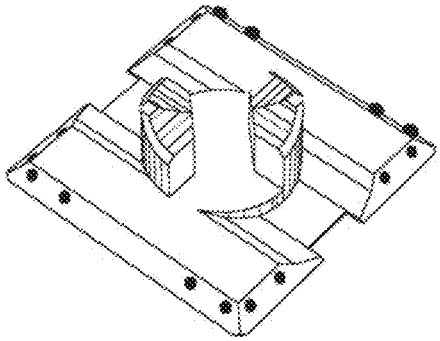
FIG. 2C is a view of FIG. 2A from a top corner perspective.

FIG. 2C is a view of FIG. 2A from a top corner perspective.

Figure 2D:
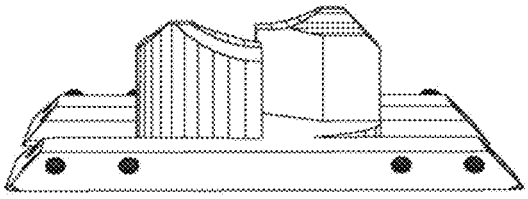
FIG. 2D is a view of the side of FIG. 2A.

FIG. 2D is a view of the side of FIG. 2A.

Figure 2E:
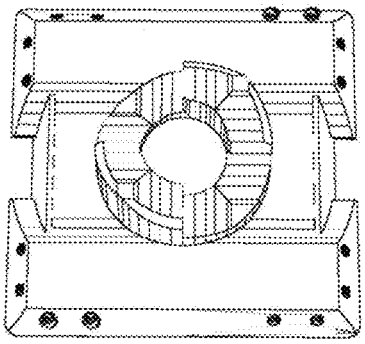
FIG. 2E is a view of FIG. 2A from a slightly different perspective.

FIG. 2E is a view of FIG. 2A from a slightly different perspective.

Figure 2F:
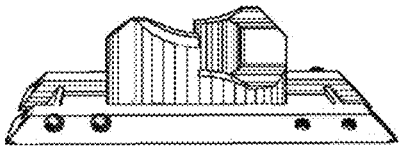
FIG. 2F is another view of FIG. 2A from the side.

FIG. 2F is another view of FIG. 2A from the side.

Figure 2G:
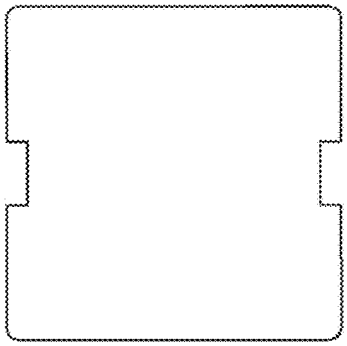
FIG. 2G is a view from the bottom of FIG. 2A.

FIG. 2G is a view from the bottom of FIG. 2A.

Figure 2H:
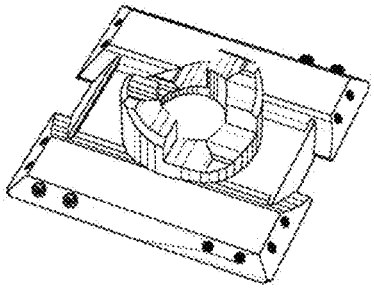
FIG. 2H is a top corner view of FIG. 2A.

FIG. 2H is a top corner view of FIG. 2A.

Figure 3A:
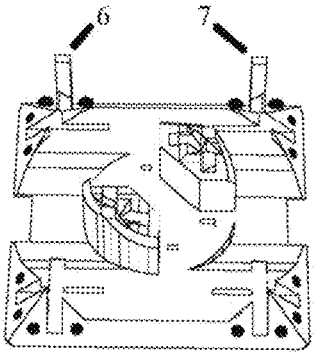
FIG. 3A is similar to FIG. 2A except it has reinforcement sticks that help it assemble in the manner shown in FIG. 4B and that stabilize it when assembled into a coaster in the manner shown in FIG. 4C.

FIG. 3A is similar to FIG. 2A except it has reinforcement sticks (6, 7) that help it assemble in the manner shown in FIG. 4B and that stabilize it when assembled into a coaster in the manner shown in FIG. 4C where the center knobs snap together (3).

Figure 3B:
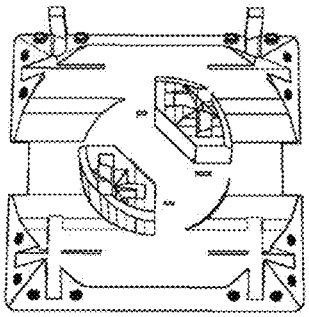
FIG. 3B is another view of FIG. 3A from a slightly different angle.

FIG. 3B is another view of FIG. 3A from a slightly different angle.

Figure 3C:
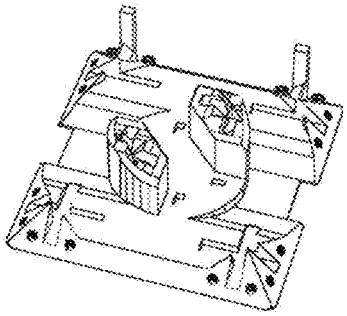
FIG. 3C is a view from a top corner of FIG. 3A.

FIG. 3C is a view from a top corner of FIG. 3A.

Figure 3D:
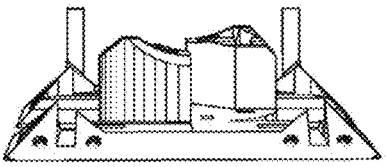
FIG. 3D is a view from the side of FIG. 3A.

FIG. 3D is a view from the side of FIG. 3A.

FIG. 4A is different views of how FIG. 3A can be assembled. Cylindrical pieces with holes the size of the reversible knobs on the side panels can go in the middle of the constructions at FIGS. 4A and 4B (8) to stabilize them into more solid cubes.

FIG. 4B is a view of FIG. 2A (9) and FIG. 3A (10) assembled together.

FIG. 4C is a profile view of two FIG. 3A (11, 12) pieces fitted together.

Figure 4D:
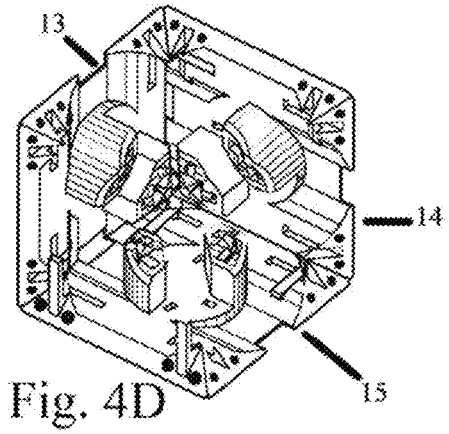
FIG. 4D is an example of how shapes that are FIG. 4A assemble to form a corner.

FIG. 4D is an example of how shapes that are FIG. 4A (13, 14, 15) assemble to form a corner.

Figure 4E:
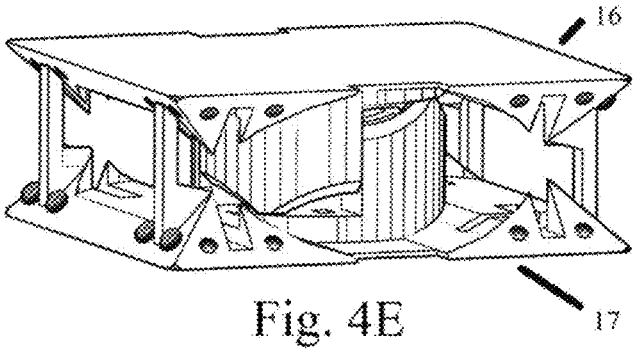
FIG. 4E is a view from a top corner of the assembled pieces in FIG. 4C.

FIG. 4E is a view from a top corner of the assembled pieces (16, 17) in FIG. 4C.

Figure 5A:
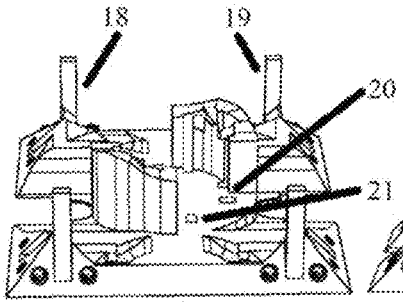
FIG. 5A is like FIG. 1A except it has the reinforcing sticks that enable it to make stronger cubes or panels. It also has holes in it that allow the sticks to be inserted a number of ways to enable the panel to make larger panels. The indented sides on the left and right of FIG. 5D are where a cylindrical shape's outer cylindrical part can reach the edge of a cube formed with the panels.

FIG. 5A is like FIG. 1A except it has the reinforcing sticks (18, 19) that enable it to make stronger cubes or panels. It also has holes (20, 21) in it that allow the sticks to be inserted a number of ways to enable the panel to make larger panels. The indented sides on the left (22) and right (23) of FIG. 5D are where a cylindrical shape's outer cylindrical part can reach the edge of a cube formed with the panels.

Figure 5B:
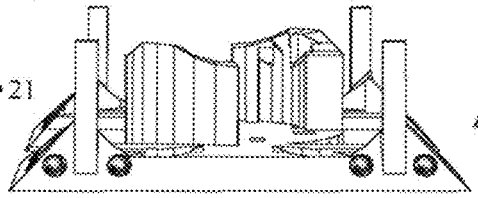
FIG. 5B is a side view of FIG. 5A.

FIG. 5B is a side view of FIG. 5A.

Figure 5C:
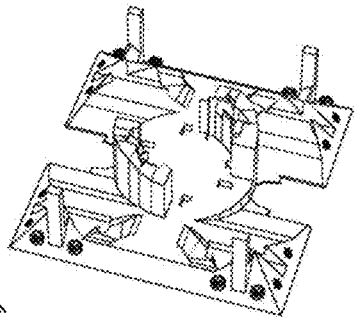
FIG. 5C is a view from a top corner of FIG. 5A.

FIG. 5C is a view from a top corner of FIG. 5A.

Figure 5D:
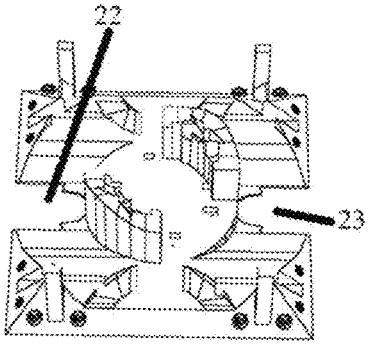
FIG. 5D is a top side view of FIG. 5A.

FIG. 5D is a top side view of FIG. 5A.

Figure 5E:
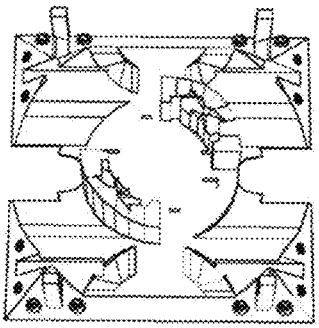
FIG. 5E is a view from the top of FIG. 5A.

FIG. 5E is a view from the top of FIG. 5A.

Figure 6:
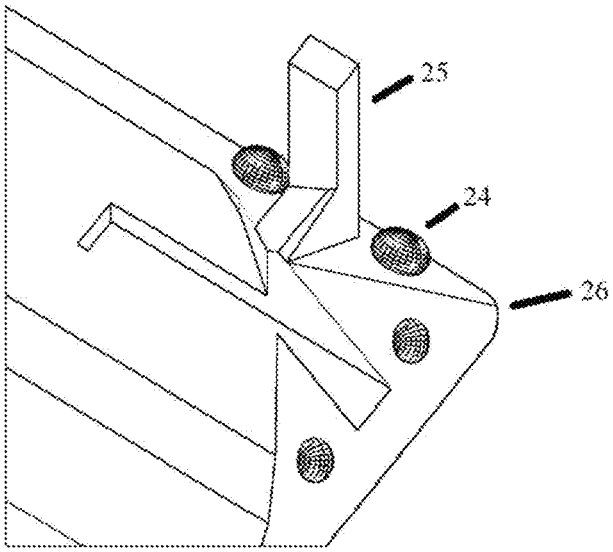
FIG. 6 is a close-up view of the snaps and stick, both male and female, at the corners of these pieces.
Figure 3E:
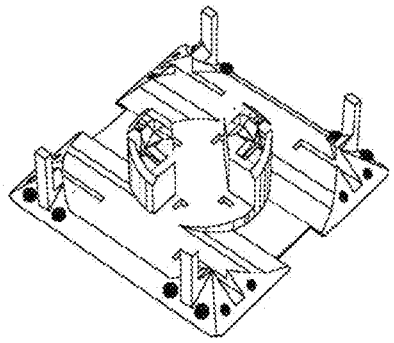
FIG. 3E is a view from a top corner angle of FIG. 5A that shows the diagonal view of FIG. 5A from one corner to ther other.

FIG. 6 is a close-up view of the snaps (24) and stick (25), both male and female, at the corners (26) of these pieces.

Figure 7B:
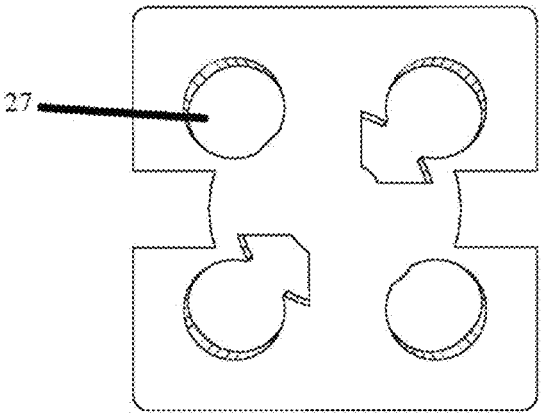
FIG. 7A is similar to the prior pieces except it also has four large holes that can provide ventilation, be female interfaces for knobs, can be insertion points for shafts, or can be receptacles of disc magnets that, when arranged properly with opposing positive and negative charges, allow the panels to form cubes that attract to build walls and additional useful things.
FIG. 7C is a view from a top corner of FIG. 7A.
FIG. 7D is a view from a top side of FIG. 7A.
Figure 7A:
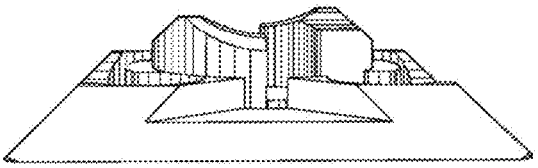

FIG. 7A is similar to the prior pieces except it also has four large holes that can provide ventilation, be female interfaces for knobs, can be insertion points for shafts, or can be receptacles of disc magnets that, when arranged properly with opposing positive and negative charges, allow the panels to form cubes that attract to build walls and additional useful things.

FIG. 7B is a profile view from the bottom of FIG. 7A in which the large holes (27) are visible.

Figure 7C:
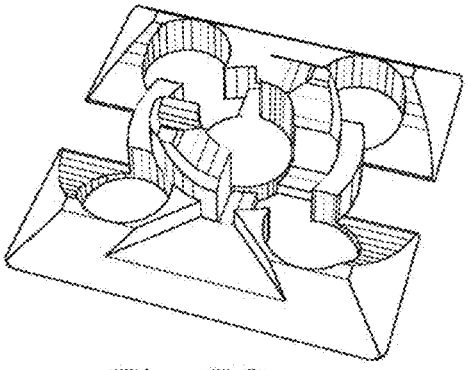

FIG. 7C is a view from a top corner of FIG. 7A.

Figure 7D:
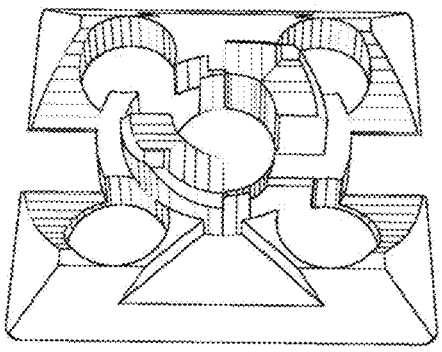

FIG. 7D is a view from a top side of FIG. 7A.

Figure 8A:
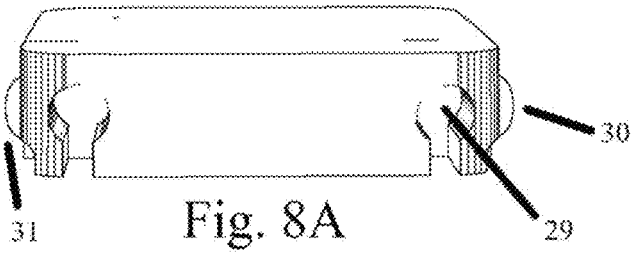
FIG. 8A is a panel that can be inserted into a casing as shown in FIG. 9A. Once inserted into that casing it can be locked in place with spheres or poles inserted into the shafts on the ends of FIG. 8A. The bumps on the ends of FIG. 8A that are visible on the front of FIG. 8C snap into the holes on FIG. 9A.
Figure 8C:
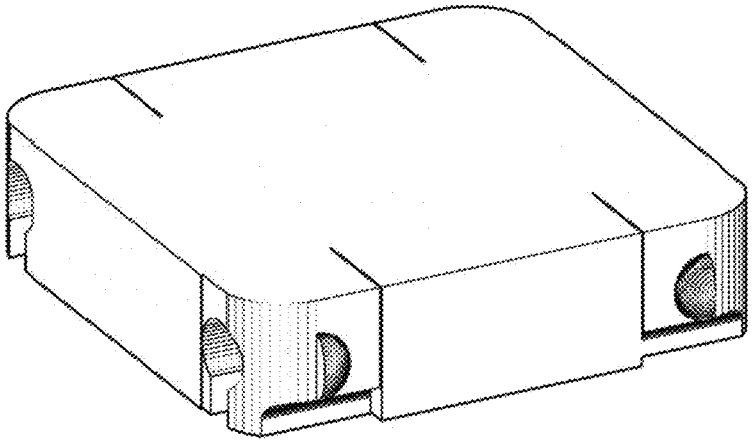
Figure 9A:
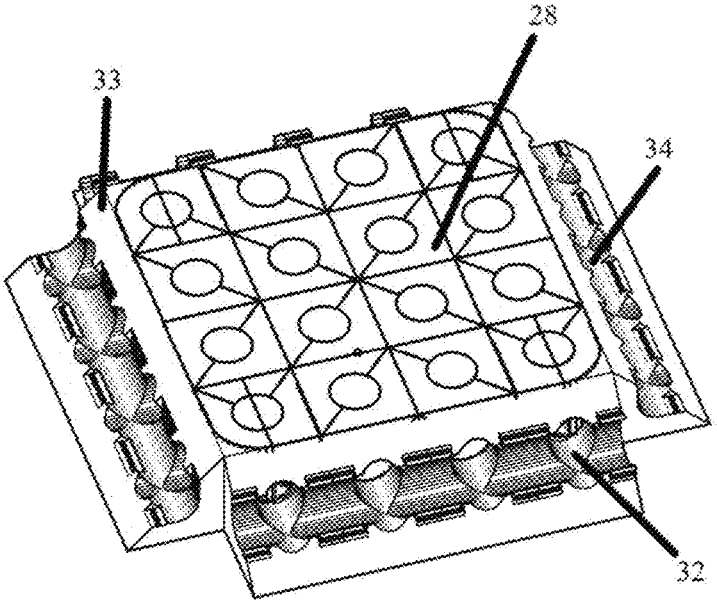
FIG. 9A is different views of FIG. 8A inserted into FIG. 10A to form a coaster that can assemble into panels and cubes with interfaces on its edges.

FIG. 8A is a panel that can be inserted into a casing as shown in FIG. 9A (28). Once inserted into that casing it can be locked in place with spheres or poles inserted into the shafts on the ends of FIG. 8A (29). The bumps on the ends of FIG. 8A (30, 31) that are visible on the front of FIG. 8C snap into the holes on FIG. 9A (32).

Figure 8B:
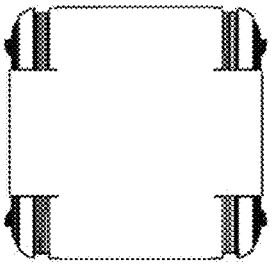
FIG. 8C is a top corner view of FIG. 8A.
FIG. 8D is a top corner view of FIG. 8A from a slightly different angle.
FIG. 8E is a top view of FIG. 8A

FIG. 8B is a top profile view of FIG. 9A.

FIG. 8C is a top corner view of FIG. 8A.

Figure 8D:
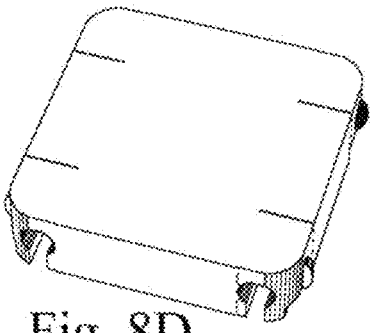

FIG. 8D is a top corner view of FIG. 8A from a slightly different angle.

Figure 8E:
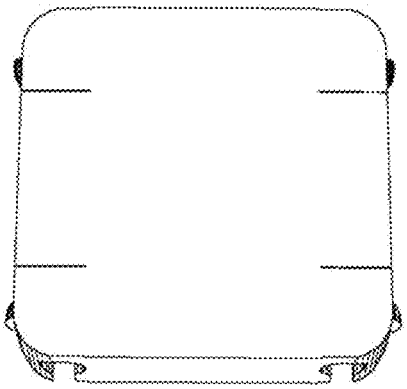

FIG. 8E is a top view of FIG. 8A

Figure 10A:
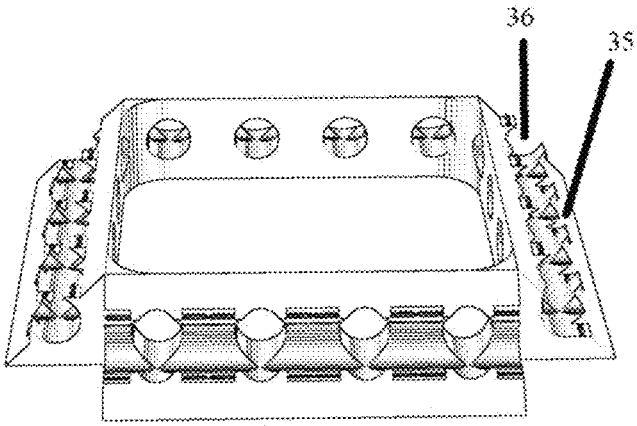
FIG. 10A is an object that can be assembled on its edges into panels and cubes. Those panels and cubes are locked and reinforced with spheres and poles inserted into the shafts created on the edges of assembled objects.

FIG. 9A is different view of FIG. 8A (28) inserted into FIG. 10A (33) to form a coaster that can assemble into panels and cubes with interfaces on its edges (34).

FIG. 98 is a view of FIG. 9A from the bottom.

Figure 9B:
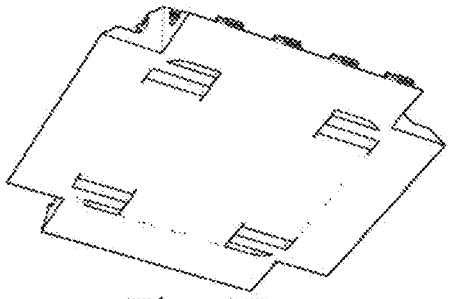
FIG. 9C is a profile view of FIG. 9A from the bottom.
FIG. 9D is a view from the side of FIG. 9A.
Figure 9C:
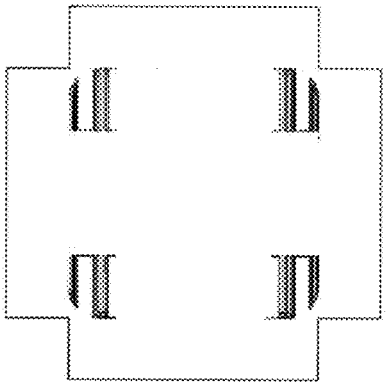

FIG. 9C is a profile view of FIG. 9A from the bottom.

Figure 9D:
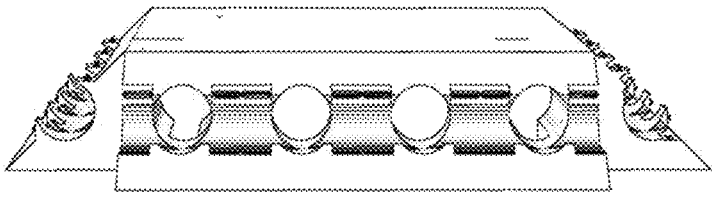

FIG. 9D is a view from the side of FIG. 9A.

FIG. 10A is an object that can be assembled on its edges (35) into panels and cubes.

Those panels and cubes are locked and reinforced with spheres and poles inserted into the shafts created on the edges (36) of assembled objects.

Figure 10B:
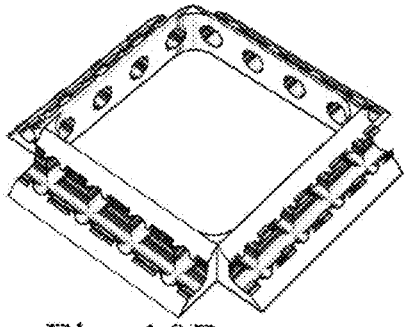
FIG. 10B is a view from a top corner of FIG. 10A.

FIG. 10B is a view from a top corner of FIG. 10A.

Figure 11A:
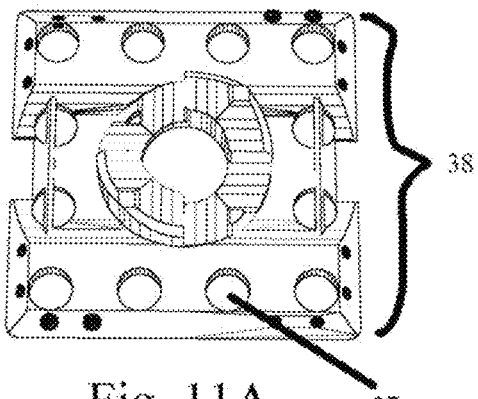
FIG. 11A is similar to FIG. 7A except the holes are smaller relative to the size of the panel.

FIG. 11A is similar to FIG. 7A except the holes (37) are smaller relative to the size of the panel (38).

Figure 11B:
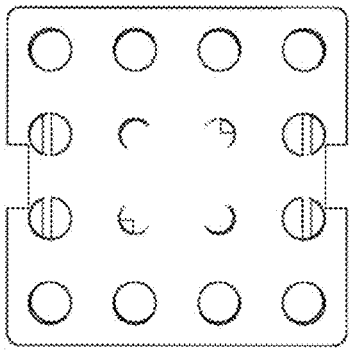
FIG. 11B is a profile view of FIG. 11A from the bottom.

FIG. 11B is a profile view of FIG. 11A from the bottom.

Figure 11C:
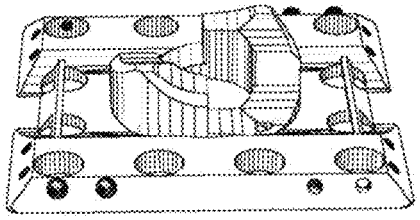
FIG. 11C is a view of FIG. 11A from the top side.

FIG. 11C is a view of FIG. 11A from the top side.

Figure 11D:
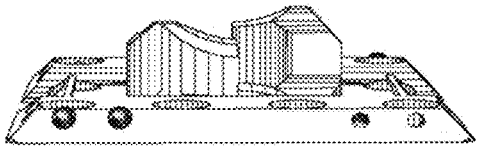
FIG. 11D is a view of FIG. 11A from the side.

FIG. 11D is a view of FIG. 11A from the side.

Figure 11E:
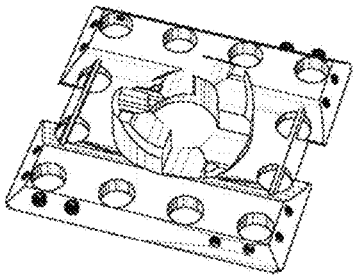
FIG. 11E is a view from a top corner of FIG. 11A.

FIG. 11E is a view from a top corner of FIG. 11A.

Figure 11F:
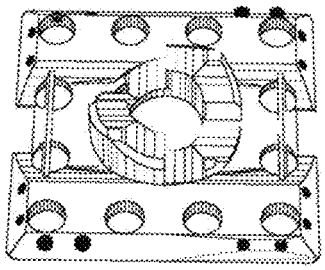
FIG. 11F is a view from the top side of FIG. 11A but at more of an angle.

FIG. 11F is a view from the top side of FIG. 11A but at more of an angle.

FIG. 12A is a panel comprised of male (39) and female (40) knob interfaces. The panel's male interfaces (39) insert into the female interfaces (40) and the male interfaces insert into the empty places on the male surface (41). This panel can insert into itself to form columns, floor surfaces and walls (when assembled in a staggered manner).

Figure 12B:
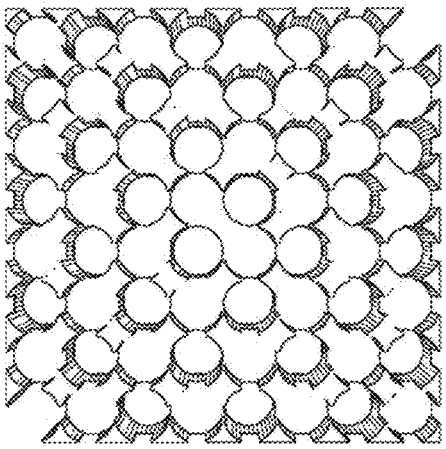
FIG. 12B is a profile view from the bottom of FIG. 12A.

FIG. 12B is a profile view from the bottom of FIG. 12A.

Figure 12C:
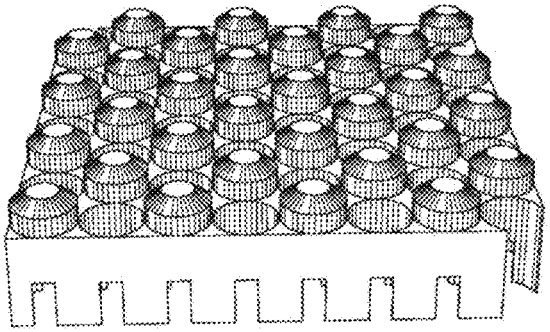
FIG. 12C is a view from a top side of FIG. 12A.

FIG. 12C is a view from a top side of FIG. 12A.

Figure 12D:
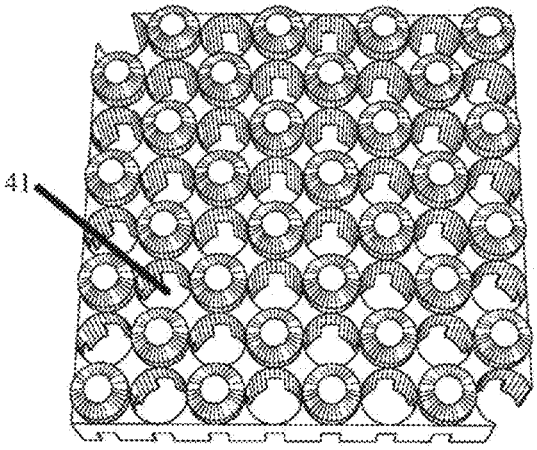
FIG. 12D is a view from the top of FIG. 12A.

FIG. 12D is a view from the top of FIG. 12A that shows the empty places on the male surface (41).

Figure 12E:
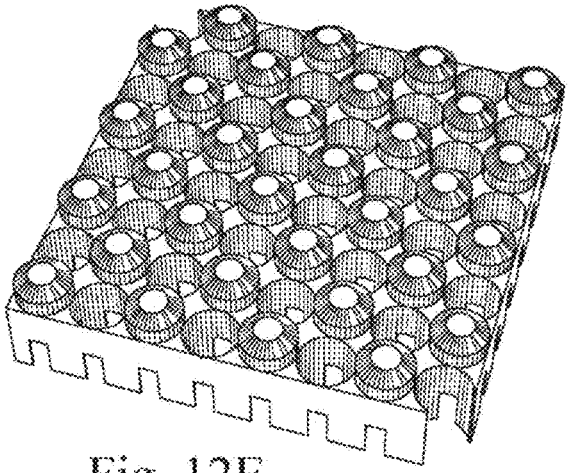
FIG. 12E is a view from a top corner of FIG. 12A.

FIG. 12E is a view from a top corner of FIG. 12A.

Figure 13A:
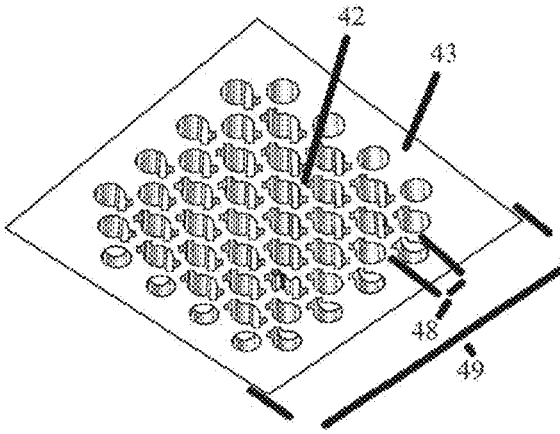
FIG. 13A is a combination of FIG. 12A and FIG. 10A. When the smooth sides of FIG. 13A are magnetized in positive and negative ways that correlate to the protruding and receding parts of FIG. 10A, then it can assemble into panels and cubes in the manner that FIG. 10A can be assembled.

FIG. 13A is a combination of FIG. 12A (42) and FIG. 10A (43). When the smooth sides of FIG. 13A are magnetized in positive and negative ways that correlate to the protruding and receding parts of FIG. 10A, then it can assemble into panels and cubes in the manner that FIG. 10A can be assembled.

Figure 13B:
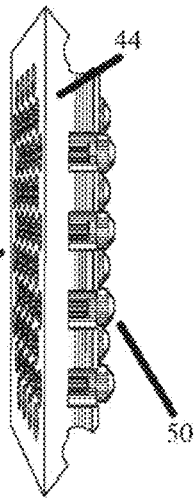
FIG. 13B is a side view of FIG. 13A.

FIG. 13B is a side view of FIG. 13A that shows the smooth (44) sides that are magnetized in positive and negative ways that correlate to the protruding and receding parts of FIG. 10A so that it can assemble into panels and cubes in the manner that FIG. 10A can be assembled.

Figure 13C:
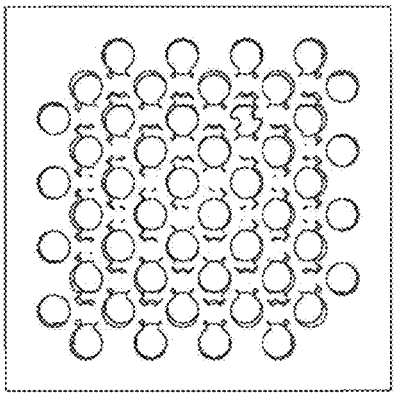
FIG. 13C is a view from the bottom of FIG. 13A.

FIG. 13C is a view from the bottom of FIG. 13A.

Figure 13D:
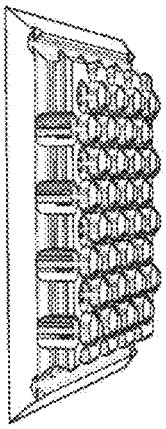
FIG. 13D is a view from the top side of FIG. 13A.

FIG. 13D is a view from the top side of FIG. 13A.

Figure 13E:
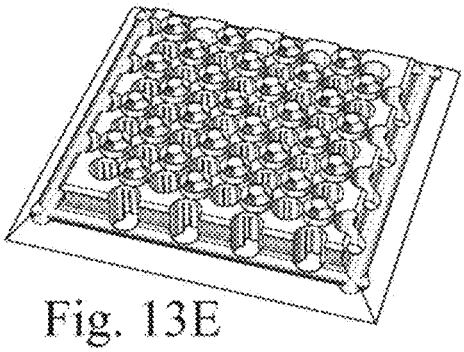
FIG. 13E is a view from a top corner of FIG. 13A.

FIG. 13E is a view from a top corner of FIG. 13A.

Figure 13F:
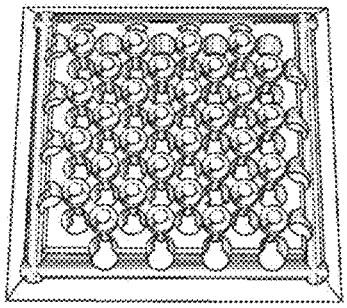
FIG. 13F is a view from a top side of FIG. 13F.

FIG. 13F is a view from a top side of FIG. 13F.

Figure 14A:
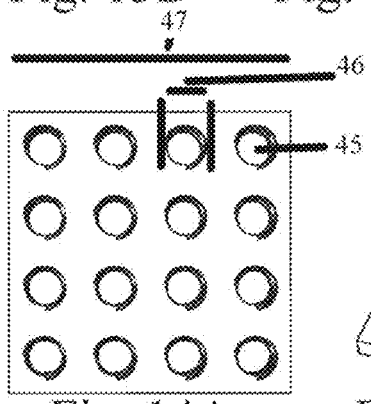
FIG. 14A is a panel with screw interfaces that also has holes of the same relative sizes as the other pieces. The holes in FIG. 14A are one eighth the size of the size of the total panel. The holes in FIG. 13A are one twelfth the size of the panel. What this means is that all these panels can either fit into each other or can be easily adapted to fit into each other. For example, when select male knobs in FIG. 13A are extended, they will protrude enough for FIG. 14A to be affixed to the top of FIG. 13A. The absolute size of the pieces is mostly not a factor because the innovative system is designed for a wide range of sized encompassing the full range of sires that are usable to humans.

FIG. 14A is a panel with screw interfaces (45) that also has holes of the same relative sizes as the other pieces. The holes in FIG. 14A are one eighth the size (46) of the size of the total panel (47). The holes in FIG. 13A (48) are one twelfth the size of the panel 49). What this means is that all these panels can either fit into each other or can be easily adapted to fit into each other. For example, when select male knobs in FIG. 13B (50) are extended, they will protrude enough for FIG. 14A to be affixed to the top of FIG. 13B. The absolute size of the pieces is mostly not a factor because the innovative system is designed for a wide range of sizes encompassing the full range of sizes that are usable to humans.

Figure 14B:
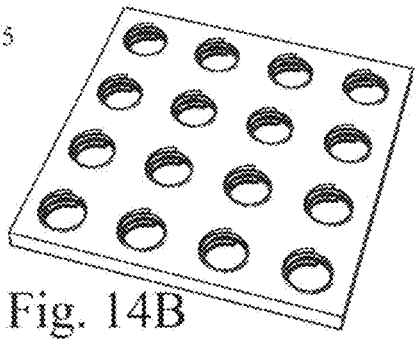
FIG. 14B is a view from a top corner of FIG. 14A.

FIG. 14B is a view from a top corner of FIG. 14A.

Figure 14C:
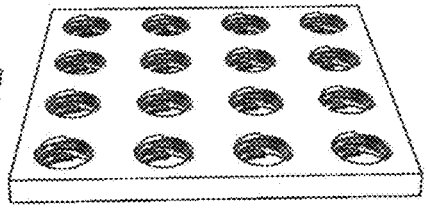
FIG. 14C is a view from a top side of FIG. 14A.

FIG. 14C is a view from a top side of FIG. 14A.

Figure 14D:
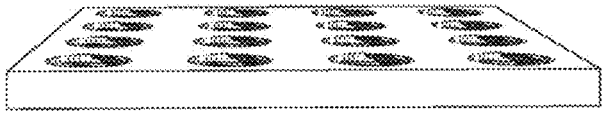
FIG. 14D is a view from the side of FIG. 14A.

FIG. 14D is a view from the side of FIG. 14A.

FIG. 15A is a coaster panel that has male (51) and female (52) knob interfaces on one side and that is smooth on the other side (53). The male and female knob interfaces can fit into themselves. It can also be assembled into panels and cubes by using the block pattern on its edges (54).

Figure 15B:
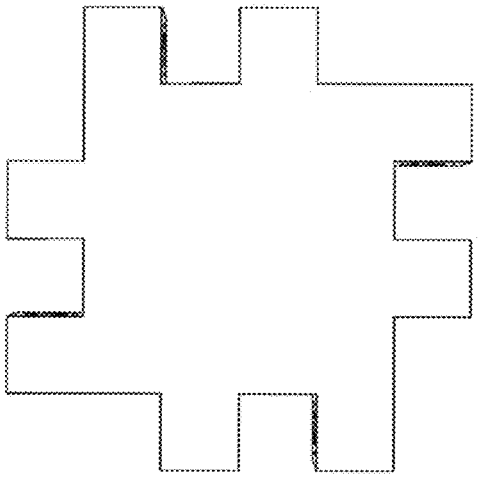
FIG. 15B is a profile view of the flat bottom side of FIG. 15A.

FIG. 15B is a profile view of the flat bottom side of FIG. 15A.

Figure 15C:
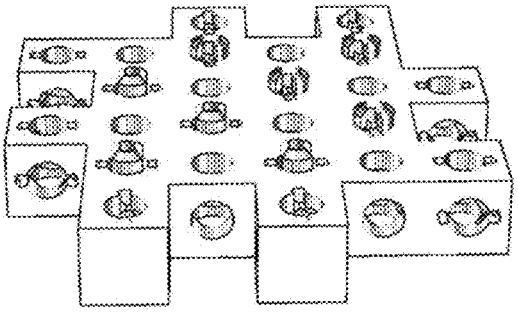
FIG. 15C is a top side view of FIG. 15A.

FIG. 15C is a top side view of FIG. 15A.

Figure 15D:
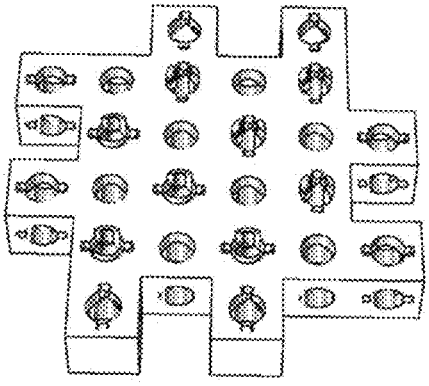
FIG. 15D is a top view of FIG. 15A.

FIG. 15D is a top view of FIG. 15A.

Figure 15E:
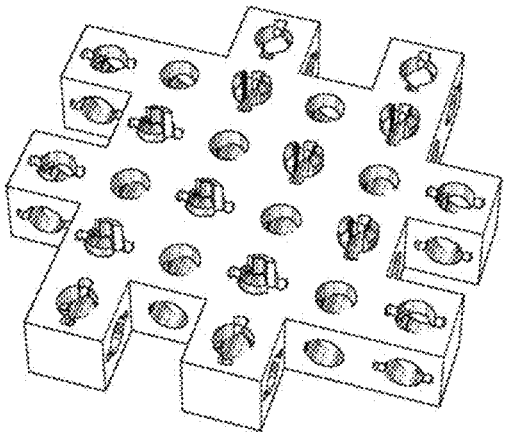
FIG. 15E is a top corner view of FIG. 15A.

FIG. 15E is a top corner view of FIG. 15A.

Figure 16A:
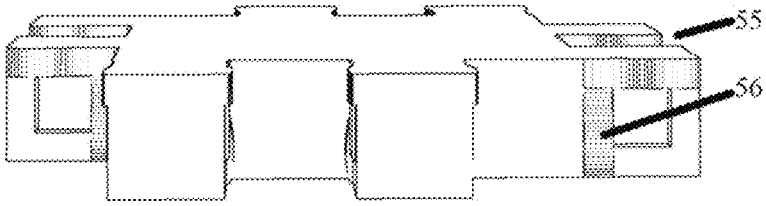
FIG. 16A is similar to FIG. 15A except its block edges can be assembled into panels or cubes with the "s" snaps on those block edges. A closeup of the "s" snaps is in FIG. 16D.

FIG. 16A is similar to FIG. 15A except its block edges (55) can be assembled into panels or cubes with the "s" snaps on those block edges (56). A closeup of the "s" snaps is in FIG. 16D (57).

Figure 16B:
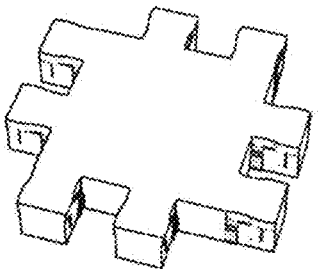
FIG. 16B is a top corner view of FIG. 16A.

FIG. 16B is a top corner view of FIG. 16A.

Figure 16C:
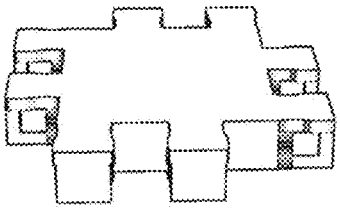
FIG. 16C is a top side view of FIG. 16A.

FIG. 16C is a top side view of FIG. 16A.

Figure 16D:
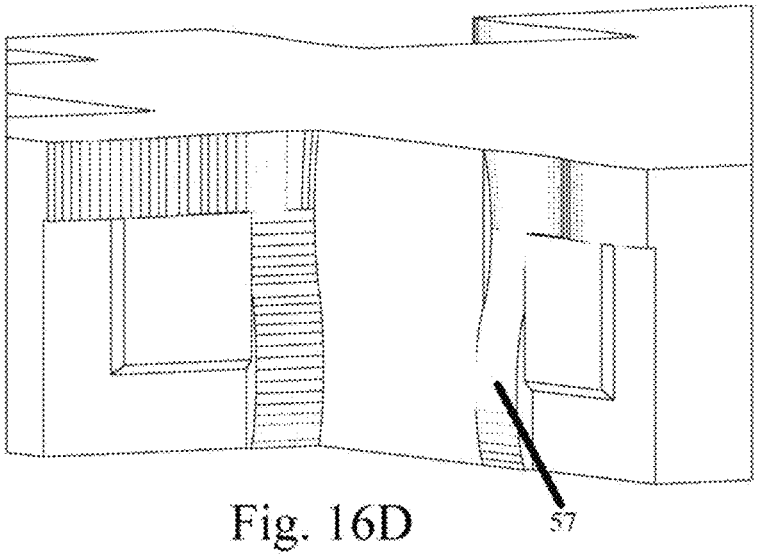
FIG. 16D is a close-up view of the "s" snaps on the side of FIG. 16A.

FIG. 16D is a close-up view of the "s" snaps on the side of FIG. 16A.

Figure 16E:
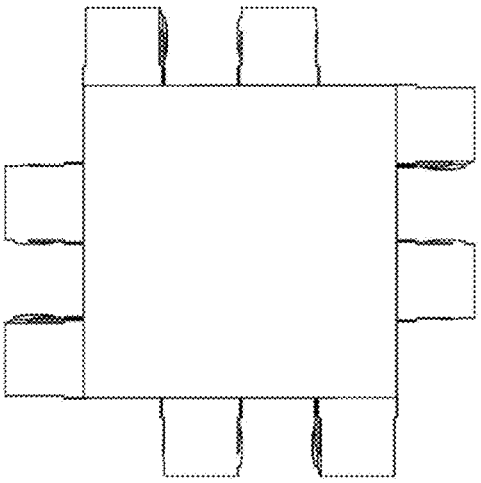
FIG. 16E is a profile view of the bottom of FIG. 16A.

FIG. 16E is a profile view of the bottom of FIG. 16A.

Figure 16F:
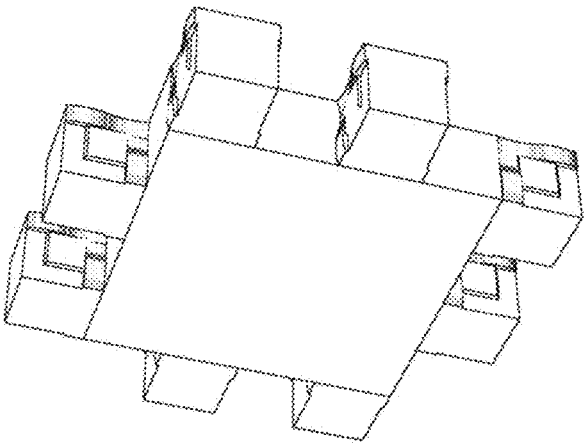
FIG. 16F is a view from a bottom corner of FIG. 16A.

FIG. 16F is a view from a bottom corner of FIG. 16A.

FIG. 17A is similar to FIG. 15A and FIG. 16A except its block edges (58) have a wavy pattern (59) that stabilizes it when the panel is assembled into a larger panel or into a cube.

FIG. 178 is a top side view of FIG. 17A.

Figure 17C:
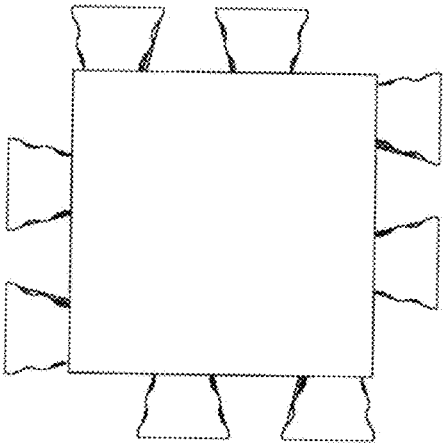
FIG. 17C is a view from the bottom of FIG. 17A.

FIG. 17C is a view from the bottom of FIG. 17A.

Figure 17D:
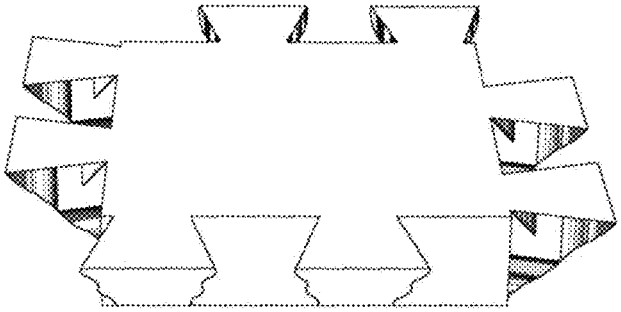
FIG. 17D is another view from a top side of FIG. 17A.

FIG. 17D is another view from a top side of FIG. 17A.

Figure 17E:
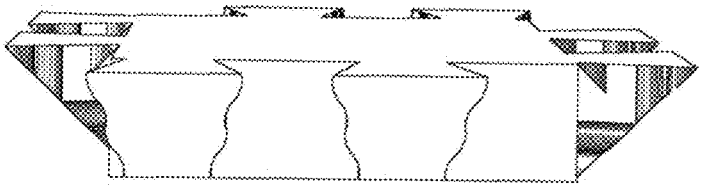
FIG. 17E is a view from the side of FIG. 17A.

FIG. 17E is a view from the side of FIG. 17A.

Figure 18A:
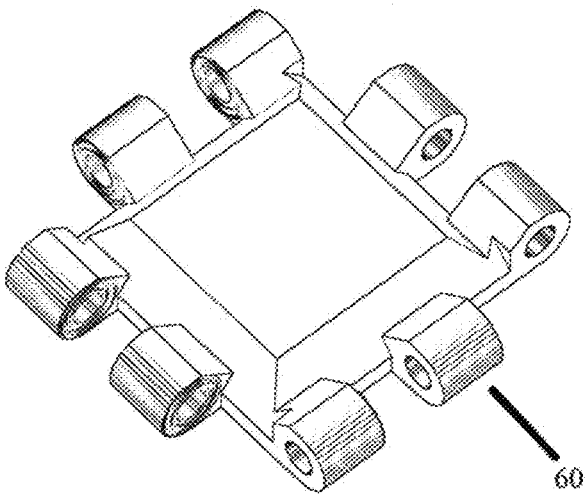
FIG. 18A is similar to FIG. 15A, FIG. 16A and FIG. 17A except it has hinges that allow it to rotate at angles beyond just 180 and 90-degree angles like the earlier FIGs. Many of these FIGs. are interchangeable or can be easily made to be interchangeable.

FIG. 18A is similar to FIG. 15A, FIG. 16A and FIG. 17A except it has hinges (60) that allow it to rotate at angles beyond just 180 and 90-degree angles like the earlier FIGs. Many of these FIGs. are interchangeable or can be easily made to be interchangeable.

Figure 18B:
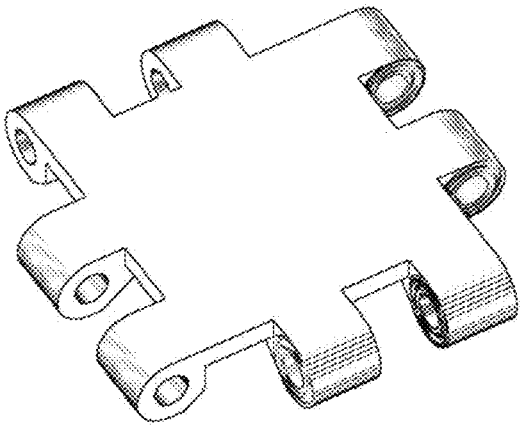
FIG. 18B is a view from a top corner of FIG. 18A.

FIG. 18B is a view from a top corner of FIG. 18A.

Figure 18C:
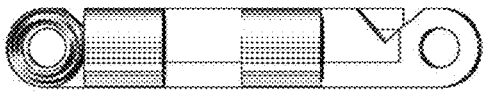
FIG. 18C is a side profile view of FIG. 18A.

FIG. 18C is a side profile view of FIG. 18A.

Figure 19A:
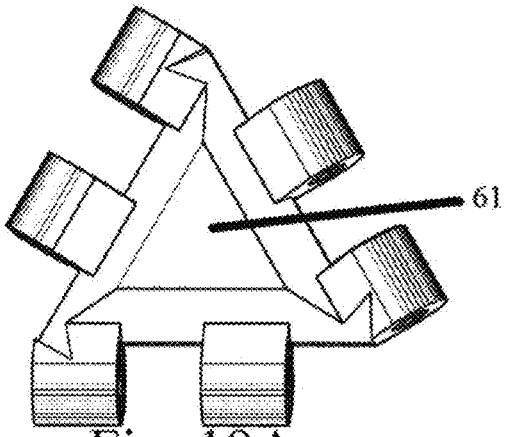
FIG. 19A is similar to FIG. 18A except it is a triangular shape. It can be assembled with the prior shapes that have the block pattern on the edges and it can be assembled into the construction in FIG. 20A.

FIG. 19A is similar to FIG. 18A except it is a triangular shape (61). It can be assembled with the prior shapes that have the block pattern on the edges and it can be assembled into the construction in FIG. 20A.

Figure 19B:
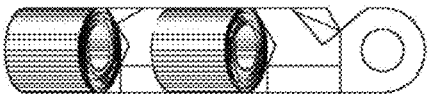

FIG. 19B is a profile view of the side of FIG. 19A.

Figure 20A:
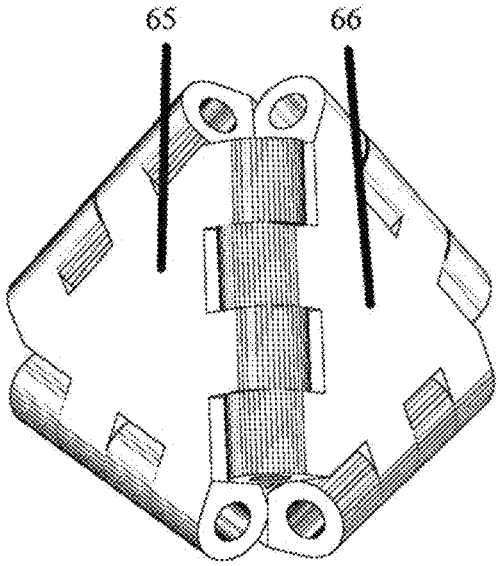
FIG. 20A is a view from a top corner of pieces in the shape of FIG. 19A assembled together.

FIG. 20A is a view from a top corner of pieces in the shape of FIG. 19A assembled together (65, 66).

Figure 20B:
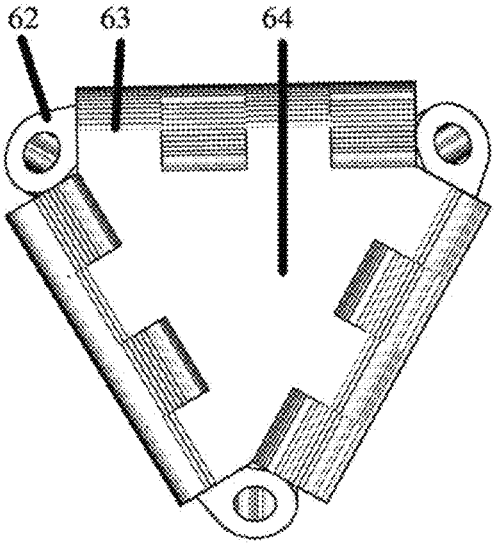

FIG. 20B is a view of the assembled pieces (62,63) shown in FIG. 20A when one of the FIG. 19A pieces (64) that make up FIG. 20A are viewed head-on.

Figure 20C:
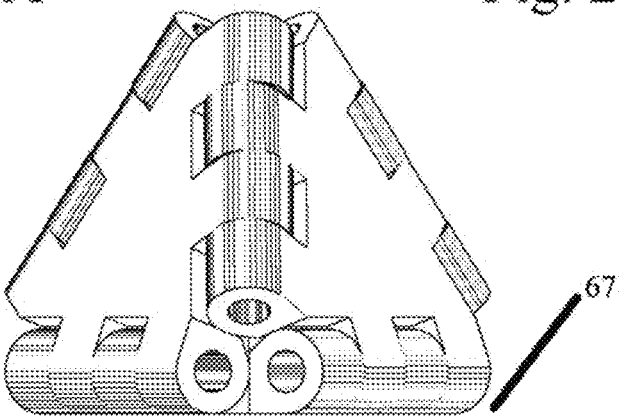
FIG. 20C is a view of a corner of FIG. 20A when

FIG. 20C is a view of a corner of FIG. 20A when FIG. 20A is resting on a flat surface (67).

Figure 21A:
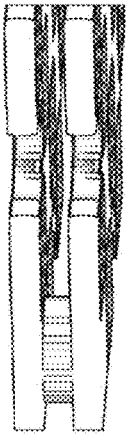
FIG. 21A is a close-up view of a corner of FIG. 21D.
Figure 21B:
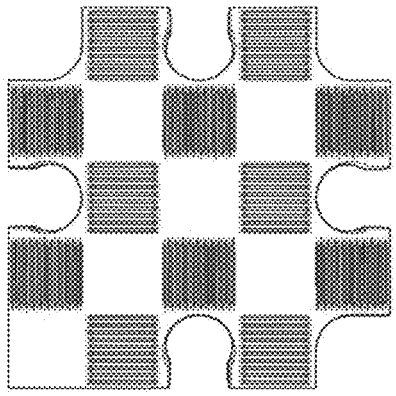
FIG. 21B is a profile view of the top of FIG. 21D.
Figure 21C:
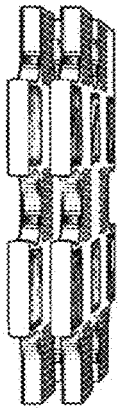
FIG. 21C is a side view of FIG. 21D.
Figure 21D:
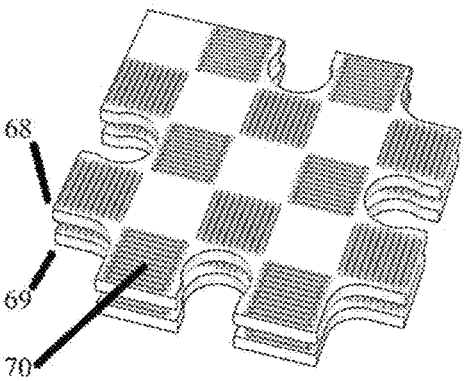
FIG. 21D is a panel with two additional panels that each have an undulating "s" shaped pattern on them with which they can snap together in the manner shown in FIG. 22A. Reinforcement poles and spheres can move through the circles that appear in FIG. 22B.

FIG. 21A is a close-up view of a corner of FIG. 21D.

FIG. 21B is a profile view of the top of FIG. 21D.

FIG. 21C is a side view of FIG. 21D.

Figure 22B:
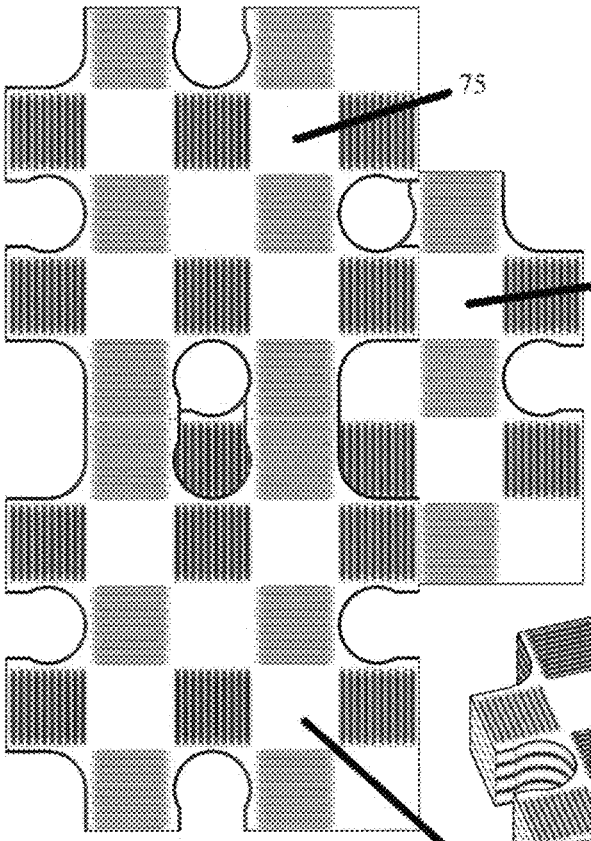
FIG. 22B is atop profile view of how multiple objects in the shape of FIG. 21D assemble into a floor.
Figure 22A:
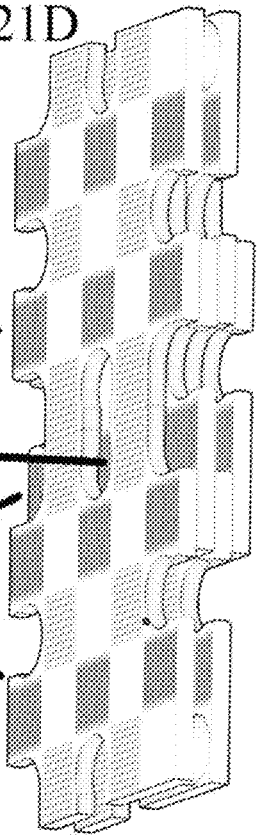
FIG. 22A is a demonstration of how multiple objects in the shape of FIG. 21D assemble into a flat wall surface.

FIG. 21D is a panel with two additional panels (68, 69) that each have an undulating "s" shaped pattern on them (70) with which they can snap together (71) in the manner shown in FIG. 22A. Reinforcement poles and spheres can move through the circles that appear in FIG. 22B.

Figure 21E:
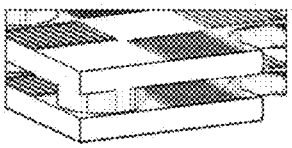
FIG. 21E is a close-up view of a corner of FIG. 21D.

FIG. 21E is a close-up view of a corner of FIG. 21D.

FIG. 22A is a demonstration of how multiple objects in the shape of FIG. 21D (72, 73, 74) assemble into a flat wall surface.

FIG. 22B is a top profile view of how multiple objects in the shape of FIG. 21D (75, 76, 77) assemble into a floor.

Figure 22C:
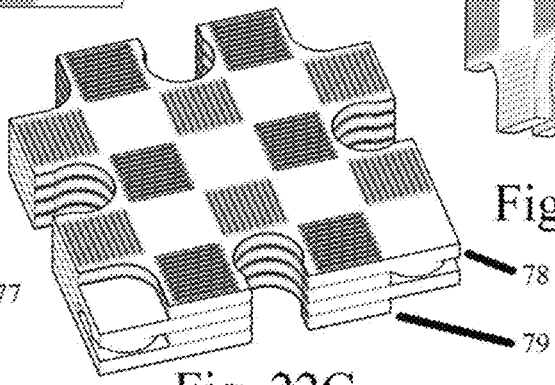
FIG. 22C is a top corner view of how two objects in the shape of FIG. 21D assemble vertically.

FIG. 22C is a top corner view of how two objects in the shape of FIG. 21D (78, 79) assemble vertically.

Figure 22D:
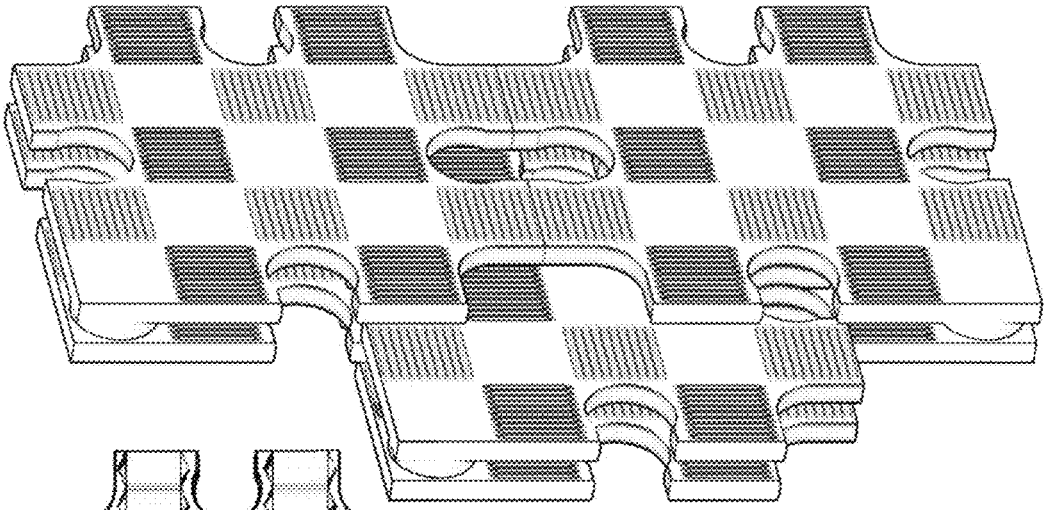
FIG. 22D is a side view of the assembled pieces displayed in FIG. 22B.

FIG. 22D is a side view of the assembled pieces displayed in FIG. 22B.

Figure 23A:
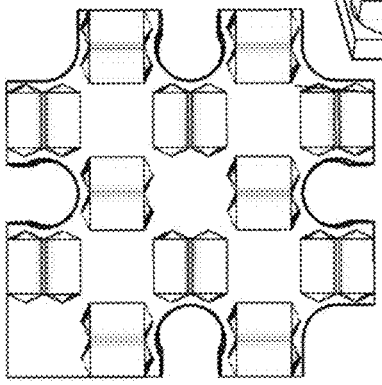
FIG. 23A is a top profile view of FIG. 23B.
Figure 23B:
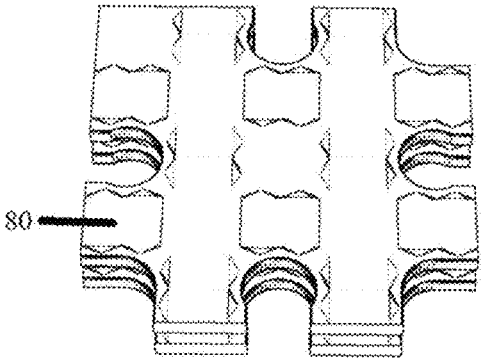
FIG. 23B is similar to FIG. 21D except the undulations are larger.

FIG. 23A is a top profile view of FIG. 23B.

FIG. 23B is similar to FIG. 21D except the undulations (80) are larger.

Figure 23C:
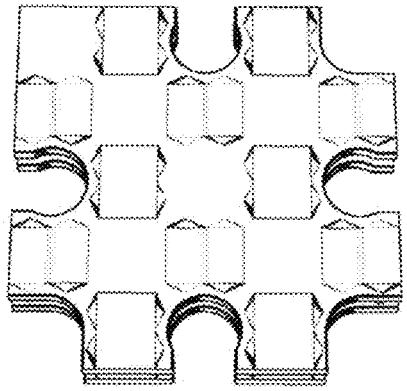
FIG. 23C is a top view of FIG. 23A.

FIG. 23C is a top view of FIG. 23A.

Figure 23D:
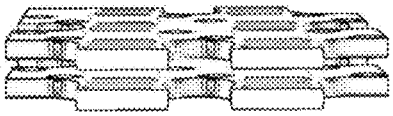
FIG. 23D is a side view of FIG. 23B.

FIG. 23D is a side view of FIG. 23B.

Figure 23E:
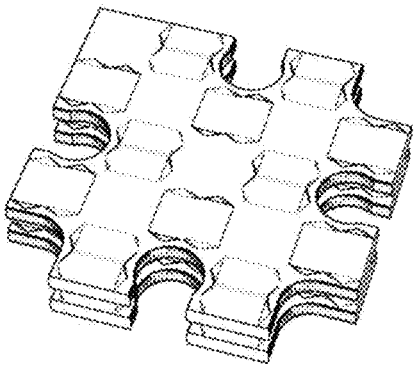
FIG. 23E is a top corner view of FIG. 23B.

FIG. 23E is a top corner view of FIG. 23B.

FIG. 24A is a panel with compressed spheres (81) that fit together in the manner shown in FIGS. 26A and 26B. Once together, they can be locked in place with poles or spheres inserted into the holes that appear in FIG. 26A (82).

FIG. 24B is a top corner view of FIG. 24A.

FIG. 24C is a top side view of FIG. 25A.

FIG. 25A is similar to FIG. 24A except the compressed spheres have less sphere quadrants (83). As a result, they can be assembled not just in the manner shown in FIGS. 26A and 26B but they can also be assembled in the manner shown in FIG. 26C and FIG. 26D, which can also be locked with poles (84, 85).

FIG. 25B is a top side view of FIG. 25A.

FIG. 25C is a side view of FIG. 24A.

FIG. 25D is a top side view of FIG. 24A

FIG. 26A is a profile view of shapes in the form of FIG. 25A (86) and FIG. 24A (87) pressed together.

FIG. 26B is a top corner view of the assembled pieces in FIG. 26A (88, 89).

FIG. 26C is a demonstration of how two pieces that are in the shape of FIG. 25A (90, 91) can assemble to allow more space than the manner of assembling them shown in FIG. 26B.

Figure 26D:
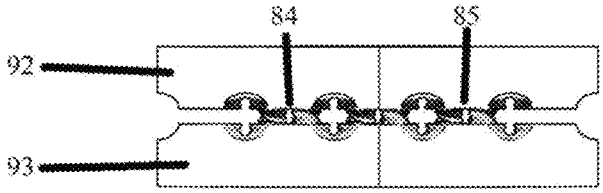
FIG. 26D is a profile view of the assembled pieces in FIG. 26C.

FIG. 26D is a profile view of the assembled pieces (92,93) in FIG. 26C.

Figure 27A:
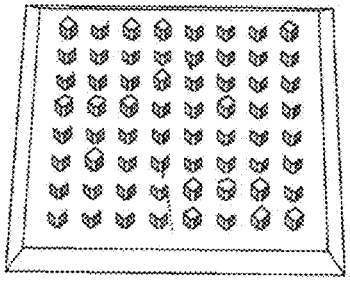
FIG. 27A is a panel that can be assembled onto knob panels like FIG. 28A.

FIG. 27A is a panel that can be assembled onto knob panels like FIG. 28A.

Figure 27B:
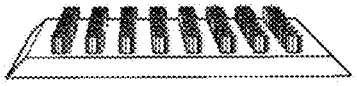
FIG. 27B is a side view of the panel that is FIG. 27A.

FIG. 27B is a side view of the panel that is FIG. 27A.

Figure 27C:
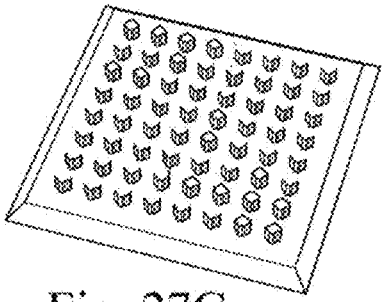
FIG. 27C is a top corner view of FIG. 27A.

FIG. 27C is a top corner view of FIG. 27A.

Figure 27D:
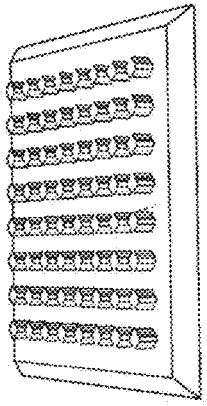
FIG. 27D is a vertical example of the panel that is FIG. 27A.

FIG. 27D is a vertical example of the panel that is FIG. 27A.

FIG. 28A can be assembled into itself because its knobs (94) form female spaces into which other knobs can be inserted. It can also fit into a wide range of the other panels.

Figure 28B:
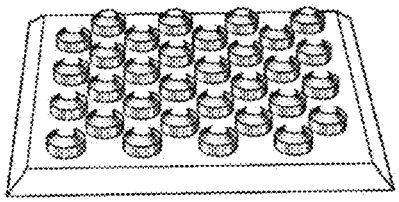
FIG. 28B is a view of FIG. 28A from the top side.

FIG. 28B is a view of FIG. 28A from the top side.

Figure 28C:
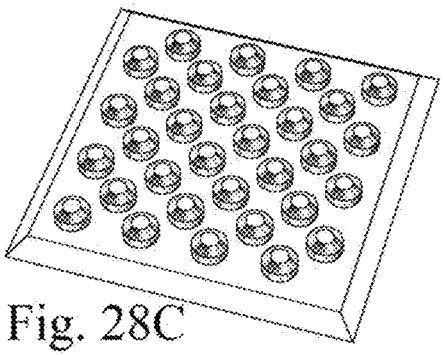
FIG. 28C is a view from a top corner of FIG. 28A.

FIG. 28C is a view from a top corner of FIG. 28A.

Figure 28D:
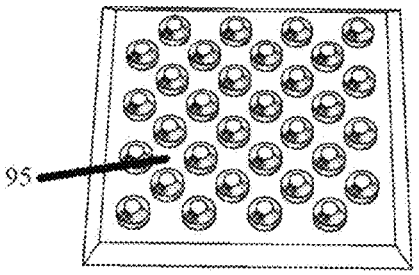
FIG. 28D is a view from the top of FIG. 28A.

FIG. 28D is a view from the top of FIG. 28A where the female spaces between the knobs are more visible (95).

Figure 29A:
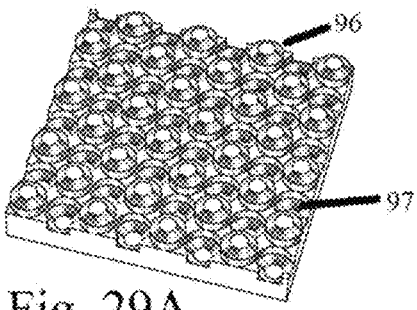

FIG. 29A is a knob panel (96) whose knobs can fit into themselves when the protruding parts (96) insert into the receding parts (97).

Figure 29C:
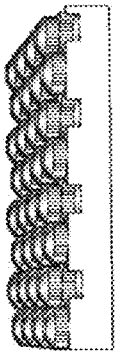
Figure 29B:
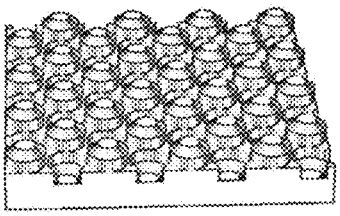

FIG. 29B is a top side view of FIG. 29A.

FIG. 29C is a vertical example of FIG. 29A.

Figure 29D:
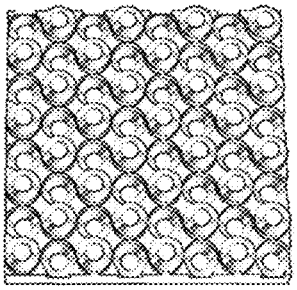

FIG. 29D is a top view of FIG. 29A.

Figure 29E:
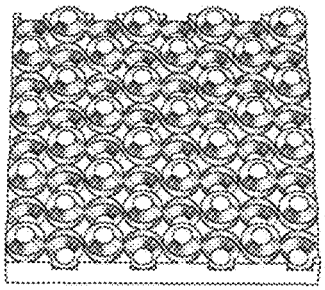

FIG. 29E is another top side view of FIG. 29A.

Figure 30A:
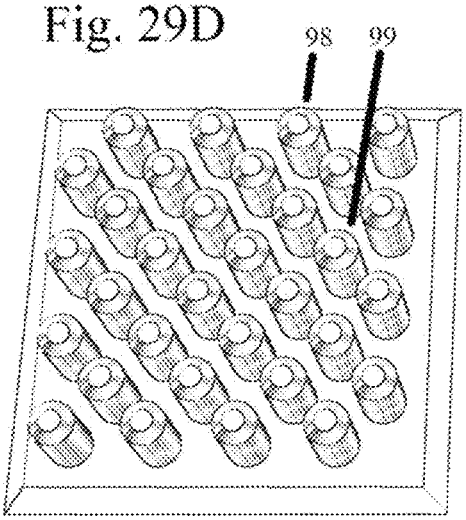

FIG. 30A is a knob panel (98) that fits into itself when the protruding knobs (98) fit into the empty space between the knobs (99) and that has longer knobs for greater stability and temperature insulation when used as a coaster.

Figure 30C:
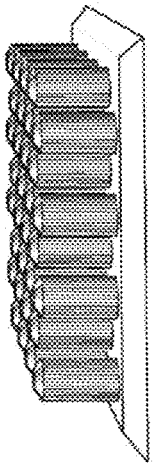
Figure 30B:
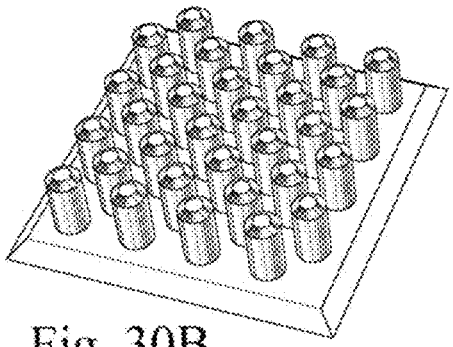

FIG. 30B is a top corner view of FIG. 30A.

FIG. 30C is a vertical example of FIG. 30A.

Figure 30D:
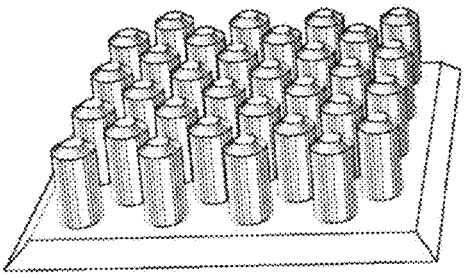

FIG. 30D is a view from a top side of FIG. 30A.

Figure 30E:
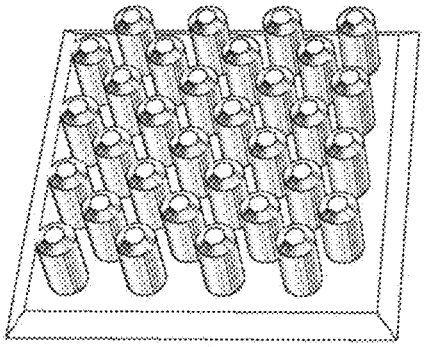

FIG. 30E is a view from further up on a top side of FIG. 30A.

FIG. 31A is a panel of compact male knobs (100) that builds larger panels with FIG. 27A.

FIG. 31B is a top side view of FIG. 31A.

FIG. 31C is a top view of FIG. 31A.

FIG. 31D is a top corner view of FIG. 31A.

FIG. 32A is a reversible panel that locks when poles and spheres are inserted into the holes (101) seen in FIG. 32D (102) when it is inserted into itself.

FIG. 32B is a top side view of FIG. 32A.

FIG. 32C is a top side view of FIG. 32A from another angle.

FIG. 32D is a profile view from the side of FIG. 32A.

FIG. 33A is similar to FIG. 32A except its knobs (103) are shorter.

FIG. 33B is a profile view from the side of an upside-down FIG. 33A.

FIG. 33C is a top side view of FIG. 33A.

FIG. 34A is similar to FIG. 33A except its knobs (104) are shorter and it has empty rows of male knobs on the ends (105) to give it more versatility when affixed next to other panels that have protruding pieces. It can be locked with poles and spheres inserted into the hollow cylinders (106, 107) created when the pieces (108, 109, 110, 111) are assembled as shown in FIGS. 35A and 35B.

FIG. 34B is a top side view of FIG. 34A.

FIG. 34C is an example of how two pieces in the shape of FIG. 34A (112, 113) can fit together when pushed into each other.

FIG. 34D is a top corner view of FIG. 34A.

FIG. 35A is a profile view of the pieces in FIG. 34C (108, 109) after they have been pushed together.

FIG. 35B is a side view at an angle of FIG. 35A.

FIG. 36A is similar to the preceding panels except the locking shafts into which poles lock the pieces when they are affixed to themselves run in two directions (114, 115) and at 90 degrees to each other, making it a more versatile building piece that can be locked in more than one direction.

FIG. 36B is a top side view of FIG. 36A from a different angle.

FIG. 36C is a vertical view of FIG. 36A.

FIG. 37A is similar to the prior FIGs. except it has large sloping sides (116) that can be magnetized to help it make cubes in the manner shown in FIG. 38. The alternating "higher (117) and lower (118)" heights of its male knobs seen in FIG. 37C also allows the gaps between those higher male knobs to operate as receding places (119), or female interfaces, for male knobs to be inserted.

FIG. 37B is a top corner view of FIG. 37A,

FIG. 37C is a side profile view of FIG. 37A.

FIG. 37D is a vertical view of FIG. 37A.

FIG. 37E is a side view of FIG. 37A.

FIG. 37F is a side view of FIG. 37A from a different angle.

FIG. 37G is a top view of FIG. 37A.

FIG. 37H is a top side view of FIG. 37A from a slightly different angle.

FIG. 38 is a demonstration of how FIG. 37A (120, 121) with magnetized sides make a cube.

FIG. 39A is a profile view from the bottom of FIG. 39A.

FIG. 39B is a basic panel outline whose slanted sides (122) can be magnetized to allow it to form panels and cubes. Magnetized poles can then be inserted (123, 124) to join panels or to reinforce them.

FIG. 39C is a view from a side of FIG. 39B.

FIG. 39D is a top corner view of FIG. 398.

FIG. 39E is a top view of FIG. 39B.

FIG. 40A is similar to FIG. 39B except it has empty corners (125) that allow it to form panels in two directions (126, 127)(not just in one direction) and it has reversible snaps (128, 129) (shown close-up in FIGS. 40C and 40D) with which it can hold itself together. Those snaps are locked when poles or spheres are inserted into the open cylindrical space that exists on the sides of the pieces (130, 131) when they are assembled.

FIG. 40B is a side view of FIG. 40A.

FIG. 40C is a close-up view at an angle of the snaps on FIG. 40A.

FIG. 40D is a head-on close-up view of the snaps on FIG. 40A.

FIG. 40E is a close-up view at an angle of a side of FIG. 40A.

FIG. 40F is a view from a top side corner of FIG. 40A.

FIG. 41A is a panel similar to the prior panels in that the ratios of the empty center space (132) to the total size of the piece (133) are the same. Also, the circular recess on the sides of the piece (134) are the same dimensions as those of the prior pieces. That circular space is one half the size of the border area.

FIG. 41B is a side view of FIG. 41A.

FIG. 41C is a close-up view of a side of FIG. 41A.

FIG. 42 shows how FIG. 41A fits into itself (135, 136) to forma 90-degree joint (37).

With additional panels an entire cube can be assembled. With reversible magnetic patterns on the flat side of the piece (138), the assembled cubes can in turn be assembled into walls that that have a lattice or scaffolding appearance. The hole in the bottom right of FIG. 42 (137) shows how the pieces snap together on their own and how, once snapped together, they can be locked with spheres inserted into that open area. Also, they can be locked and reinforced with poles inserted into that opening area.

FIG. 43A is a close-up view of a side of the panel that is FIG. 43C.

FIG. 43B is a profile view of the side of the panel shown in FIG. 43C.

FIG. 43C is a panel that is similar to the prior panels except that its reversible edges (138) are secured in place with the insertion of poles or spheres. The edges can also be magnetized in a reversible manner that allows it to be assembled with more stability and strength. The center part of FIG. 43A has an artistic pattern of holes that allow light through as is seen in FIG. 43D (139) and 43E (140). Those holes also can secure pieces together with knobs that have the shape of those holes as is shown in FIG. 48A (141). In addition, the panels can be secured together with poles that have hooks that grab onto the point that protrudes into the hole (142) when the poles are inserted into that hole and rotated to hook in place. That pole is FIG. 48B.

FIG. 43D is a profile view from the bottom of FIG. 43C.

FIG. 43E is a profile view from the top of FIG. 43C.

FIG. 44A is a panel that follows the same basic logic as the prior panels except that the hole on the side is much smaller and is also a snapping mechanism. That hole is shown in FIG. 44B (143). As with the standard operating abilities of these panels, this panel can be assembled at 90-degree and 180-degree angles to form larger panels or to form cubes. Once snapped in place, this FIG. 44A can be locked with a pole or with spheres that are much smaller in size relative to the total size of the panel. The ratios of sizes of features in these panels, like the small hole in this piece, are all of a standard nature in that they are either one half the size of the height of the piece, one fourth, one eighth the size. etc. This facilitates scaling and adjusting the features to make them compatible with all other pieces.

FIG. 44B is a profile close-up view of a side of FIG. 44A where the hole in the side is clearly visible (143).

FIG. 44C is a view from a top side of FIG. 44A.

FIG. 44D is a view from an angle of one of the sides of FIG. 44A.

FIG. 45A is a close-up view of a side of FIG. 45B.

FIG. 45B is a panel that also uses its sides to be large hooks (144) that fit into themselves (145) when the panels (146, 147) are assembled in the manner shown in FIG. 46. Those hooks can be locked by inserting poles and spheres into the cylinder that forms (148). This panel can also assemble at 180-degree angles, FIG. 45C is a close-up view of the side of FIG. 45B.

FIG. 46 shows how the FIG. 45B panels assemble.

FIG. 47A is a panel following the logic of the prior panels and it can affix itself together with a reversible knob panel in the middle (149) as can be seen in FIG. 47A. FIG. 47C shows the hole pattern that also exists in the middle of the piece (150) through which poles can hook to affix this panel to itself with a pole that has hooks on the end in the manner shown in FIG. 48A (141). The pole is FIG. 48B and a closeup view of the hook interface at the end of that pole (151) is FIG. 48C.

FIG. 47B is a view from the bottom of FIG. 47A.

FIG. 47C is a profile view from the top of FIG. 47A.

FIG. 47D is a side view of FIG. 47A.

FIG. 48A is a demonstration of how the pole that is FIG. 48B (152) fits into (141) the panel that is FIG. 47A (153).

FIG. 48B is a pole that is inserted into a hole in FIG. 48A (141).

FIG. 48C is a closeup view of the hook interface (151) at the end of FIG. 48B (154).

FIG. 49A is a panel that can be assembled into a larger panel, into a cube (155, 156 & 157 in FIG. 49D and 158, 159 & 160 in FIG. 49E) and into cube walls that form the shape of shelving (see, for example, shelf at 161 in FIG. 49H). FIG. 49G is a profile view from the top of the partially assembled cube at FIGS. 49D and 49E. For the panel to fully assemble into intersecting cubes at each 90-degree angle. the hollow cubes on its edges (162) must be aligned in the manner shown in FIG. 49F. That way, when assembled into the shape at FIG. 49H, that shape will in turn fit into itself (FIG. 49H forms a partial set of cubes, but does not fit into itself on the right side (163) because the hollow cubes on the edges (163, 164) are not aligned to all fit snugly).

FIG. 49B is a close-up view at an angle of a side of FIG. 49A.

FIG. 49C is a profile view from the top of FIG. 49A.

FIG. 49D is a demonstration of a partially assembled cube with FIG. 49A shapes (155, 156, 157).

FIG. 49E is a view of the back side of FIG. 49D.

FIG. 49F is a demonstration of a different way to assemble panels that are FIG. 49A, FIG. 49G is a profile view from the top of FIG. 49A panels assembled into each other.

FIG. 49H is an example of more FIG. 49A panels (165, 166, 167) assembled into each other.

FIG. 50A is a profile view from the top of FIG. 50B.

FIG. 50B is a panel that can have disc magnets inserted in the positive (168) and negative (169) pattern shown to attract the panel to itself to form larger panels and cubes.

FIG. 51A is a coaster that also fits into boxes to form a lid. It also forms vertical stacked constructions when assembled with the panels that follow it at FIG. 52A and following.

FIG. 51B is a view from a top corner of FIG. 51A.

FIG. 51C is a profile view from the bottom of FIG. 51A.

FIG. 52A is a reversible coaster series that can stack with pieces in the series itself manner generally similar to the assembled pieces demonstrated in FIG. 55B. Its protruding edges (170) fit into the receding edges (171).

FIG. 52B is a profile view from the top of FIG. 52A.

FIG. 52C is another view from a top corner of FIG. 52A but from a slightly different angle.

FIG. 52D is similar to FIG. 52A except it has longer simpler lips (172) on the side.

FIG. 53A is similar to FIG. 52A except that it stacks higher (173) and it forms a box as shown in FIG. 538 (174, 175).

FIG. 53B shows how FIG. 53A stacks (174, 175) higher than FIG. 52A.

FIG. 54A is similar to FIG. 53A except that it also forms a bowl (176) whose sides grab onto themselves to secure it in place.

FIG. 54B is similar to FIG. 54A except that it only rests on itself and grabs onto itself at the ends of the protruding sides (177, 178), not on the face of the protruding sides (179) as is the case with FIG. 54A.

FIG. 54C is a demonstration of how FIG. 54B (180, 181) fits into itself, FIG. 55A is a simple coaster panel that fits into itself in the manner shown in FIG. 55B (182, 183) and it fits into a large number of the other panels at FIG. 52A and following.

FIG. 55B is a demonstration of how a simple coaster panel fits into itself (182, 183).

FIG. 56A is similar to the prior panels except it has feet that are reversible knobs on the bottom (184) that can be easily seen in the view of FIG. 56B (185). It assembles into itself in the manner shown in FIG. 58 where the edges fit together (186) and where the feet fit together (187).

FIG. 56B is a profile view from the bottom of FIG. 56A.

FIG. 57 is an example of how coaster panels of different geometries (188, 189) fit together. Specifically, FIG. 57 (188) is panel 54A fit into 52D (189).

FIG. 58 is an example of how FIG. 56A assembles into itself (186, 187).

FIG. 59A is similar to FIG. 56A except it has an additional large reversible knob in the middle that is twice the size of the other knobs as is clearly shown in FIG. 59B (190).

FIG. 59B is a profile view from the bottom of FIG. 59A.

FIG. 60A is a profile view from the top of FIG. 608.

FIG. 60B is a panel that holds knobs, reversible knobs (like those shown in FIG. 59B) and hooks in its holes (191, 192, 193). Its sides (194) can be magnetized to be affixed into panels with the basic configuration shown in FIG. 39D. If holes are placed through the sides of FIG. 60B (194), it can also be secured with knobs and poles from the sides.

FIG. 61A is similar to FIG. 59A except it has more reversible knobs (195).

FIG. 61B is a profile view from the bottom of FIG. 61A.

FIG. 61C is a view from the side of FIG. 61A.

FIG. 61D is a demonstration of how FIG. 61B can be rotated 180 degrees and keep the same interfaces (196).

FIG. 62A is a coaster panel that can be snapped into itself in the manner shown in FIG. 63A (197, 198) and 63B. When it is snapped together it can be locked with a sphere being placed in the middle of the cavities that snap together, two of which are on each panel that are also easily visible in FIG. 62B (199) and 62C (200). Up to four spheres will fully lock this piece once it is snapped shut. To do so, the user must first place the spheres on the sides of the locking cavities that are at the top and bottom of FIG. 62C (201, 202, 203, 204). Then, when another FIG. 62A piece is snapped onto that piece, the snapped-in-place construction must be shaken so the spheres move to the middle of the shafts in the cavities and get lodged in the middle (205). Then, those cavities will not un-snap as easily as they would have in the absence of the spheres being held in place. To unlock, the snapped object must be jolted so the spheres become dislodged from the middle and fall back to one side (201, 202, 203, 204). Then the construction can be un-snapped.

FIG. 62B is a view from the top of FIG. 62A.

FIG. 62C is a profile view from the top of FIG. 62C.

FIG. 63A is an example of how FIG. 62B pieces (197, 198) fit together vertically.

FIG. 63B is a side profile view of FIG. 63A.

FIG. 63C is a wireframe view of FIG. 63B.

FIG. 64A is similar to FIG. 62A except the sides of the piece are open (199) so that both spheres and poles can be inserted to lock the assembled pieces. The assembled pieces (200, 201) are in FIG. 65B.

FIG. 64B is a profile view from the side of FIG. 64A.

FIG. 64C is a view from a bottom side of FIG. 64A.

FIG. 65A is a close-up view of FIG. 65B.

FIG. 65B is a profile view of the side of FIG. 65C.

FIG. 65C is a demonstration of how FIG. 64A pieces (202, 203) assemble.

FIG. 66A is a coaster that snaps together with "s" snaps, the intersection of which is denoted by element 204 in FIG. 67A. Element 205 in FIG. 67B is a close-up view of FIG. 66A that shows the "s" shaped snap. This snap is arranged along the straight lines (206) shown in FIG. 66C and it appears in the circular part of that FIG. (207)

FIG. 66B is a close-up view of ridges on FIG. 66A.

FIG. 66C is a profile view of the bottom of FIG. 66A,

FIG. 67A is a demonstration of how FIG. 66A pieces (208, 209) come together.

FIG. 67B is a close-up view of FIG. 66A.

FIG. 68A is similar to FIG. 1I except the holes (210) are smaller in relation to the piece and FIG. 68 can also have an object with a smaller shape snap into the indented area shown in the middle of FIG. 68D (211), FIG. 68D is a top view of FIG. 68A.

FIG. 68C is a side view of FIG. 68A.

FIG. 68D is a profile view from the bottom of FIG. 68A.

FIG. 68E is a top corner view of FIG. 68A.

FIG. 69A is a profile view of FIG. 69B.

FIG. 69B shows how a flexible materials construction of this piece can fit into itself (212, 213) using the reversible knob.

FIG. 70A is a close-up view of a coaster panel that can be assembled into a cube in the manner shown in FIG. 71A (214, 215, 216, 217, 218). This piece follows the same principles as prior panels (like the panel assembled at FIG. 49H) except the hole in the center of the squares on the edges (219) is smaller to correspond to roughly the size of a nail in certain objects.

FIG. 70B is a profile view of the side of the panel shown in FIG. 70A.

FIG. 70C is a profile view from the top of the panel shown in FIG. 70A.

FIG. 71A is a demonstration of how panels that are FIG. 70A (214, 215, 216, 217, 218) can be assembled.

FIG. 71B is a profile view from the top of FIG. 71A.

FIG. 71C is a view from a bottom corner of FIG. 71A.

FIG. 71D is a view from a top corner of FIG. 71A.

FIG. 72A is a profile view from the side of FIG. 72C.

FIG. 72B is a profile view from the top of FIG. 72C.

FIG. 72C is a panel that has both small (220, 221) and wide (222) holes for side shafts to secure the panels in place. This way panels can form cubes secured with small poles (223, 224, 225, 226, 227, 228, 229, 230) in the way shown in FIGS. 73E through 73L and those cubes can in turn be assembled with holes for the large poles (231, 232, 233, 234, 235, 236, 237, 238, 239, 240) in the manner shown in FIGS. 73M through 73V.

FIG. 72D is another top corner view of FIG. 72C.

FIG. 72E is a side view of FIG. 72C.

FIG. 73A is a demonstration of how panels that are FIG. 72A (242, 243) assemble.

FIG. 73B is a different view of FIG. 73A.

FIG. 73C is a backside view of FIG. 73B.

FIG. 73D is a demonstration of how two FIG. 73C (244, 245, 246, 247) can be assembled.

FIG. 73E is a profile view from the top of FIG. 73D.

FIG. 73F is a view of FIG. 73D from a different angle.

FIG. 73G is FIG. 73F with an additional FIG. 72A panel (248).

FIG. 73H is a view of the opening of FIG. 73G.

FIG. 73I is an example of how FIG. 72A panels assemble without the corner squares (249, 250) being together.

FIG. 73J is a profile view of the top of FIG. 73H.

FIG. 73K is an example of how FIG. 72A panels assemble with the corner squares being together (251, 252).

FIG. 73L is a view of FIG. 73K from a different angle.

FIG. 73M is a demonstration of how two FIG. 73L objects (253, 254) assemble.

FIG. 73N is a profile view from the top of FIG. 73M.

FIG. 73O is a demonstration of how four FIG. 73L objects (255, 256, 257, 258) assemble.

FIG. 73P is a demonstration of how three FIG. 73L (259, 260, 261) objects assemble.

FIG. 73Q is a demonstration of how five FIG. 73L objects (262, 263, 264, 265, 266) assemble.

FIG. 73R is a demonstration of how six FIG. 73L objects (267, 268, 269, 270, 271, 272) assemble.

FIG. 73S is a demonstration of how seven FIG. 73L objects (273, 274, 275, 276, 277, 278, 279) assemble.

FIG. 73T is a profile view from a side of FIG. 73U.

FIG. 73U is a demonstration of how eight FIG. 73L objects (280, 281, 282,283, 284, 285, 286) assemble (only 7 are visible).

FIG. 73V is a different view of FIG. 73U.

FIG. 74A is a close-up view of the side of FIG. 74C.

FIG. 74B is a side profile view of FIG. 74C.

FIG. 74C is like FIG. 70A except it has bumpy protrusions (287) that have "s" snaps with which the pieces snap together on the sides in the manner shown in FIG. 75B (288). A closeup view of the snaps (289) is in FIG. 74A. Their orientation just before being snapped together is in 41) FIG. 75A (290). FIG. 74C also has indentations where these protrusions can rest so the constructions build with it can be stabilized (291).

FIG. 74D is a profile view from the bottom of FIG. 74C.

FIG. 75A is a demonstration of how FIG. 74C pieces (292, 293) fit together.

FIG. 75B is a wireframe view of FIG. 74C pieces fitting together.

FIG. 76A is a side profile view of FIG. 76B.

FIG. 76B is similar to FIG. 74C except it only has protruding (294) and receding (295) areas and not protruding "s" snaps. FIGS. 74, 70 and 76 can be used together.

FIG. 76C is another view from a top corner of FIG. 76B.

FIG. 76D is a profile view from the bottom of FIG. 76B.

FIG. 77 is a pencil-like object that locks the panel constructions in place.

FIG. 78 is similar to FIG. 77 except it has a pointed end (296). These pieces have two snap areas on them where they snap onto the panels when inserted. Because the pieces can be of any size, FIGS. 77 and 78 can be pens, pencils, nails, straws or toothpicks.

FIG. 79A is a profile view from the side of FIG. 79E.

FIG. 79B is a side view of FIG. 79E.

FIG. 79C is a top view of FIG. 79E.

FIG. 79D is a profile view of the bottom of FIG. 79E.

FIG. 79E is similar to FIG. 15A except it is larger so that it can interface with other larger panels, like FIG. 49A.

FIG. 79F is a close-up view of a side of FIG. 79E.

FIG. 79G is a close-up view of a corner of FIG. 79E.

FIG. 80A is a side profile view of FIG. 80D.

FIG. 80B is a side view of FIG. 80D.

FIG. 80C is a top view of FIG. 80D.

FIG. 80D is similar to FIG. 79E except it has less block protrusions (297) on the edges so that it can build a more versatile set of constructions. Not only can it build cubes and larger panels as is shown in FIG. 81B (298, 299, 300), it can also build shelves by continuing to build out the area shown at FIG. 81A (301, 302, 303).

FIG. 80E is a profile view from the bottom of FIG. 80D.

FIG. 81A is an example of how FIG. 80D (301, 302, 303) panels can build shelves.

FIG. 81B is an example of how FIG. 80D (298, 299, 300) can build more versatile constructions.

FIG. 82A is a side view of FIG. 82D.

FIG. 82B is a top side view of FIG. 82D.

FIG. 82C is a profile bottom view of FIG. 82D.

FIG. 82D is a coaster that fits into itself in the ways shown in FIG. 83A (304, 305, 306, 307) that is also compatible with the pieces at FIGS. 51A through 61A.

FIG. 83A is an example of how FIG. 82D coasters (304, 305, 306, 307) fit into themselves.

FIG. 83B is a side profile view of FIG. 83A.

FIG. 84A can fit into itself in the manner shown in FIG. 84C (308, 309, 310, 311, 312, 313, 314).

FIG. 84B is a side view of FIG. 84A.

FIG. 84C is an example of how FIG. 84A pieces (308, 309, 310, 311, 312, 313, 314) fit into themselves.

FIG. 85A is a side view of FIG. 85D.

FIG. 85B is a top side view of FIG. 85D.

FIG. 85C is a bottom profile view of FIG. 85D.

FIG. 85D fits into itself and can hold large knobs and hooks in the circles at its center (315).

FIG. 86A is similar to FIG. 84A except it has a snake pattern that undulates at different heights (316, 317).

FIG. 86B is a side view of FIG. 86A.

FIG. 86C is a bottom profile view of FIG. 86A.

FIG. 87A is a profile view from the bottom of FIG. 87C.

FIG. 87B is a side view of FIG. 87C.

FIG. 87C is a coaster with different combinations of interfaces found in prior pieces to demonstrate that these interfaces are modular because they are interchangeable. These are modular pieces with modular interfaces.

FIG. 88A is a coaster panel with blocks on the edges (318) that allow it to be assembled to form a larger continuous flat panel as is shown in FIG. 89A (319, 320, 321, 322). It can also be assembled to form a cube in a manner that is similar to FIG. 91. FIG. 91 itself is specifically an assembly of FIG. 89B (323, 324, 325) into a cube; these panels operate in a similar manner to build both panels and cubes.

FIG. 88B is a vertical view of FIG. 88A.

FIG. 88C is a profile view from the bottom of FIG. 88A.

FIG. 88D is a view from the top of FIG. 88A.

FIG. 89A is a demonstration of how FIG. 88A panels (319, 320, 321, 322) assemble.

FIG. 89B is a demonstration of how FIG. 90B panels assemble.

FIG. 90A is a close-up view of a side of FIG. 90B.

FIG. 90B has a wavy pattern on the blocks on the edges (326) that is like FIG. 17A except FIG. 90A has a middle area that is larger relative to the geometries on its edges to allow it to interface with other pieces with similar ratios. While it is tempting to think of FIG. 90B as being larger than FIG. 17A, they are not necessarily of different sizes and in fact FIG. 17A could be larger than FIG. 908. The ratios of the features to each other are the guiding principle and not the absolute size of the pieces.

FIG. 90C is a profile view from the bottom of FIG. 90B.

FIG. 91A is a close-up view of a side of FIG. 91B.

FIG. 91B is similar to FIG. 90B except it has a pattern of square snaps on the protruding triangles on its edges (327) that are visible in FIGS. 918 and 91C. This allows it to snap and lock in place when the panels are assembled perpendicularly, as is shown in FIG. 92A (328, 329), and then they are assembled horizontally, as is shown in FIG. 92B, where the wireframe of one panel is black and the other panel is orange (330, 331).

FIG. 91C is a close-up view at an angle of FIG. 91A.

FIG. 91D is a profile view from the bottom of FIG. 918.

FIG. 92A shows how FIG. 91B (328, 329) assembles into itself perpendicularly.

FIG. 92B shows how FIG. 91B (330, 331) assembles into itself horizontally.

FIG. 93A is a close-up view of a corner of FIG. 93B.

FIG. 93B is a panel that is similar to FIG. 91B except its edges undulate (332) so that it can be assembled into a cube with flat sides, as is seen in FIG. 94B (333, 334); the interlocking edges are most visible in FIG. 94K (335), and so that it can be assembled into smooth surfaces as is seen in FIG. 94L (336, 337), 94M (338, 339, 340, 341) and 94N (342, 343, 344, 345). The bottom side of the panel when assembled to form a smooth flat surface on the top is shown in FIG. 94O (346). Additional views of FIG. 94A are of the panel that is FIG. 93C assembled, or partially assembled, to form a cube.

FIG. 93C is a top profile view of FIG. 938.

FIG. 93D is a side profile view of FIG. 93B.

FIG. 93E is a profile view of the bottom of FIG. 93B.

FIG. 94A is an example of how panels that are FIG. 93B (347, 348, 349, 350) assemble.

FIG. 94B is another example of how FIG. 93B panels assemble.

FIG. 94C is an example of how an additional FIG. 93B (351) panel assembles into FIG. 94A.

FIG. 94D is a profile view from the bottom of assembled panels.

FIG. 94E is a profile view of the open side of FIG. 94A.

FIG. 94F is a view of the object at FIG. 94C from a different angle.

FIG. 94G is a wireframe view of a cube made from FIG. 938 panels.

FIG. 94H is a profile view of a cube of assembled panels.

FIG. 94I is a top side view of four panels (352, 353, 354, 355) assembled together.

FIG. 94J is a profile view of the open side of FIG. 94I.

FIG. 94K is a top corner view of the cube shown in FIG. 94H.

FIG. 94L is an example of how FIG. 93B panels (336, 337) assemble.

FIG. 94M is an example of how four FIG. 93B panels (338, 339, 340, 341) assemble.

FIG. 94N is a profile view from the top of FIG. 94L.

FIG. 94O is a view from the bottom of FIG. 94N.

FIG. 95A is a close-up view of a side of FIG. 95C.

FIG. 95B is a profile view of the side of FIG. 95C.

FIG. 95C is similar to FIG. 93B except its edges are rounded (356), and not as pointed, for safety and to make them stronger. FIG. 95C (357, 358) assembles at 90-degrees in the manner shown in FIG. 96C and forms a cube in the manner shown in FIG. 96D (359, 360, 361), 96E (362, 363, 364) and 96F (365, 366, 367, 368). FIG. 95C assembles into smooth panels surfaces as is shown in FIG. 96G (369, 370, 371, 372), 96H (373, 374), 96I (375, 376, 377, 378) and 96J (379, 380, 381, 382). The bottom view of these smooth larger assembled panels is shown in FIGS. 96K and 97L.

FIG. 95D is a close-up view from the bottom of FIG. 95C.

FIG. 96A is an example of how FIG. 95C (383, 384) pieces assemble.

FIG. 96B is a profile view of an open side (385) of FIG. 96A.

FIG. 96C shows how FIG. 95C (357, 358) assembles.

FIG. 96D is a close-up view of how FIG. 95C pieces (359, 360, 361) assemble.

FIG. 96E is a view of how FIG. 95C (362, 363, 364) pieces assemble.

FIG. 96F is a profile view of FIG. 96E.

FIG. 96G is a view of how FIG. 95C pieces (369, 370, 371, 372) assemble horizontally.

FIG. 96H is a top side view of FIG. 96G.

FIG. 96I is a view from a top side of FIG. 96G.

FIG. 96J is a top profile view of FIG. 96G.

FIG. 96K is a bottom view of FIG. 96G.

FIG. 96L is a bottom corner view of FIG. 96G.

FIG. 97A is a close-up view of a corner of FIG. 97B.

FIG. 97B is a knob cube that can be assembled into coasters, walls, panels and larger cubes. It is a cube form of FIG. 29A.

FIG. 97C is a profile view of FIG. 97B.

FIG. 97D is another close-up view of a corner of FIG. 97B.

FIG. 98A is a close-up view of a corner of FIG. 98B.

FIG. 98B is similar to FIG. 97B except FIG. 98B has shafts on the side (386, 387, 388) through which reinforcement poles can be inserted or through which poles and spheres can be transported. Those shafts and poles can be magnetized in a reversible manner to enable the inserted poles and spheres to attract cube constructions to be stronger.

FIG. 98C is a profile view of a side of FIG. 98B.

FIG. 99A is similar to FIG. 98B except it has four additional pole shafts on the edges of each profile view as can be seen in FIG. 99A (389, 390, 391, 392) and 99B (393, 394, 395, 396). FIG. 99A shows shafts that also have protruding knobs (397) onto which poles can hook to affix the cubes together with hooked poles.

FIG. 99B is a profile view of FIG. 99A from a different angle.

FIG. 99C is a top corner view of FIG. 99A.

FIG. 100A is a pole with hook interfaces on its ends (398, 399) that hooks FIG. 99A pieces together. It is the same as FIG. 488.

FIG. 100B is a side profile view of FIG. 100A.

FIG. 100C is a view from an end of FIG. 100A.

FIG. 101A is a side profile view of FIG. 101C.

FIG. 101B is a view of FIG. 101C from a slightly different angle.

FIG. 101C is a cube version of the panel at FIG. 28A (400).

FIG. 102A is a top side view of FIG. 102C.

FIG. 102B is a side profile view of FIG. 102C.

FIG. 102C is similar to FIG. 97B except it has less protruding knobs on the edges (401, 402) to make it easier to stack it with other pieces.

FIG. 103A is a corner side view of FIG. 103C.

FIG. 103B is a side profile view of FIG. 103C.

FIG. 103C is a cube version of FIG. 24A.

FIG. 103D is a close-up view of FIG. 103C.

FIG. 103E is a different view of FIG. 103C.

FIG. 104A is a cube version of FIG. 41A (403). The series of objects at FIG. 105A and following is comprised of FIG. 104A cubes assembled together (404, 405, 406, 407, 408, 411, 412). In those FIGs. it is clear how the cubes snap together to form hollow cavities (409, 410) into which poles or spheres can be inserted to lock the pieces in place.

FIG. 104B is a slightly different view of FIG. 104A.

FIG. 104C is a close-up view of FIG. 104A.

FIG. 104D is a close-up view of how two 104A (413, 414) pieces snap together.

FIG. 104E is a close-up view of a corner edge of FIG. 104A.

FIG. 104F is a close-up view looking directly at a corner edge of FIG. 104A.

FIG. 104G is a profile close-up view of a corner edge of FIG. 104A.

FIG. 104H is a profile view from a side of FIG. 104A.

FIG. 104I is a corner view of FIG. 104A.

FIG. 105A is an example of how FIG. 104A pieces (404.405) assemble.

FIG. 105B is a close-up view of the intersection point (410) of the objects that make up FIG. 105A (411, 412).

FIG. 105C is a demonstration of how an additional FIG. 104A (406) piece assembles onto a FIG. 105A piece (407, 408).

FIG. 106A is the beginning of a set of tubes of exponentially larger (415) and smaller (416) sized that are arranged into the dimensions of an equilateral cube that is as high as it is deep and wide. It fits into itself in the manner shown in FIG. 107A (417, 418).

FIG. 106B is a different side view of FIG. 106A.

FIG. 106C is a top corner view of FIG. 106A.

FIG. 107A shows how FIG. 106A (419, 420) fits into itself (417, 418).

FIG. 107B is an example of how FIG. 112A pieces (421, 422) fit onto FIG. 107A (423).

FIGS. 108A through 111A are panels that can be affixed to the tubes on FIG. 106B to convert the tubes of that cube into a smooth cube.

FIG. 108A is a panel that fits onto FIG. 106B (424).

FIG. 108B is a front view of FIG. 108A.

FIG. 108C is a close-up view of the hole in FIG. 108A.

FIG. 109A is the front side of FIG. 109B.

FIG. 109B is a modular interface that fits onto each of the tube ends of FIG. 106B (the large and small ends at 425, 426) to form a smooth surface.

FIG. 110A is a panel with a center hole (427) that fits onto poles in FIG. 106B (428).

FIG. 110B is the front side of FIG. 110A.

FIG. 111A is a panel with a center hole (429) that fits onto poles in FIG. 106B (430).

FIG. 111B is a slightly different view of FIG. 111A.

FIG. 111C is the front view of FIG. 111A.

FIG. 112A is cube with inverted space of FIG. 106B, meaning that instead of having tubes it has hollow shafts (431, 432, 433, 434) where tubes can be inserted. It can be affixed to itself and to FIG. 106B (423) in the manner shown in FIG. 107B.

FIG. 1128 is a view of FIG. 112A from a different angle.

FIG. 112C is an additional example of FIG. 112A from a different view.

FIG. 112D is a view of FIG. 112A from a different angle.

FIG. 113A is a profile view of FIG. 113B.

FIG. 1139 is a cube that has square cubes on it (435, 436) that can be affixed to themselves in a reversible manner. Once affixed together they can be locked in place with smaller tubes in the holes shown in FIG. 113D (437, 438). FIG. 113B also has larger circular shafts (439) into which poles can be inserted to strengthen the constructions that it builds or to extend constructions into new areas or into new kinds of interfaces.

FIG. 113C is a view of FIG. 113B from a slightly different angle.

FIG. 113D is a close-up view of FIG. 113B.

FIG. 114A is a profile view of FIG. 114B.

FIG. 114B is a cube version of FIG. 61A (440).

FIG. 115A is an assembled box version of the box that is built with FIG. 80A (441, 442). Like the panel that is FIG. 80A, it can assemble with itself and with panels. It can also hold panels and other pieces inside (443).

FIG. 115B is a different view of FIG. 115A.

FIG. 115C is a view from the bottom of FIG. 115A.

FIG. 116 is a box version of the panel at FIG. 52D (444) that can hold other panels and can serve as a smooth lining (445) of other boxes in the manner shown in FIG. 118.

FIG. 117A is a box version of the panel at FIG. 74C.

FIG. 117B is a profile view of FIG. 117A.

FIG. 118 shows how FIG. 116 (446) fits into FIG. 117A (447).

The invention claimed is:

1. A block system comprising:

a plurality of objects;

wherein a first set of said plurality of objects are panels;

each said panel having:

a perimeter;

four main edges, said panels further having a first side, a second side opposite said first side and a thickness therebetween defining said perimeter;

said first side comprising a plurality of rows defined by a plurality of knobs and recesses arranged in an alternating manner along a length of each said respective row, said perimeter having a single row of a plurality of recesses, each said recess of said first side and said perimeter configured to receive a respective said knob of another said panel, each said main edge having a protrusion extending therefrom having a first surface substantially coplanar with said first side, and each said protrusion having a second surface opposite said first surface and being substantially coplanar with said second side, each said first side of said protrusion having a recess;

each said recess of said first side and said protrusions being substantially cylindrical and having diametrically opposed first and second cutouts, each said cutout having a first sidewall and a second sidewall facing said first sidewall and being at an angle diverging from a center of a center of said recess;

each said knob of said first side comprising a first extension and a second extension with a space therebetween, each said extension having a tapered distal free end, each said first extension having an inner surface facing a respective inner surface of respective said second extension, said inner surfaces being concave in shape;

said second side being a substantially flat, uninterrupted surface.

* * * * *